US008196924B2

(12) United States Patent
Numauchi

(10) Patent No.: US 8,196,924 B2
(45) Date of Patent: Jun. 12, 2012

(54) DRIVE CONTROL METHOD AND DRIVE CONTROL APPARATUS FOR PROCESSING MACHINE

(75) Inventor: Hiromitsu Numauchi, Tsukuba (JP)

(73) Assignee: Komori Corporation, Tokyo (JP)

( * ) Notice: Subject to any disclaimer, the term of this patent is extended or adjusted under 35 U.S.C. 154(b) by 322 days.

(21) Appl. No.: 12/611,409

(22) Filed: Nov. 3, 2009

(65) Prior Publication Data

US 2010/0109234 A1 May 6, 2010

(30) Foreign Application Priority Data

Nov. 4, 2008 (JP) ..... 2008-283100

(51) Int. Cl.
*B65H 7/02* (2006.01)

(52) U.S. Cl. ..... 271/265.02; 271/275; 271/277

(58) Field of Classification Search ..... 271/265.01, 271/265.02, 275, 277, 272
See application file for complete search history.

(56) References Cited

U.S. PATENT DOCUMENTS 4,133,667 A * 1/1979 Nitschke ..... 65/163
5,076,568 A * 12/1991 de Jong et al. ..... 271/275
5,320,341 A * 6/1994 Pease et al. ..... 271/277
6,641,134 B1 * 11/2003 Dobbertin et al. ..... 271/226
6,687,570 B1 * 2/2004 Sussmeier et al. ..... 700/220
7,316,477 B2 * 1/2008 Yoda ..... 347/104
7,562,870 B2 * 7/2009 Terada ..... 271/270
7,568,696 B2 * 8/2009 Henson ..... 271/270
7,581,727 B2 * 9/2009 Iesaki ..... 271/10.02
2009/0212488 A1 * 8/2009 Hashimoto et al. ..... 271/226
2009/0302532 A1 * 12/2009 Suzuki et al. ..... 271/272

FOREIGN PATENT DOCUMENTS

JP 2006-305903 A 11/2006

* cited by examiner

*Primary Examiner* — Stefanos Karmis
*Assistant Examiner* — Prasad Gokhale
(74) *Attorney, Agent, or Firm* — Birch, Stewart, Kolasch & Birch, LLP

(57) ABSTRACT

An upstream-side printing unit group and a downstream-side printing unit group, respectively, are driven by separate prime motors and synchronously controlled. In addition to rotary encoders for the upstream-side and downstream-side prime motors, rotary encoders are provided on a last impression cylinder of the upstream-side printing unit group and a first transfer cylinder of the downstream-side printing unit group to detect differences between rotational phases, which the upstream-side and downstream-side printing unit groups should have, and the actual rotational phase of the last impression cylinder of the upstream-side printing unit group or the first transfer cylinder of the downstream-side printing unit group. In accordance with the rotational phase differences, the rotational speeds of the prime motors are corrected.

12 Claims, 44 Drawing Sheets

DRIVE CONTROL METHOD AND DRIVE CONTROL APPARATUS FOR PROCESSING MACHINE

TECHNICAL FIELD

The present invention relates to a drive control method and a drive control apparatus for a processing machine such as a sheet-fed printing press.

BACKGROUND ART

A sheet-fed printing press, which is equipped with many processing units by the addition of other processing units (a coater, an embossing unit, etc.) associated with the increased number of colors adapted for higher grade printing, and an increased added value, has so far driven all the processing units by a single prime motor.

Thus, a high load has been imposed on the prime motor, and the use of the prime motor with great capacity has been necessitated. As a result, the use of an expensive motor has been needed, and the rigidity of a drive system has been required, causing further upsizing. Thus, the problems have arisen that a motor with even greater capacity has to be used, and a high speed operation cannot be performed.

[Citation List]

[Patent Literature]

[Patent Document 1] JP-A-2006-305903

SUMMARY OF INVENTION

[Technical Problem]

Under these circumstances, it is conceivable to drive a group of processing units on the upstream side (i.e., an upstream-side processing unit group) in a sheet flow direction and a group of processing units on the downstream side (i.e., a downstream-side processing unit group) in the sheet flow direction by separate prime motors, and control the speeds and the phases of the two prime motors to be synchronized, as disclosed in Patent Document 1.

However, the following problems are involved, if a sheet-fed printing press having many processing units is taken as an example: Variations in mass are existent owing to the presence of notches of respective cylinders of a group of printing units on the upstream side (hereinafter referred to as an upstream-side printing unit group), especially, the presence of the notch of an impression cylinder located at the last position. The mass variations lead to rotational speed variations due to backlash within a gear train between the upstream-side prime motor and the last located impression cylinder of the upstream-side printing unit group. Similarly, variations in mass are existent owing to the presence of notches of respective cylinders of a group of printing units on the downstream side (hereinafter referred to as a downstream-side printing unit group), especially, the presence of the notch of a transfer cylinder located at the first position. The mass variations lead to rotational speed variations due to backlash within a gear train between the downstream-side prime motor and the first located transfer cylinder of the downstream-side printing unit group.

Rotational speed variations as mentioned above also occur in the presence of load variations caused between a plate cylinder and a blanket cylinder in each printing unit, namely, load variations due to a difference between a state where the circumferential surface of the plate cylinder and the circumferential surface of the blanket cylinder contact and the pressure of this contact acts, and a state where the notch of the plate cylinder and the notch of the blanket cylinder oppose and no contact pressure is applied.

If such rotational speed variations occur, when a sheet is transferred from the upstream-side printing unit group to the downstream-side printing unit group, it becomes impossible for the sheet to be transferred at the exact position each time, thereby arousing a possibility for a printing trouble. Even greater variations in the rotational speed have posed the problems that a gripping error for the sheet, or a bend at the edge of the sheet occurs, taking plenty of time until a normal operation is resumed.

A rotational phase detector for detecting the rotational phase of each printing unit group has been reset by a zero pulse from a rotary encoder which detects each rotational phase. Because of the aforementioned rotational speed variations, however, the position at which the reset is performed is slightly displaced, posing a second problem that a corresponding error occurs.

The present invention aims at solving the above problems. The present invention lies in solving these problems by driving the upstream-side processing unit group and the downstream-side processing unit group by separate prime motors and exercising synchronous control over these processing unit groups, providing further rotational phase detectors for the last located impression cylinder of the upstream-side printing unit group and the first located transfer cylinder of the downstream-side printing unit group, detecting a difference between a rotational phase which each printing unit group should have, and the actual rotational phase of the last located impression cylinder of the upstream-side printing unit group or the first located transfer cylinder of the downstream-side printing unit group, and correcting the rotational speed of the prime motor in accordance with the rotational phase difference.

[Solution to Problem]

A first aspect of the present invention for solving the above problems is a drive control method for a processing machine which includes first drive means, first driven means driven by the first drive means, second driven means rotationally driven by the first drive means via the first driven means, a first rotating body provided with a first holding portion for holding a member to be processed, and rotationally driven by the second driven means, and a second rotating body provided with a second holding portion for receiving the member to be processed, from the first holding portion of the first rotating body, the drive control method comprising: providing second drive means for rotationally driving the second rotating body; indicating means for indicating a rotational phase and a rotational speed which the first rotating body should have; first rotational phase detecting means for detecting a rotational phase of the first drive means; and second rotational phase detecting means for detecting a rotational phase of the first rotating body; and controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

A second aspect of the present invention is a drive control method for a processing machine which includes first drive means, first driven means driven by the first drive means, second driven means rotationally driven by the first drive means via the first driven means, a first rotating body provided with a first holding portion for holding a member to be processed, and rotationally driven by the second driven means, and a second rotating body provided with a second holding portion for passing the member to be processed, on to the first holding portion of the first rotating body, the drive control method comprising: providing second drive means for rotationally driving the second rotating body; indicating means for indicating a rotational phase and a rotational speed which the first rotating body should have; first rotational phase detecting means for detecting a rotational phase of the first drive means; and second rotational phase detecting means for detecting a rotational phase of the first rotating body; and controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

A third aspect of the present invention is the drive control method for a processing machine according to the first or second aspect, further providing home position detecting means provided for the first rotating body and adapted to detect a home position of the rotational phase of the first rotating body, and wherein the first rotational phase detecting means and the second rotational phase detecting means are reset by a signal from the home position detecting means.

A fourth aspect of the present invention is the drive control method for a processing machine according to the first or second aspect, further providing home position detecting means provided for the second rotating body and adapted to detect a home position of a rotational phase of the second rotating body, and wherein the first rotational phase detecting means and the second rotational phase detecting means are reset by a signal from the home position detecting means.

A fifth aspect of the present invention is a drive control apparatus for a processing machine which includes first drive means, first driven means driven by the first drive means, second driven means rotationally driven by the first drive means via the first driven means, a first rotating body provided with a first holding portion for holding a member to be processed, and rotationally driven by the second driven means, and a second rotating body provided with a second holding portion for receiving the member to be processed, from the first holding portion of the first rotating body, the drive control apparatus comprising: second drive means for rotationally driving the second rotating body; indicating means for indicating a rotational phase and a rotational speed which the first rotating body should have; first rotational phase detecting means for detecting a rotational phase of the first drive means; second rotational phase detecting means for detecting a rotational phase of the first rotating body; and control means for controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

A sixth aspect of the present invention is a drive control apparatus for a processing machine which includes first drive means, first driven means driven by the first drive means, second driven means rotationally driven by the first drive means via the first driven means, a first rotating body provided with a first holding portion for holding a member to be processed, and rotationally driven by the second driven means, and a second rotating body provided with a second holding portion for passing the member to be processed, on to the first holding portion of the first rotating body, the drive control apparatus comprising: second drive means for rotationally driving the second rotating body; indicating means for indicating a rotational phase and a rotational speed which the first rotating body should have; first rotational phase detecting means for detecting a rotational phase of the first drive means; second rotational phase detecting means for detecting a rotational phase of the first rotating body; and control means for controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

A seventh aspect of the present invention is the drive control apparatus for a processing machine according to the fifth or sixth aspect, further comprising home position detecting means provided for the first rotating body and adapted to detect a home position of the rotational phase of the first rotating body, and wherein the first rotational phase detecting means and the second rotational phase detecting means are reset by a signal from the home position detecting means.

An eighth aspect of the present invention is the drive control apparatus for a processing machine according to the fifth or sixth aspect, further comprising home position detecting means provided for the second rotating body and adapted to detect a home position of a rotational phase of the second rotating body, and wherein the first rotational phase detecting means and the second rotational phase detecting means are reset by a signal from the home position detecting means.

[Advantageous Effects of Invention]

According to the drive control method and apparatus for a processing machine concerned with the present invention, the rotational speed of the drive means is controlled in accordance with the rotational phase difference (positional deviation) between the first rotating body and the second rotating body which are rotationally driven separately from each other, whereby the first and second rotating bodies can be synchronously controlled. Accordingly, when the sheet is transferred from the upstream-side printing unit group to the downstream-side printing unit group, the sheet can be transferred every time at the exact position. This makes it possible to prevent printing troubles and increase the rate of operation.

DESCRIPTION OF EMBODIMENTS

Hereinafter, a drive control method and a drive control apparatus for a processing machine according to the present invention will be described in detail by an embodiment with reference to the accompanying drawings.

[Embodiment]

Figure 1:
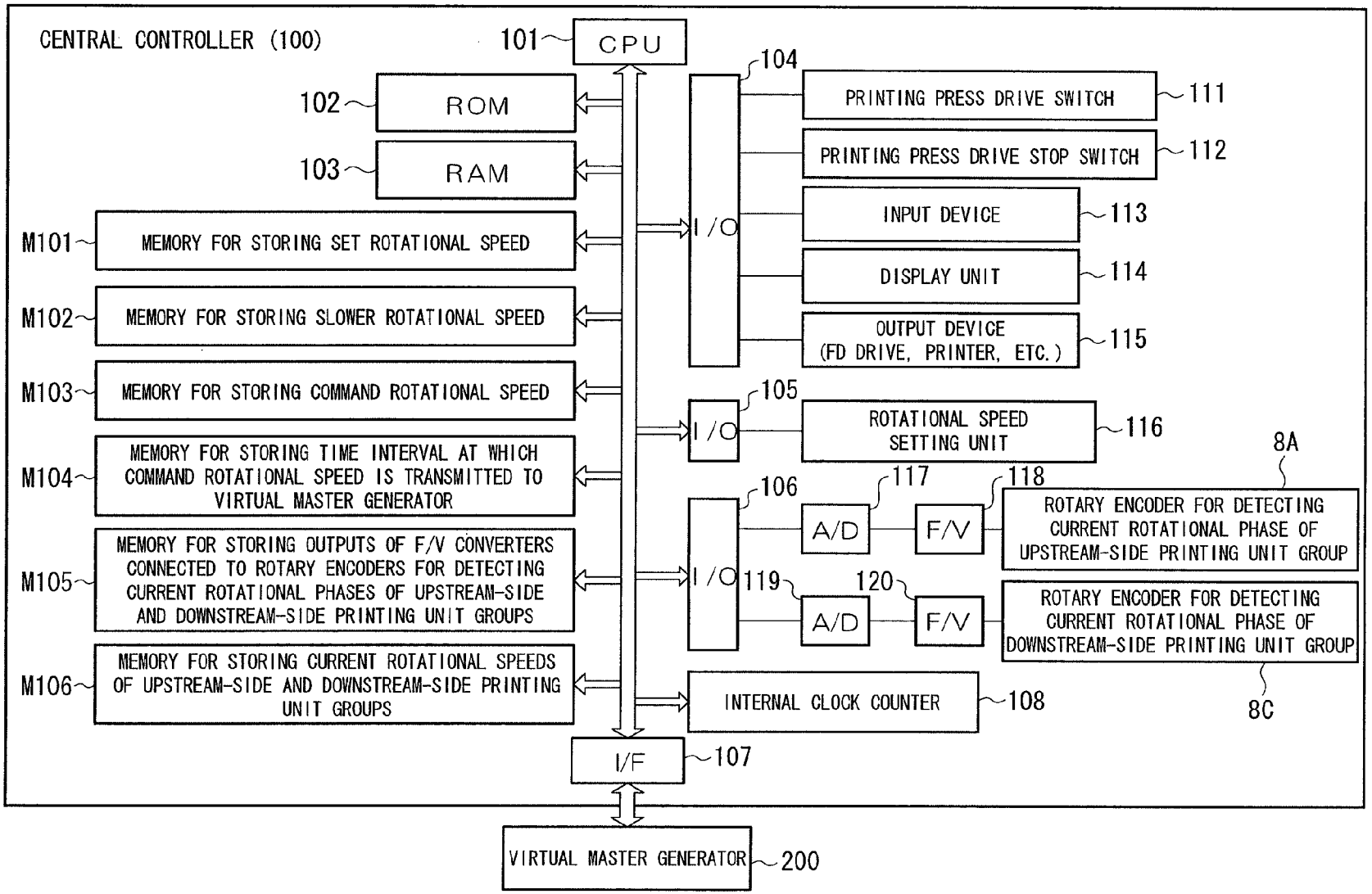
FIG. 1 is a hardware block diagram of a central controller in an embodiment of the present invention.
Figure 2:
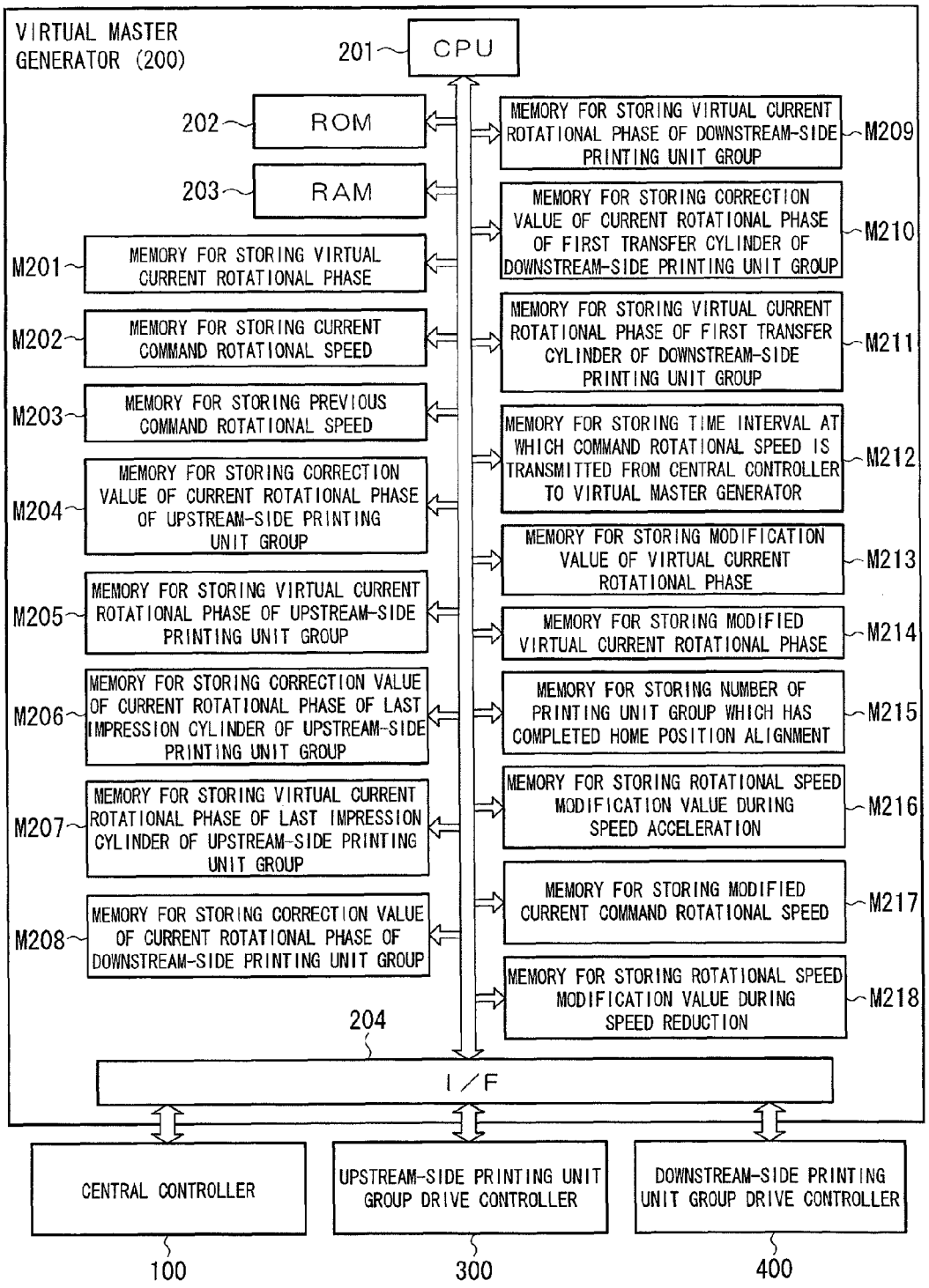
FIG. 2 is a hardware block diagram of a virtual master generator in the embodiment of the present invention.
Figure 3A:
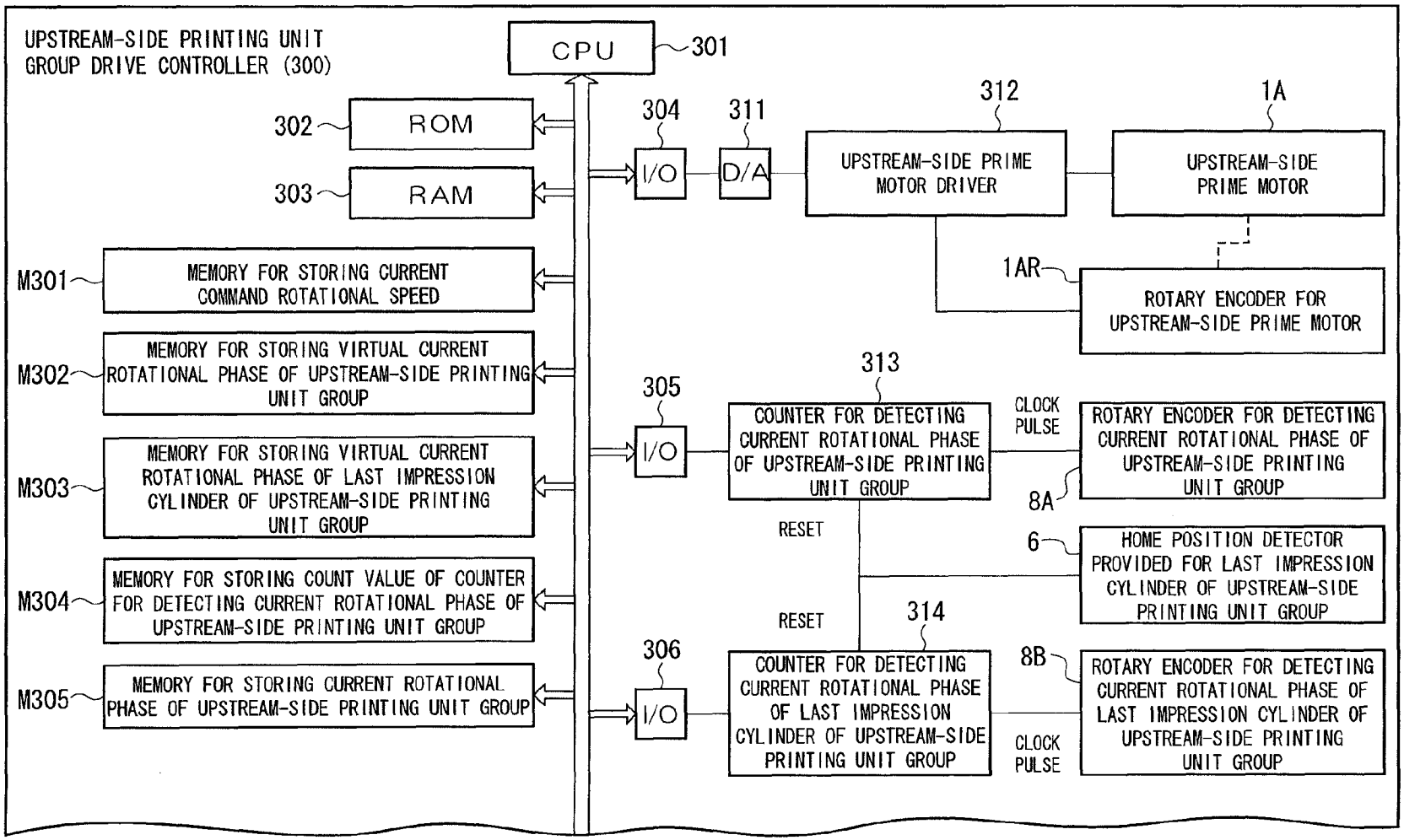
FIG. 3A is a hardware block diagram of an upstream-side printing unit group drive controller in the embodiment of the present invention.
Figure 3B:
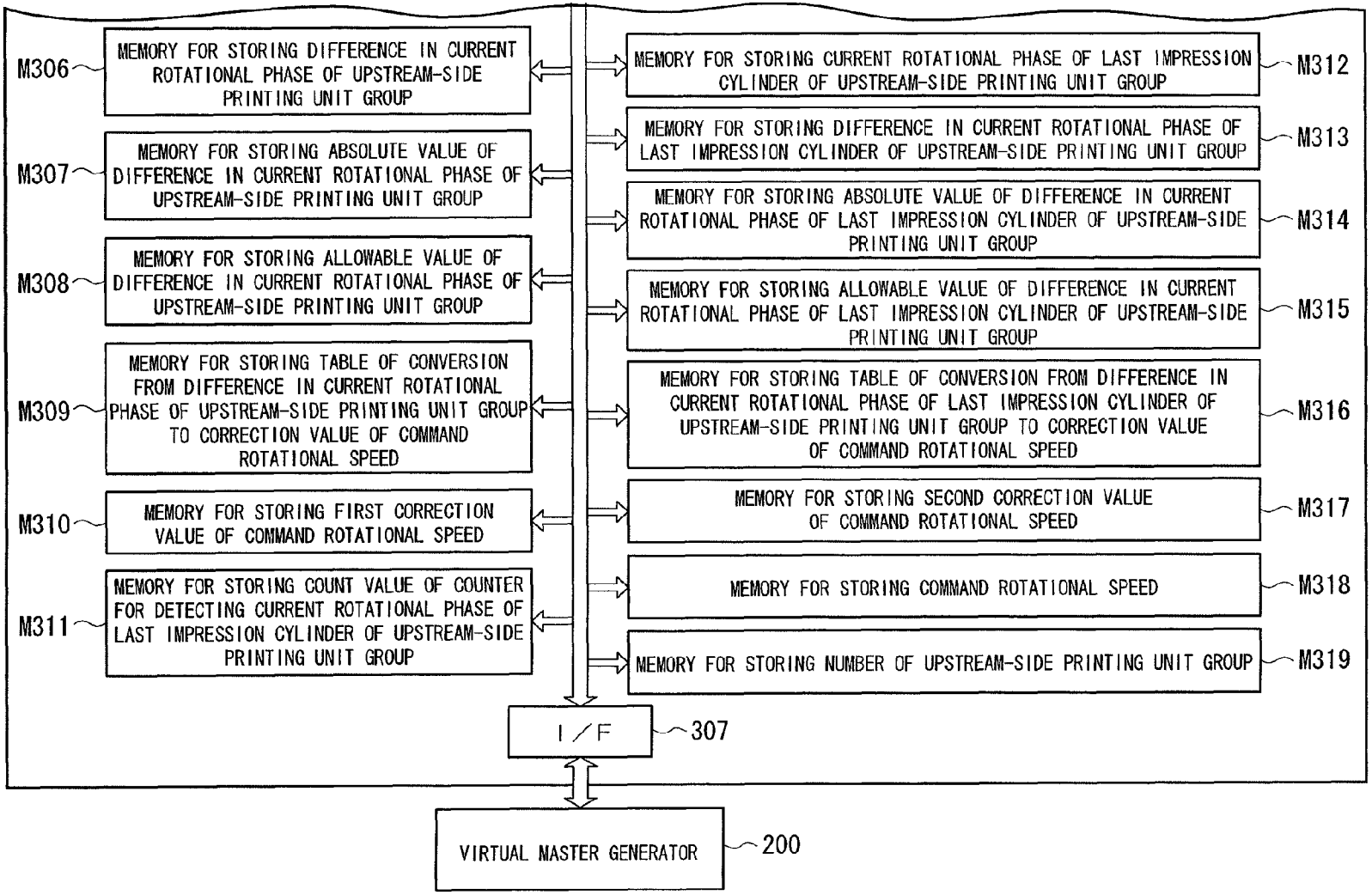
FIG. 3B is a hardware block diagram of the upstream-side printing unit group drive controller in the embodiment of the present invention.
Figure 4A:
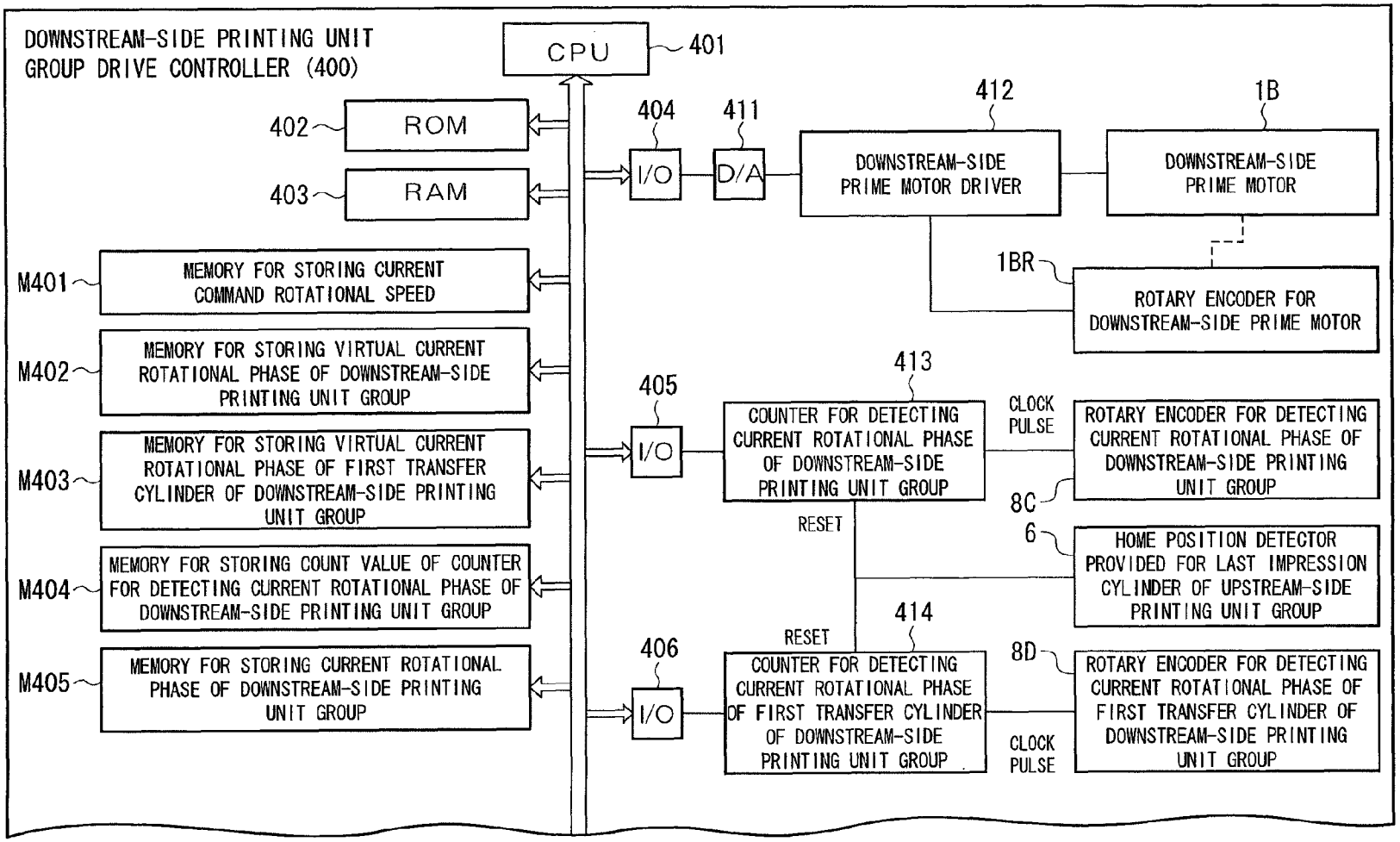
FIG. 4A is a hardware block diagram of a downstream-side printing unit group drive controller in the embodiment of the present invention.
Figure 4B:
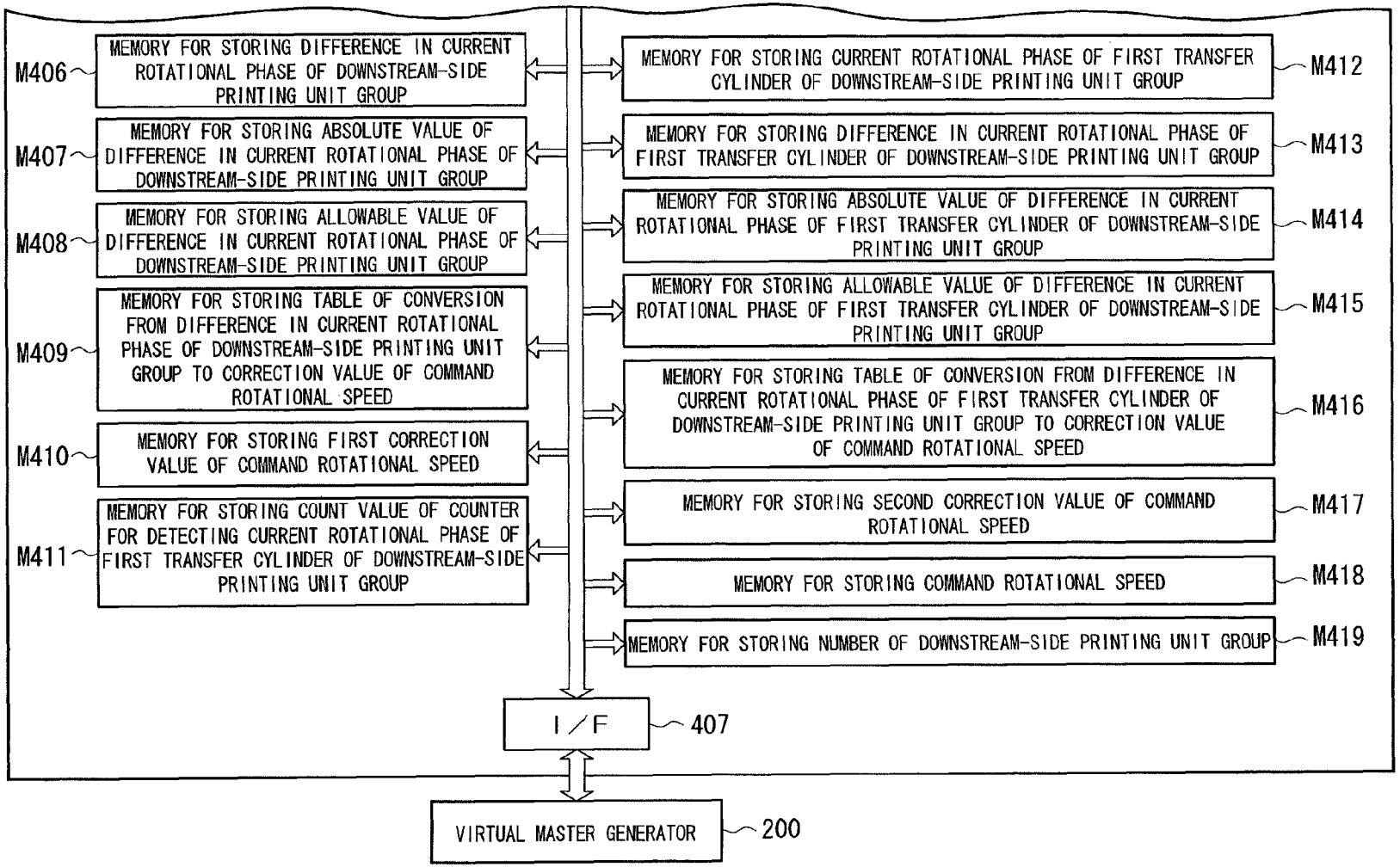
FIG. 4B is a hardware block diagram of the downstream-side printing unit group drive controller in the embodiment of the present invention.

An embodiment of the present invention will be described based on FIGS. 1 to 11A to 11E. FIG. 1 is a hardware block diagram of a central controller in a drive control apparatus for a processing machine according to the present embodiment. FIG. 2 is a hardware block diagram of a virtual master generator in the drive control apparatus for the processing machine according to the present embodiment. FIGS. 3A and 3B are hardware block diagrams of an upstream-side printing unit group drive controller in the drive control apparatus for the processing machine according to the present embodiment. FIGS. 4A and 4B are hardware block diagrams of a downstream-side printing unit group drive controller in the drive control apparatus for the processing machine according to the present embodiment.

FIGS. 5A to 5E are operational flowcharts of the central controller in the present embodiment. FIGS. 6A to 6F and 7A to 7E are operational flowcharts of the virtual master generator in the present embodiment. FIGS. 8A to 8E and 9A to 9E are operational flowcharts of the upstream-side printing unit group drive controller in the present embodiment. FIGS. 10A to 10E and 11A to 11E are operational flowcharts of the downstream-side printing unit group drive controller in the present embodiment.

Figure 12:
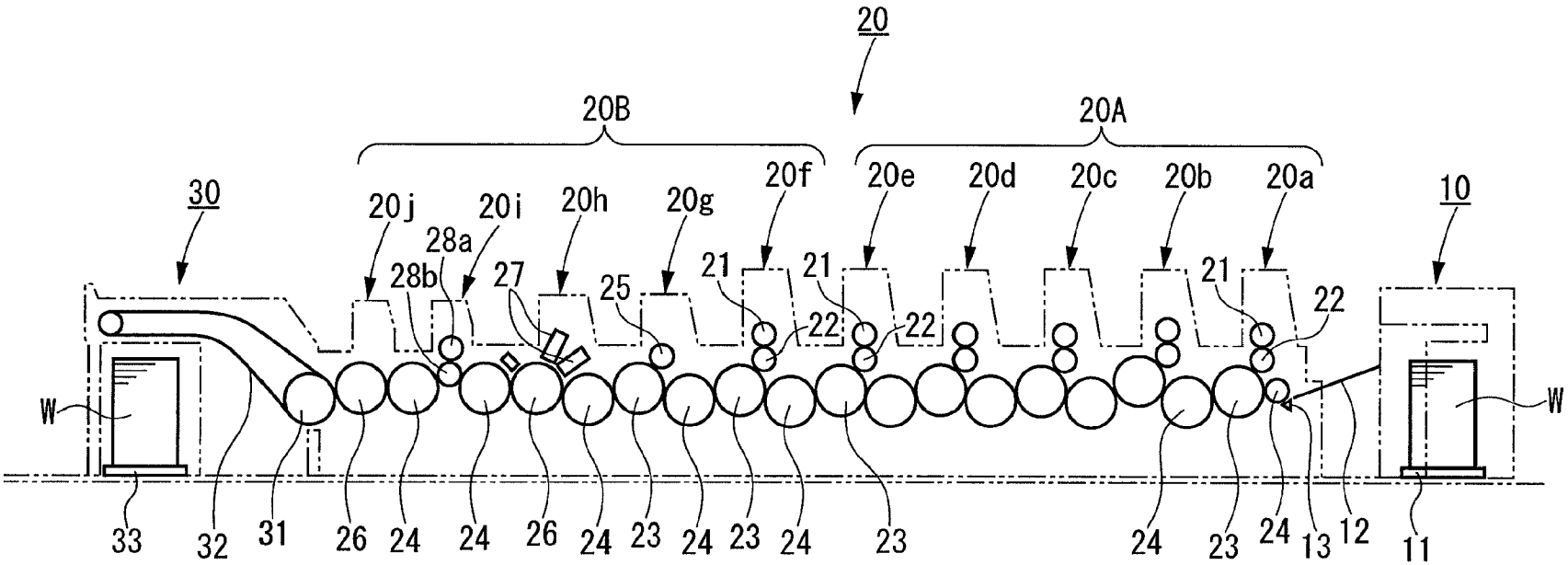
FIG. 12 is a side view showing the schematic configuration of a sheet-fed printing press.
Figure 13:
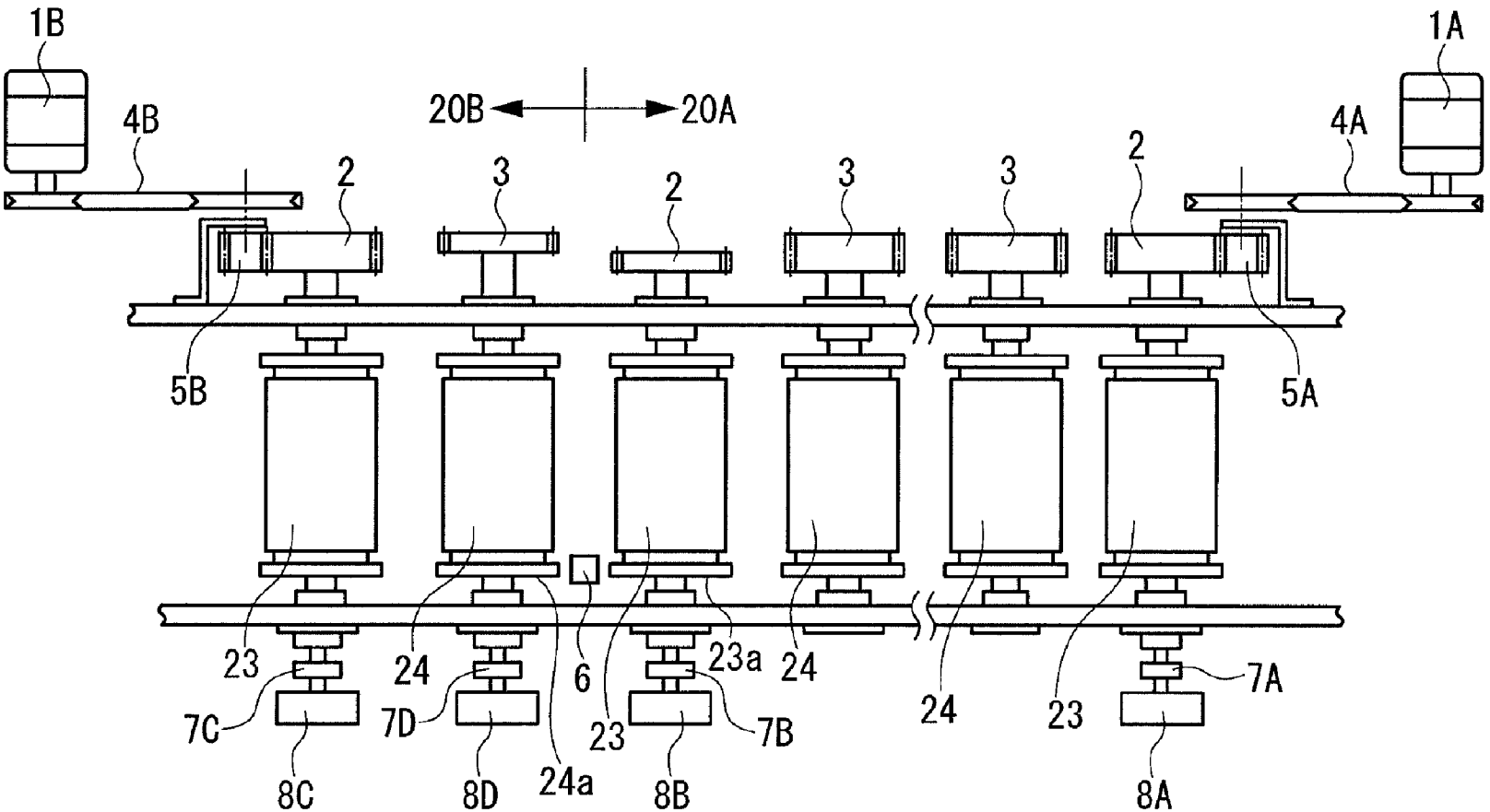
FIG. 13 is a plan view showing a drive separating section of the sheet-fed printing press.

FIG. 12 is a side view showing the schematic configuration of a sheet-fed printing press. FIG. 13 is a plan view showing a drive separating section of the sheet-fed printing press.

In the present embodiment, as shown in FIG. 12, a sheet-fed printing press (processing machine) has a feeder 10, a printing section 20, and a delivery unit 30. The printing section 20 further comprises an upstream-side printing unit group 20A including offset printing units 20*a* to 20*e* of a first color to a fifth color, and a downstream-side printing unit group 20B including an offset printing unit 20*f* of a sixth color, a coating unit 20*g*, a drying unit 20*h*, an embossing unit 20*i*, and a cooling unit 20*j*.

The feeder 10 is provided with a feeder board 12 for feeding sheets (members to be processed) W on a sheet pile board 11, one by one, to the printing section 20. At the leading end of the feeder board 12, there is provided a swing arm shaft pregripper 13 which passes the sheet W on to the offset printing unit 20*a* of the first color via a transfer cylinder 24.

The offset printing units 20*a* to 20*f* of the first color to the sixth color each have a plate cylinder 21, a blanket cylinder 22, and an impression cylinder 23, print on the sheet W transferred via a transfer cylinder 24, and transport the printed sheet to the succeeding unit.

The coating unit 20*g* is equipped with an impression cylinder 23 and a blanket cylinder 25, applies coating to the sheet W transferred via a transfer cylinder 24, and transports the coated sheet to the drying unit 20*h*. The drying unit 20*h* has a transport cylinder 26 and UV lamps 27, dries the inks and coating agent on the sheet W transferred via a transfer cylinder 24, and transports the dried sheet to the embossing unit 20*i*. The embossing unit 20*i* has concave and convex embossing rolls 28*a*, 28*b*, applies embossing to the sheet W transferred via a transfer cylinder 24, and transports the embossed sheet to the cooling unit 20*j*. The cooling unit 20*j* has a transport cylinder 26, cools the sheet W, which has been transferred via a transfer cylinder 24, with cooling water circulating within the transport cylinder 26, and transports the cooled sheet to a delivery unit 30.

In the delivery unit 30, the sheet W transferred from the transport cylinder 26 of the cooling unit 20*j* is transported by a delivery chain 32 looped over a delivery cylinder 31, and delivered onto a delivery pile board 33.

The impression cylinder 23, the transfer cylinder 24, and the transport cylinder 26 each have a notch in which a holding portion such as grippers for holding the sheet W is mounted. The transported sheet W is transferred by this mechanism between these cylinders.

In the present embodiment, as shown in FIG. 13, the upstream-side printing unit group 20A is driven by an upstream-side prime motor (first or quasi-second drive means; electric motor) 1A via a looping transmission device such as a belt 4A, whereas the downstream-side printing unit group 20B is driven by a downstream-side prime motor (second or quasi-first drive means; electric motor) 1B via a looping transmission device such as a belt 4B. In the above parenthesized expressions "first" and "second", those without "quasi" represent features corresponding to the aforementioned first and fifth aspects of the invention, and those with "quasi" represent features corresponding to the aforementioned second and sixth aspects of the invention. The same holds true in the descriptions to follow.

Figure 5A:
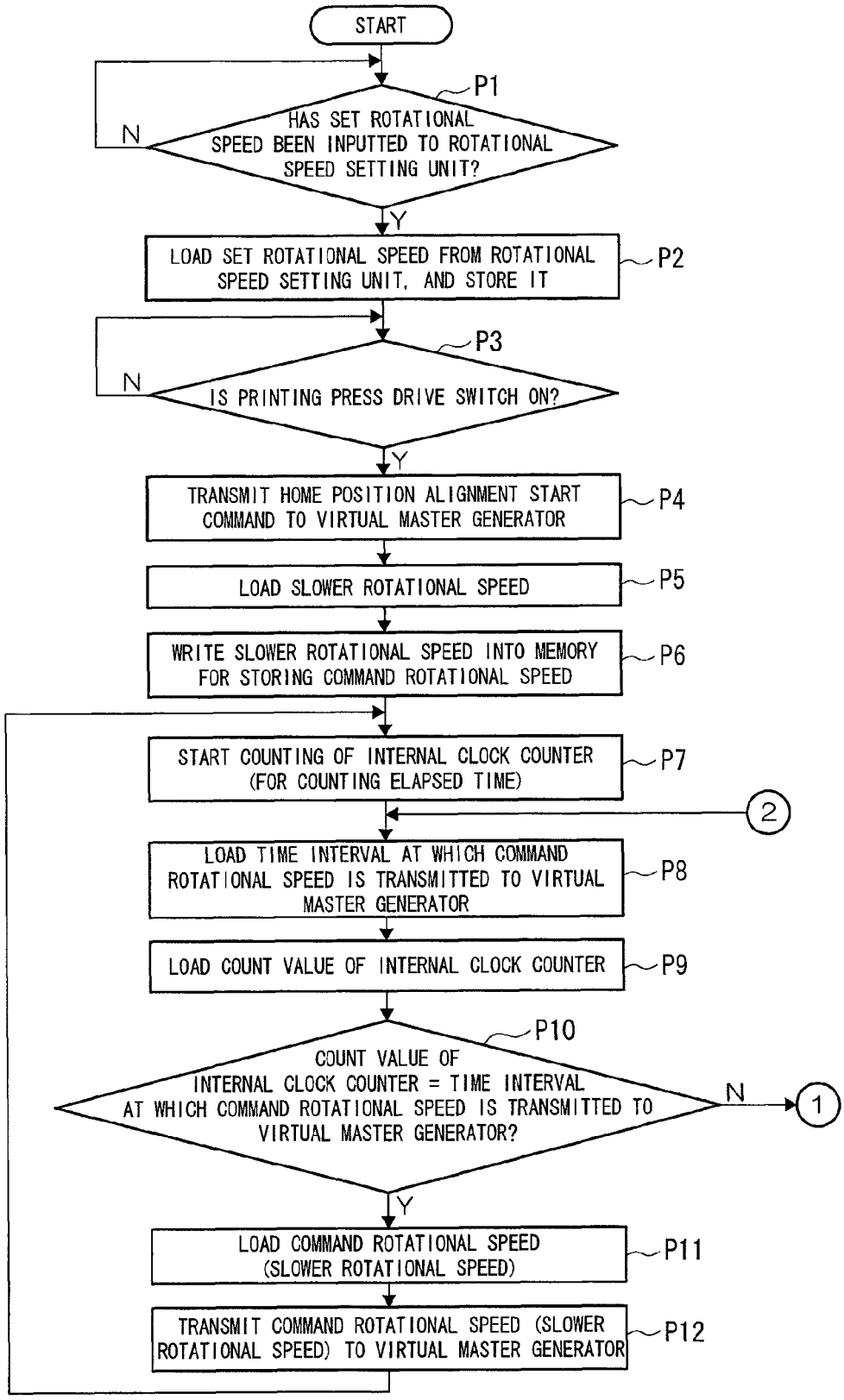
FIG. 5A is an operational flowchart of the central controller in the embodiment of the present invention.
Figure 5B:
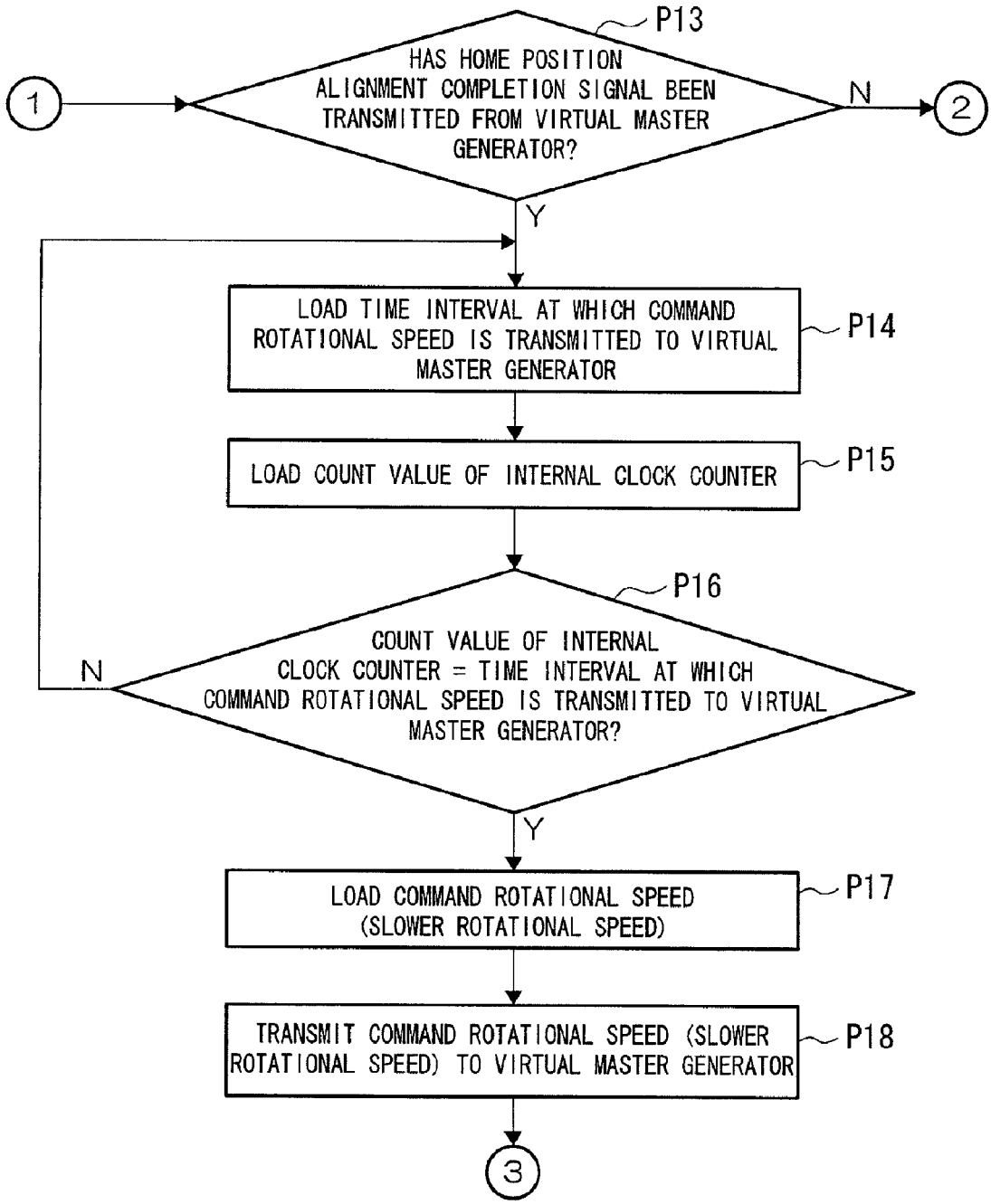
FIG. 5B is an operational flowchart of the central controller in the embodiment of the present invention.
Figure 5C:
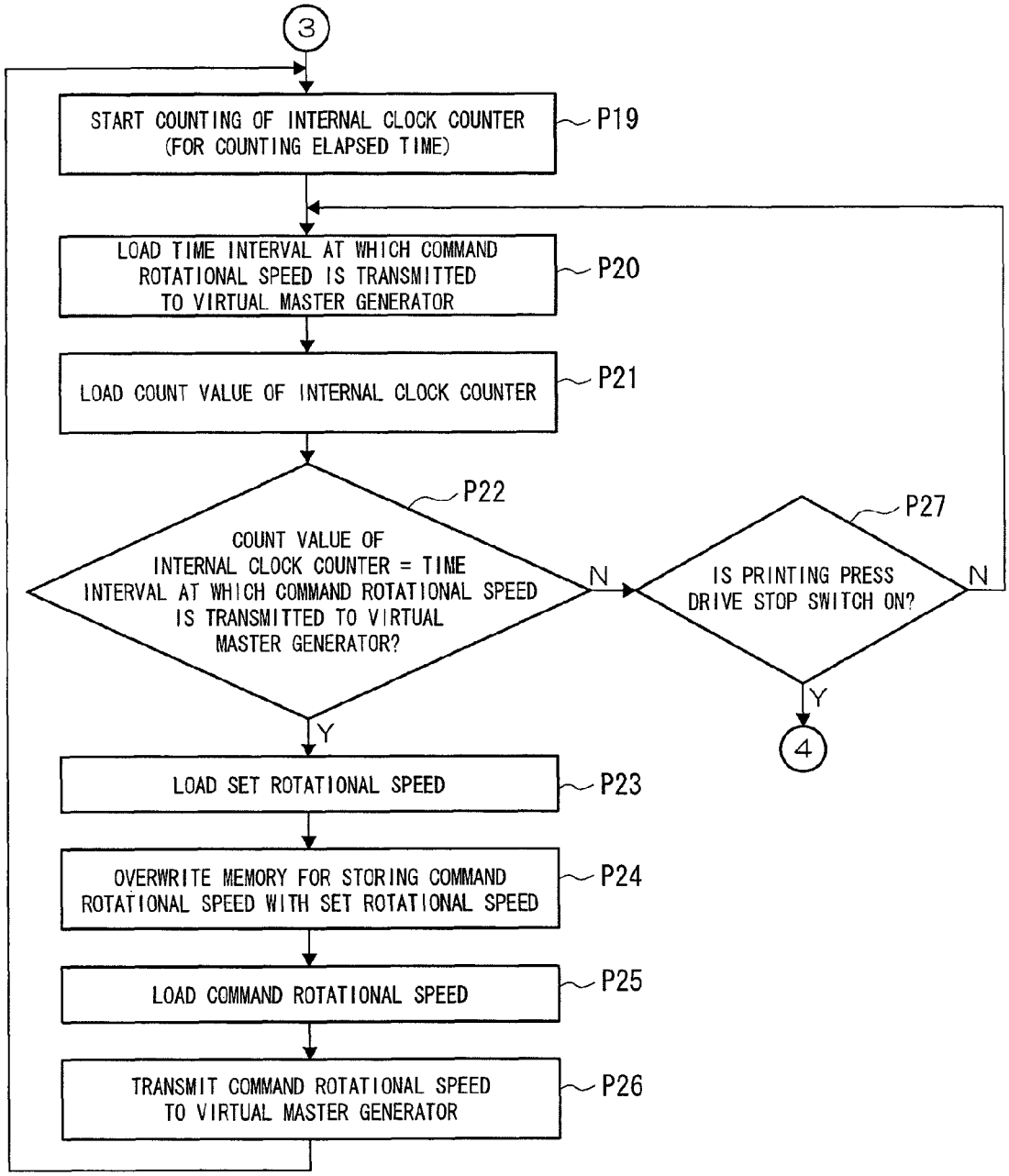
FIG. 5C is an operational flowchart of the central controller in the embodiment of the present invention.
Figure 5D:
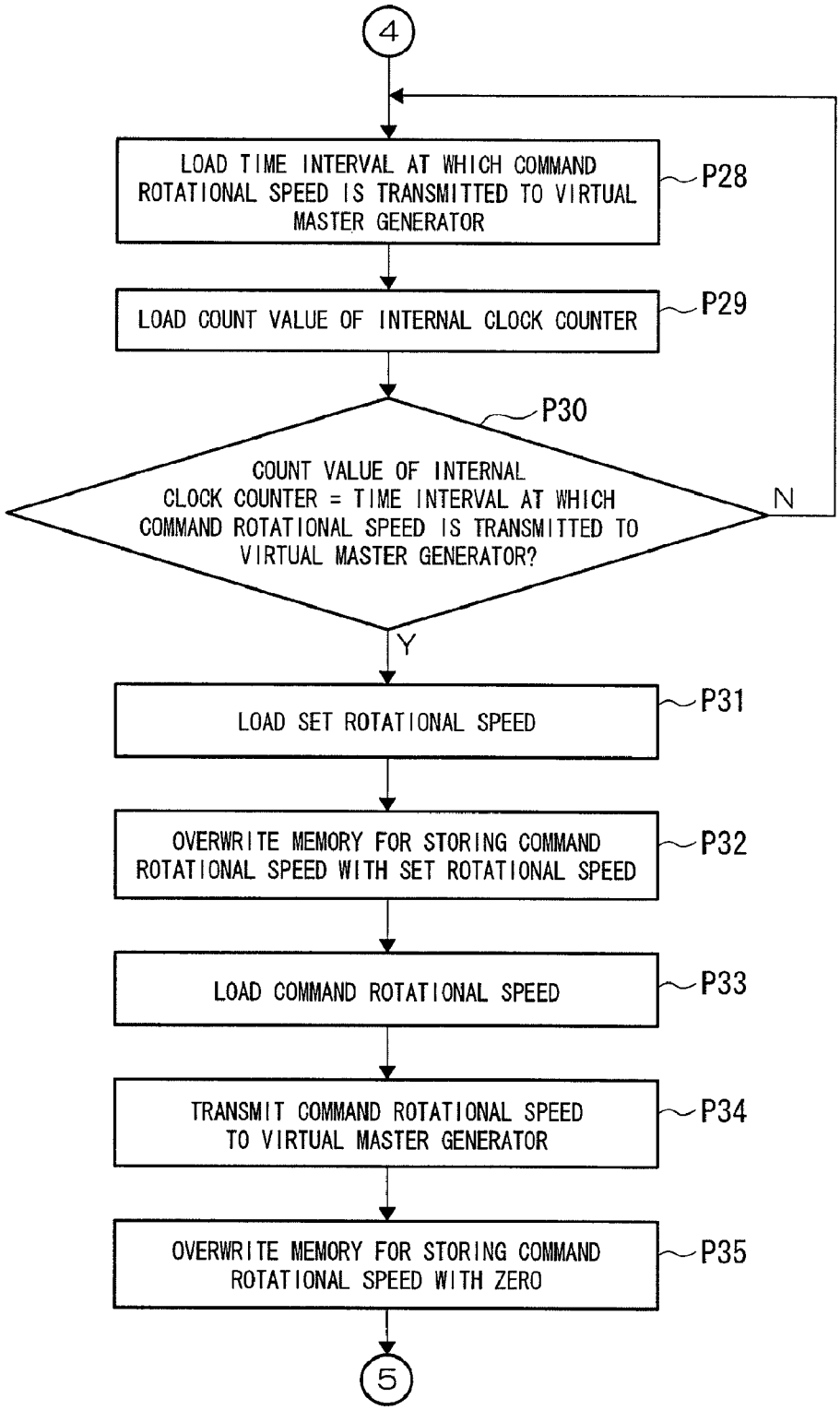
FIG. 5D is an operational flowchart of the central controller in the embodiment of the present invention.
Figure 5E:
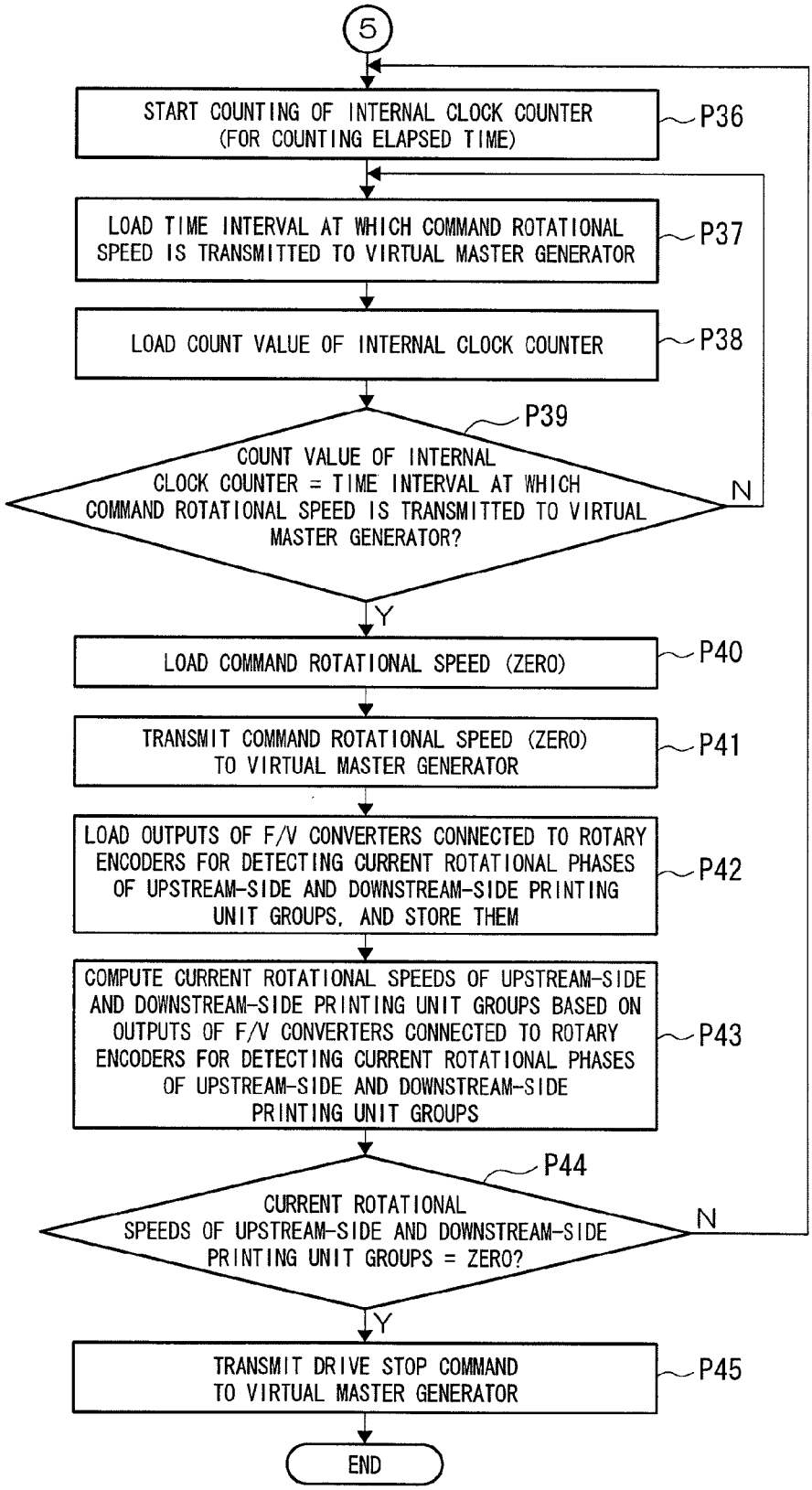
FIG. 5E is an operational flowchart of the central controller in the embodiment of the present invention.
Figure 6A:
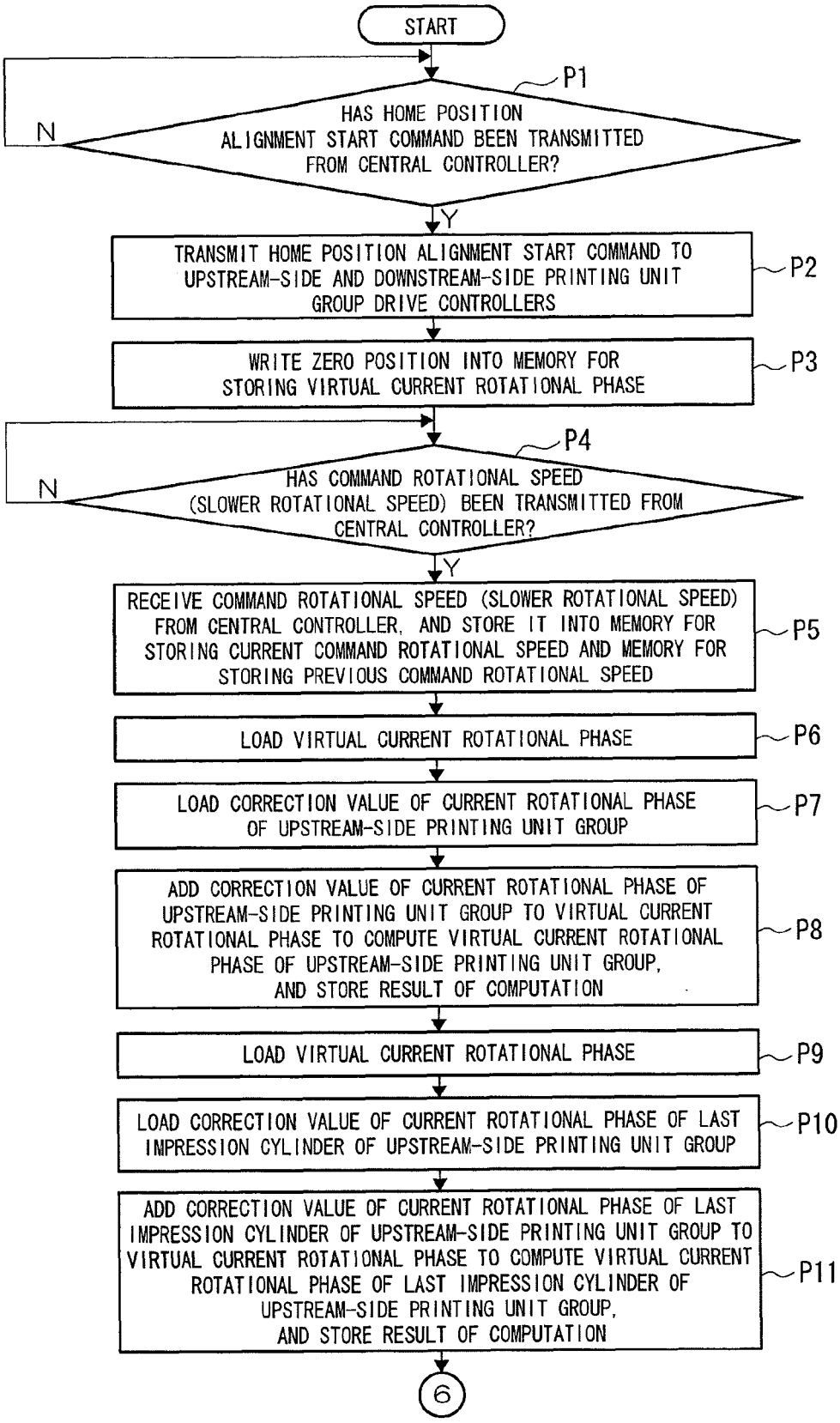
FIG. 6A is an operational flowchart of the virtual master generator in the embodiment of the present invention.
Figure 6B:
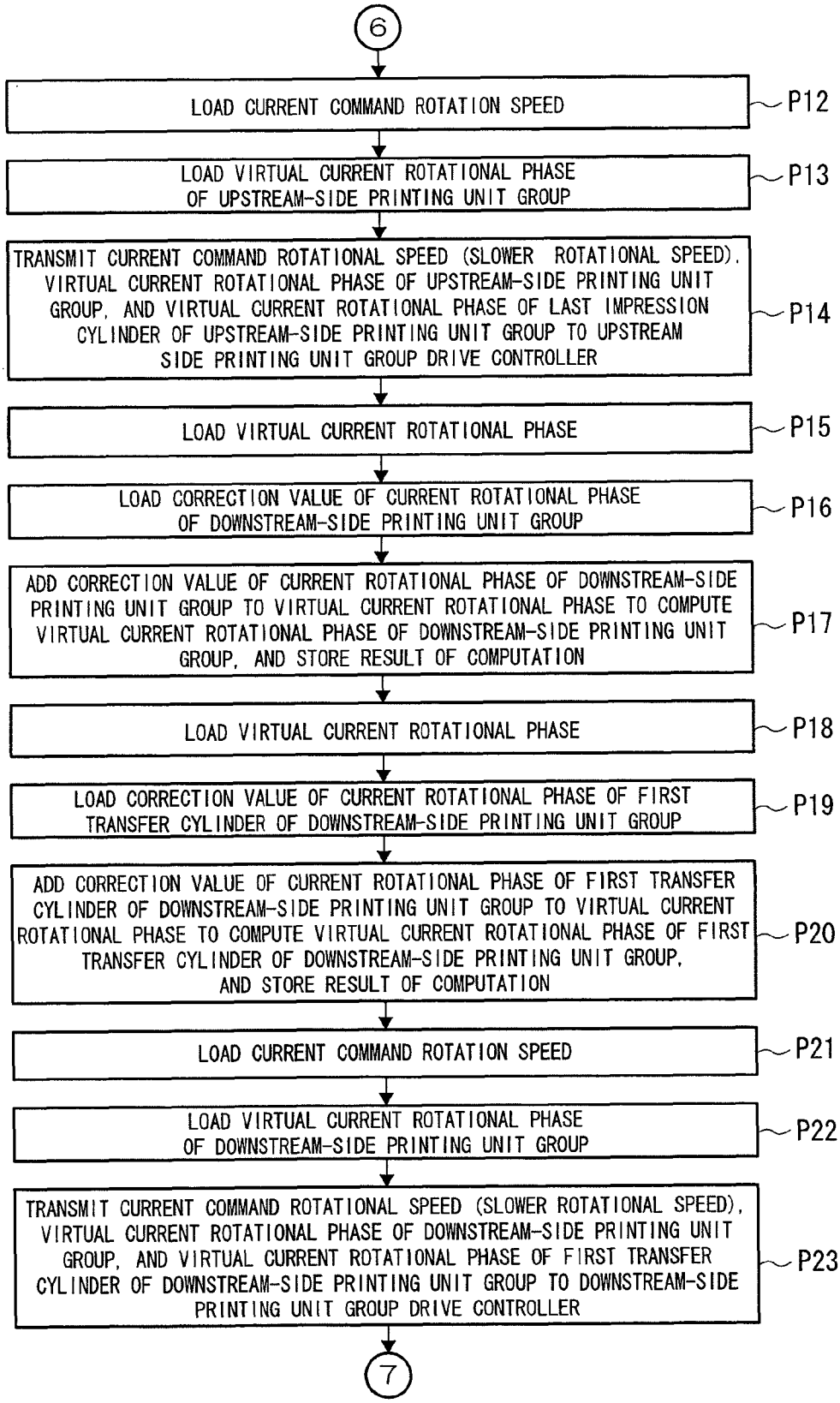
FIG. 6B is an operational flowchart of the virtual master generator in the embodiment of the present invention.
Figure 6C:
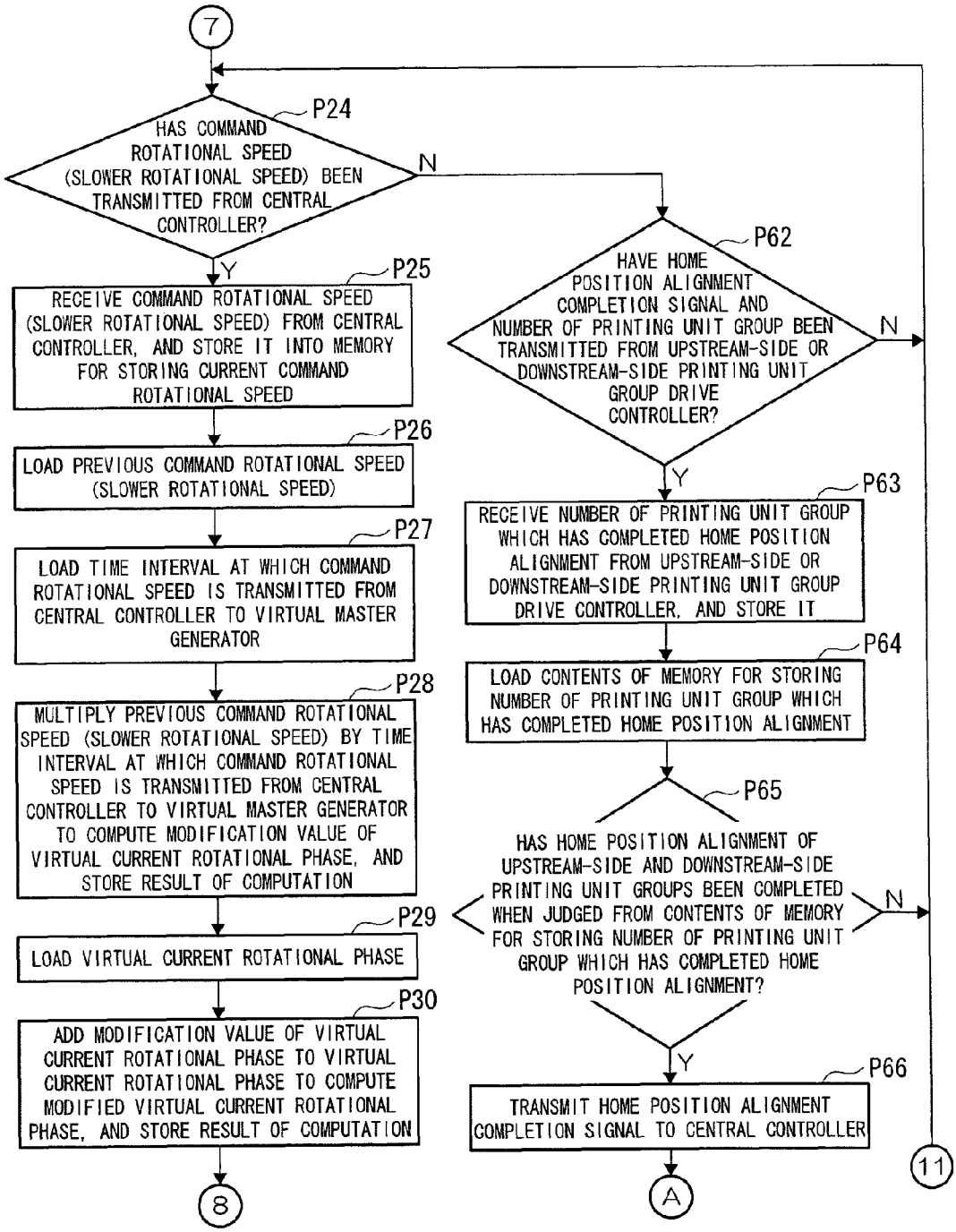
FIG. 6C is an operational flowchart of the virtual master generator in the embodiment of the present invention.
Figure 6D:
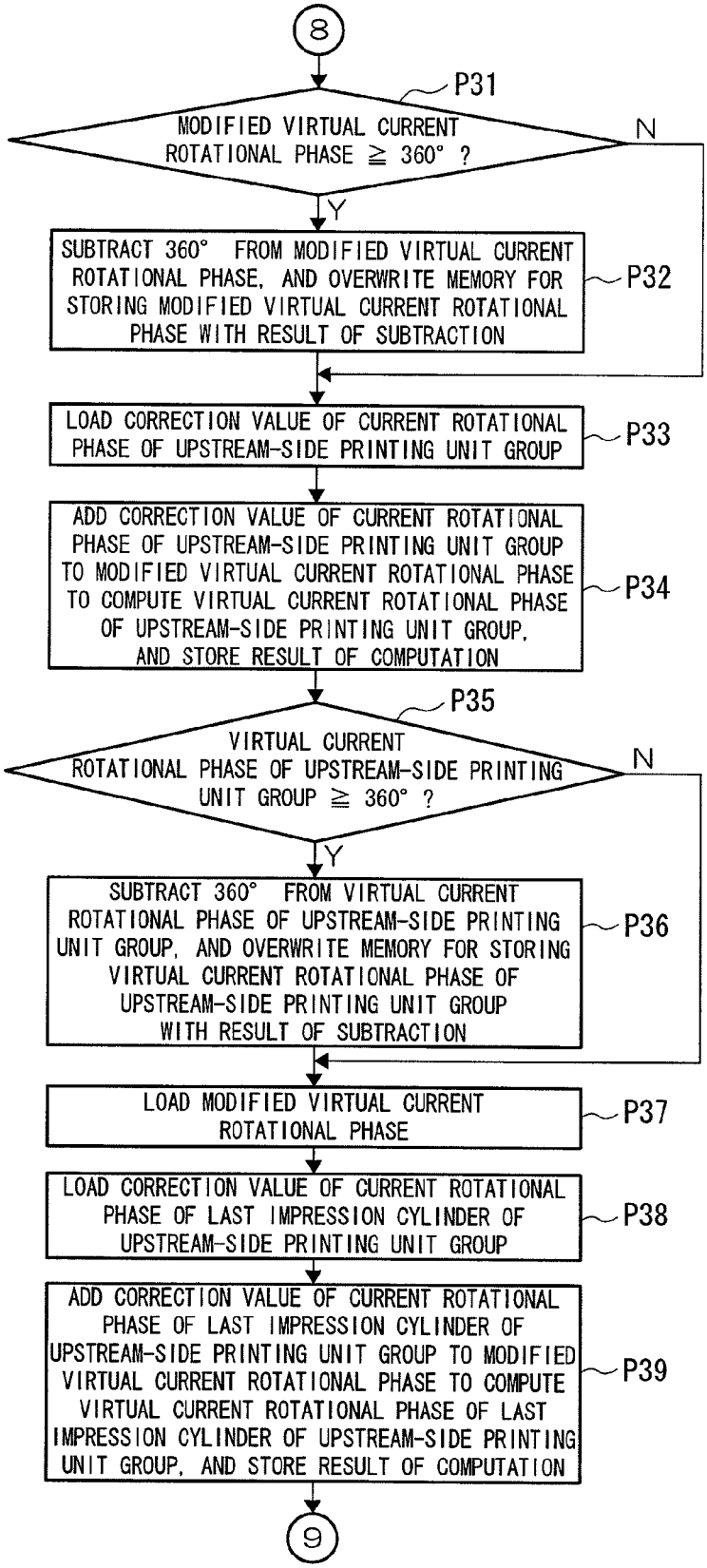
FIG. 6D is an operational flowchart of the virtual master generator in the embodiment of the present invention.
Figure 6E:
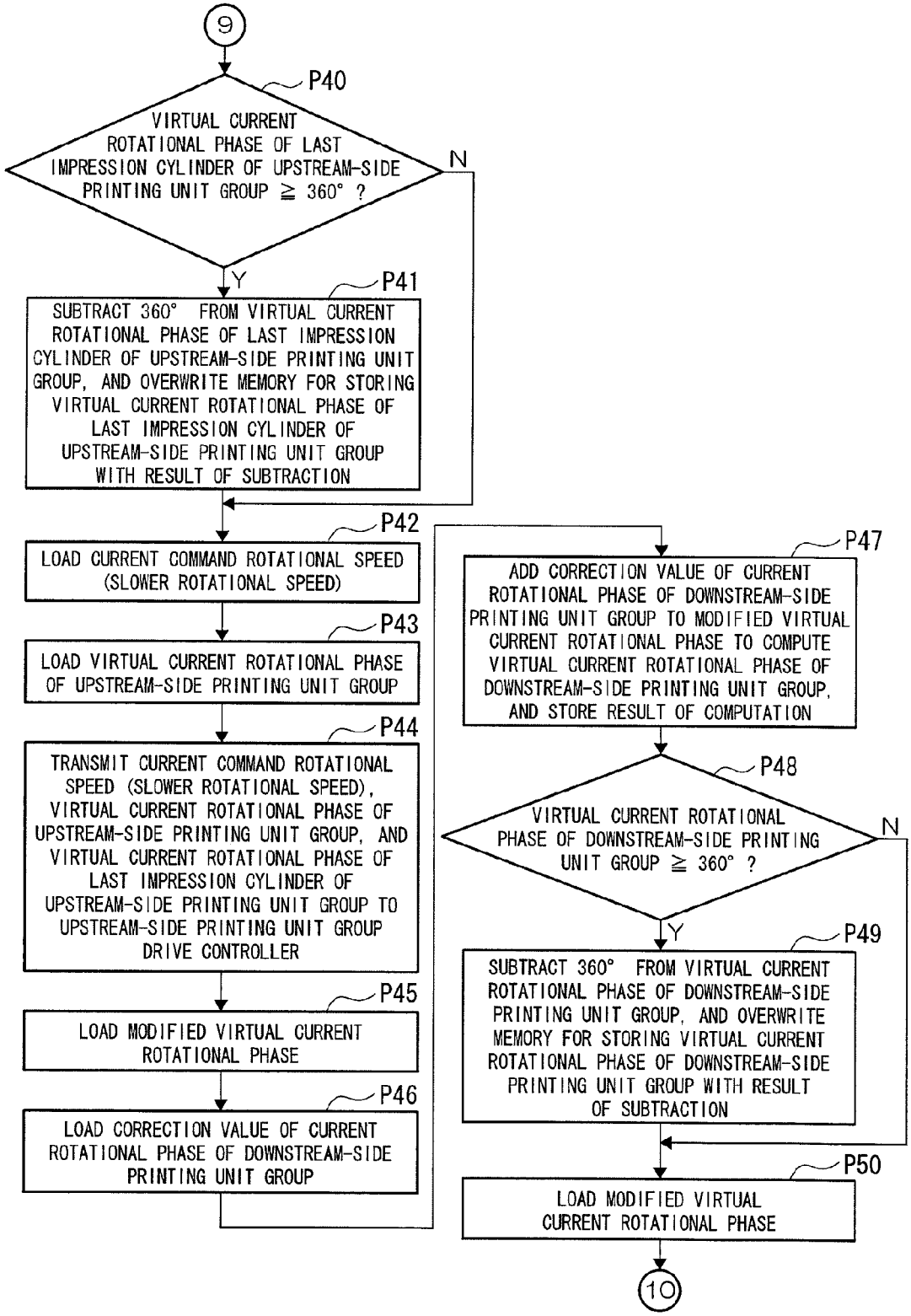
FIG. 6E is an operational flowchart of the virtual master generator in the embodiment of the present invention.
Figure 6F:
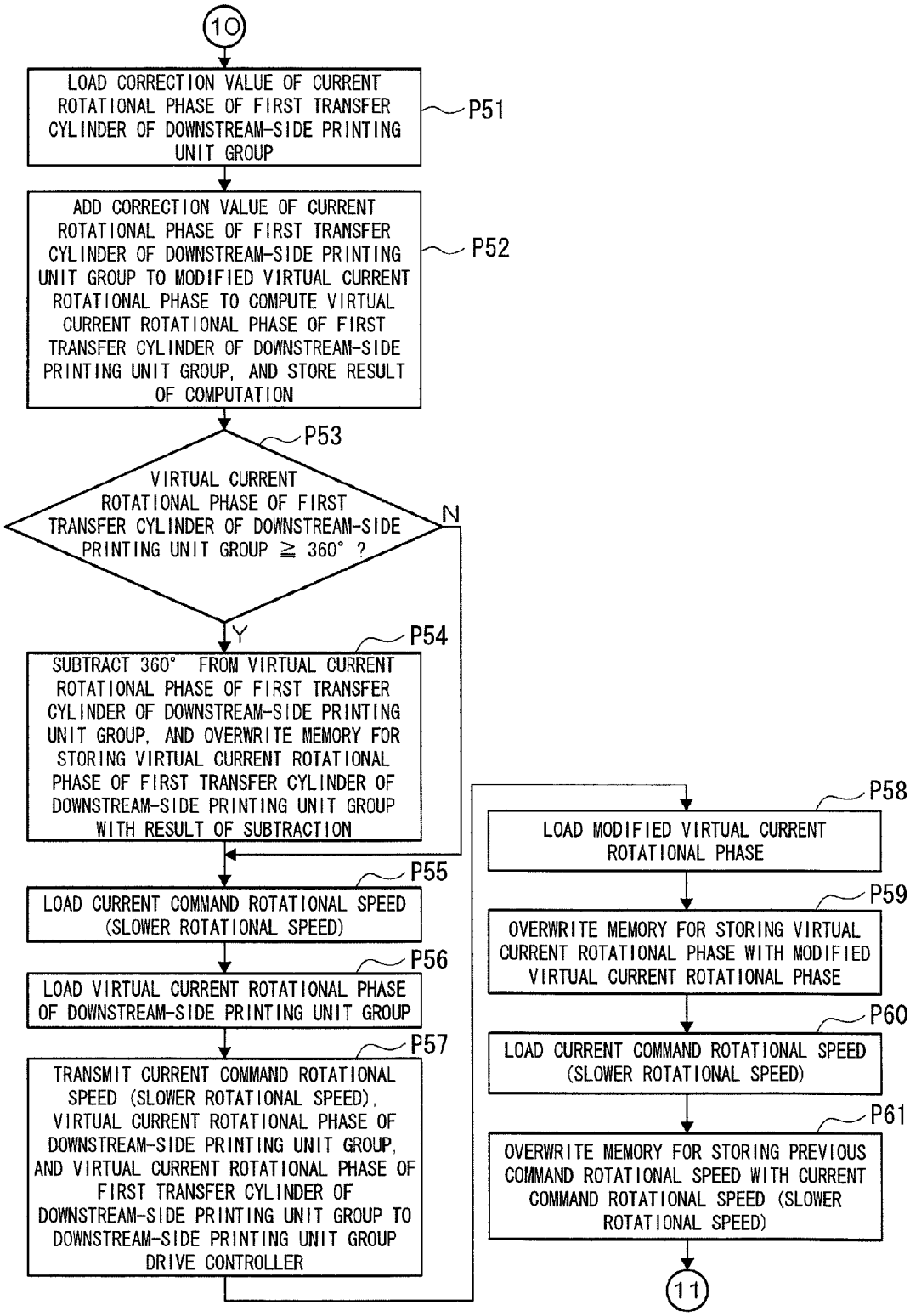
FIG. 6F is an operational flowchart of the virtual master generator in the embodiment of the present invention.
Figure 7A:
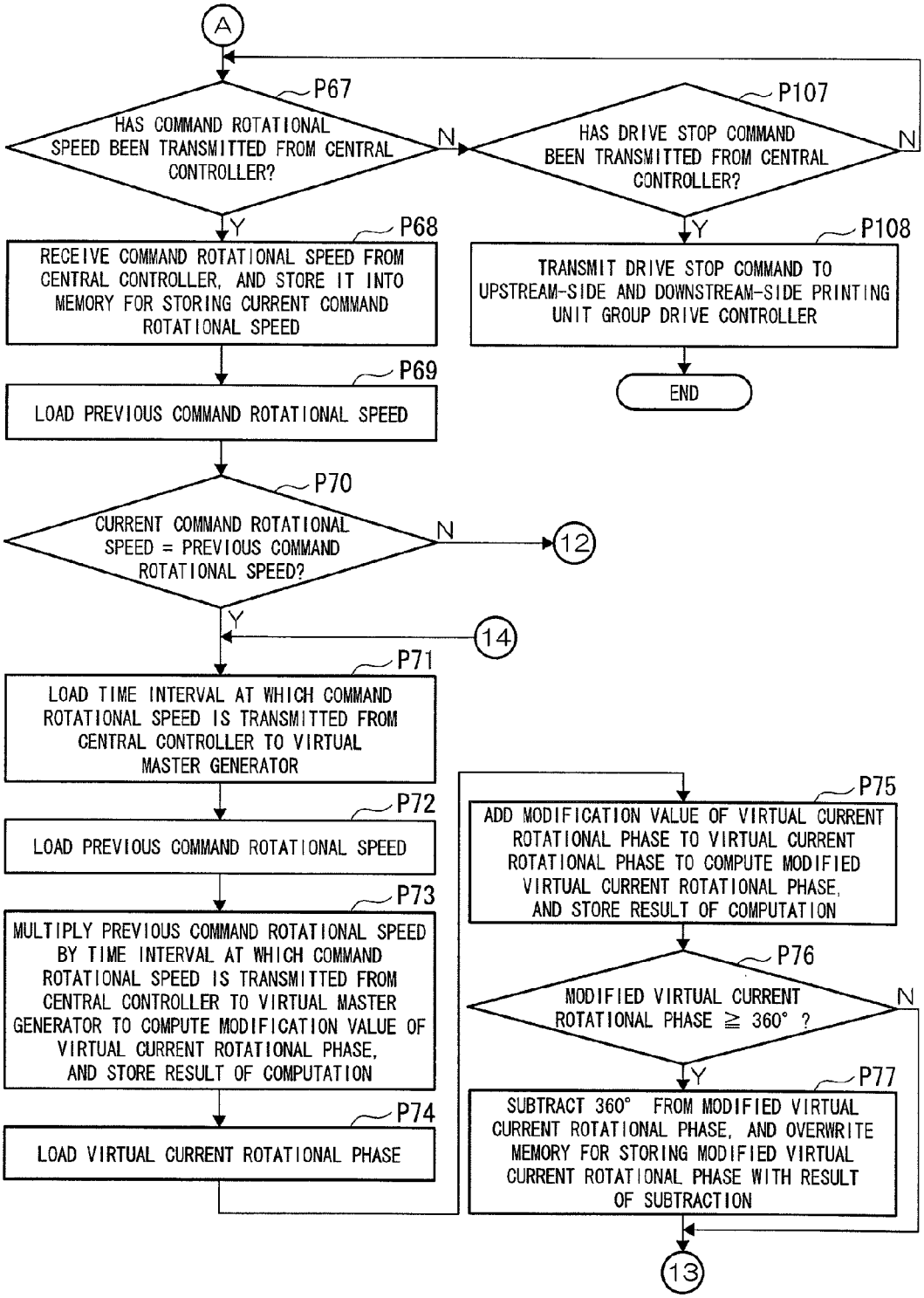
FIG. 7A is an operational flowchart of the virtual master generator in the embodiment of the present invention.
Figure 7B:
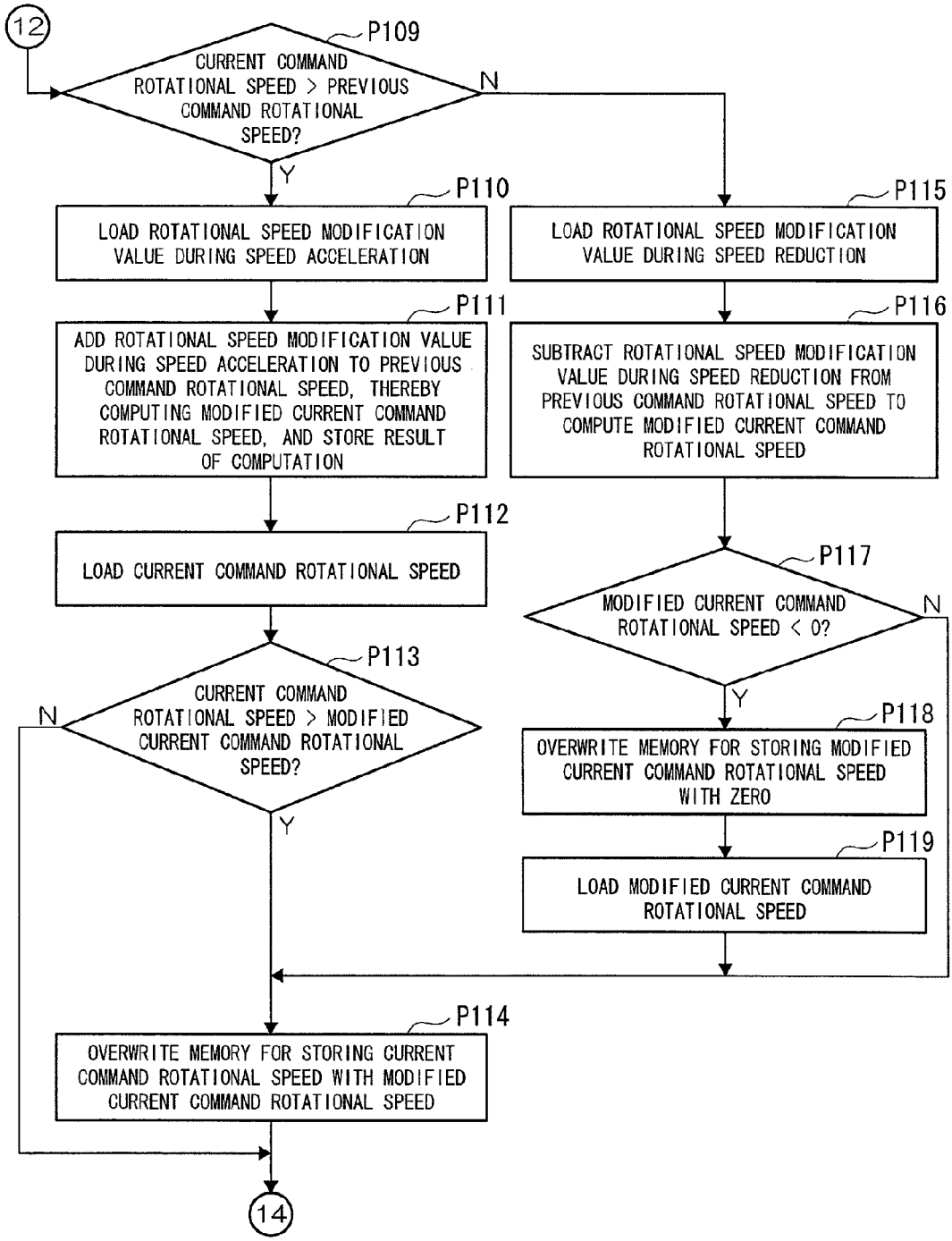
FIG. 7B is an operational flowchart of the virtual master generator in the embodiment of the present invention.
Figure 7C:
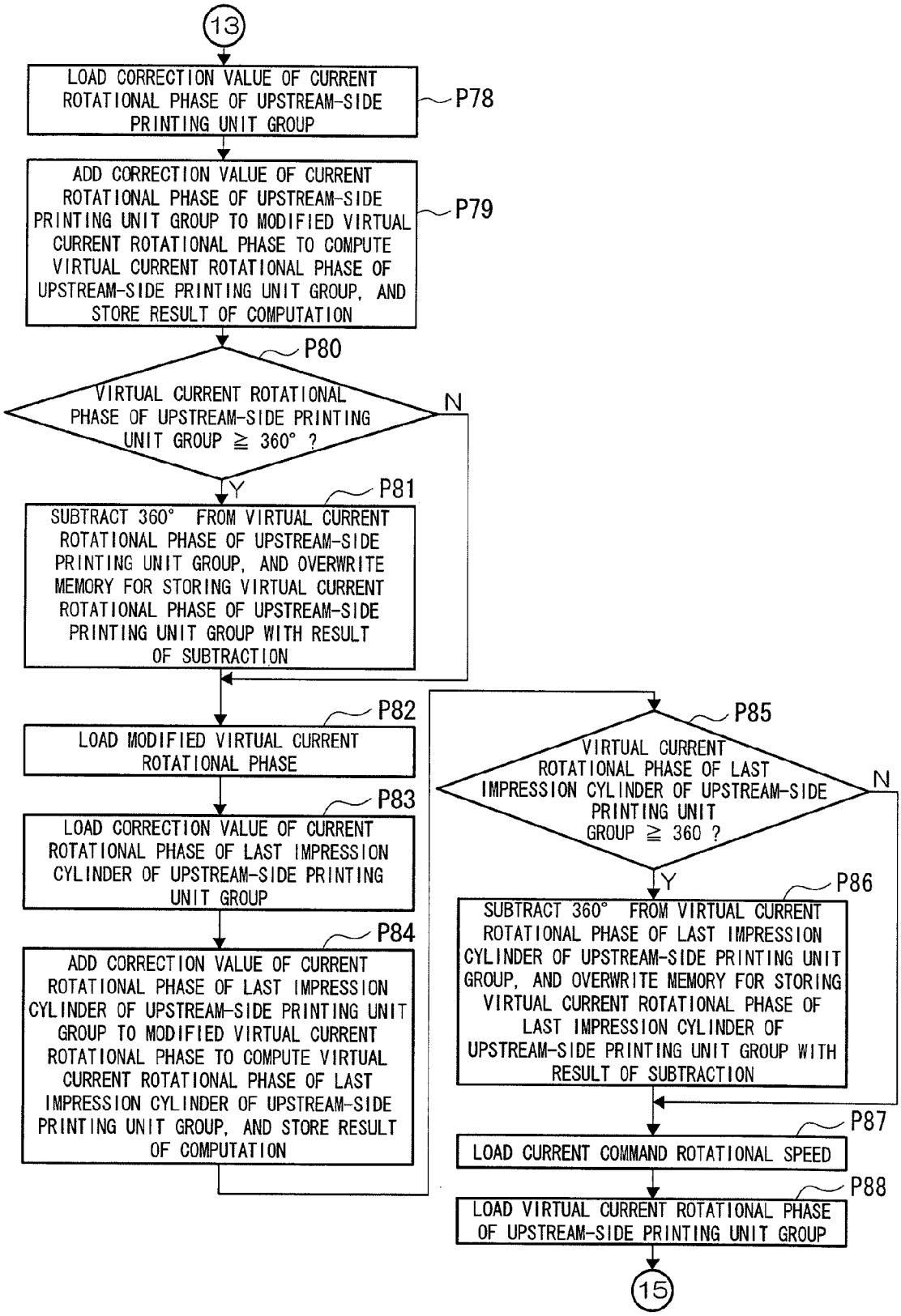
FIG. 7C is an operational flowchart of the virtual master generator in the embodiment of the present invention.
Figure 7D:
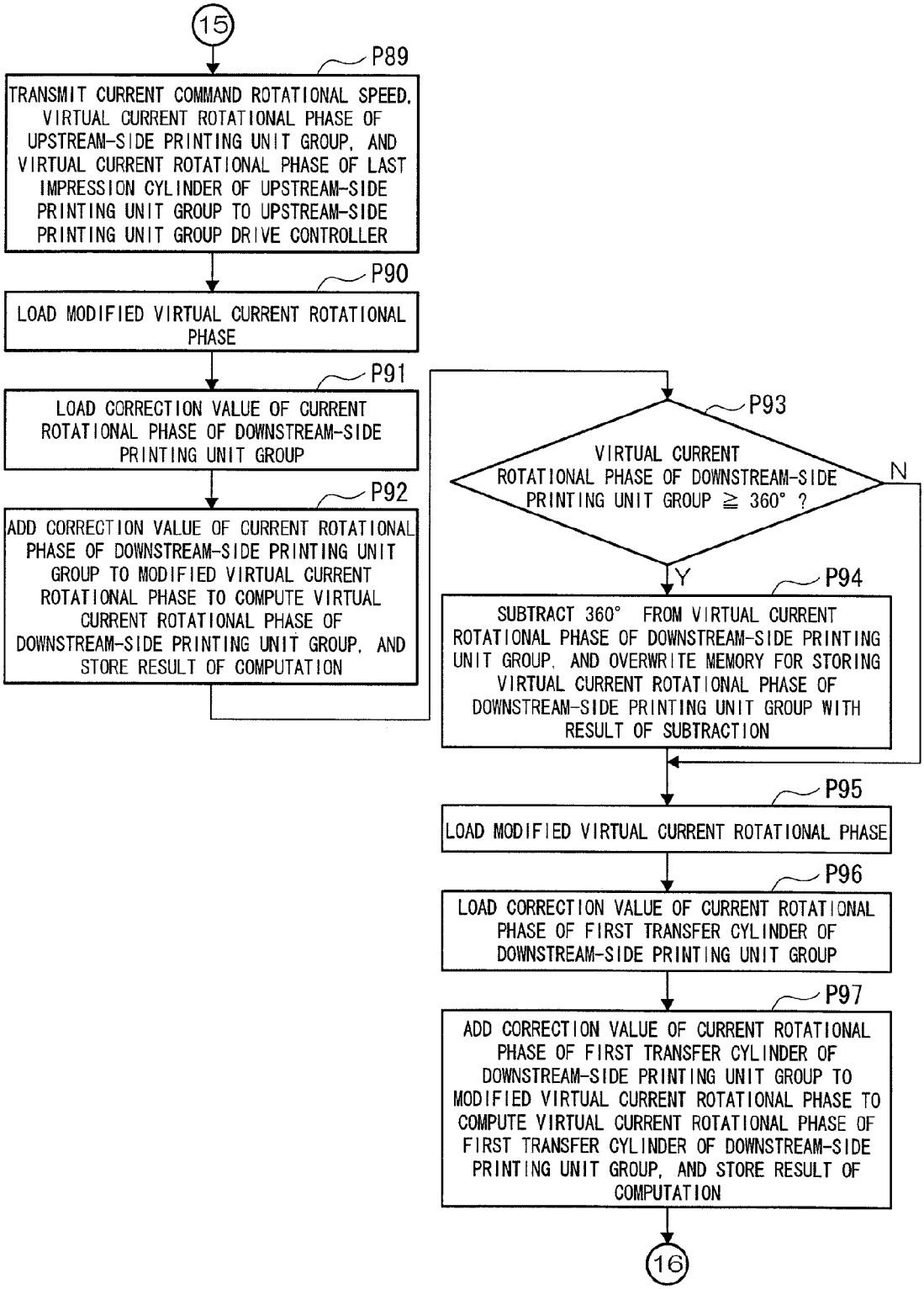
FIG. 7D is an operational flowchart of the virtual master generator in the embodiment of the present invention.
Figure 7E:
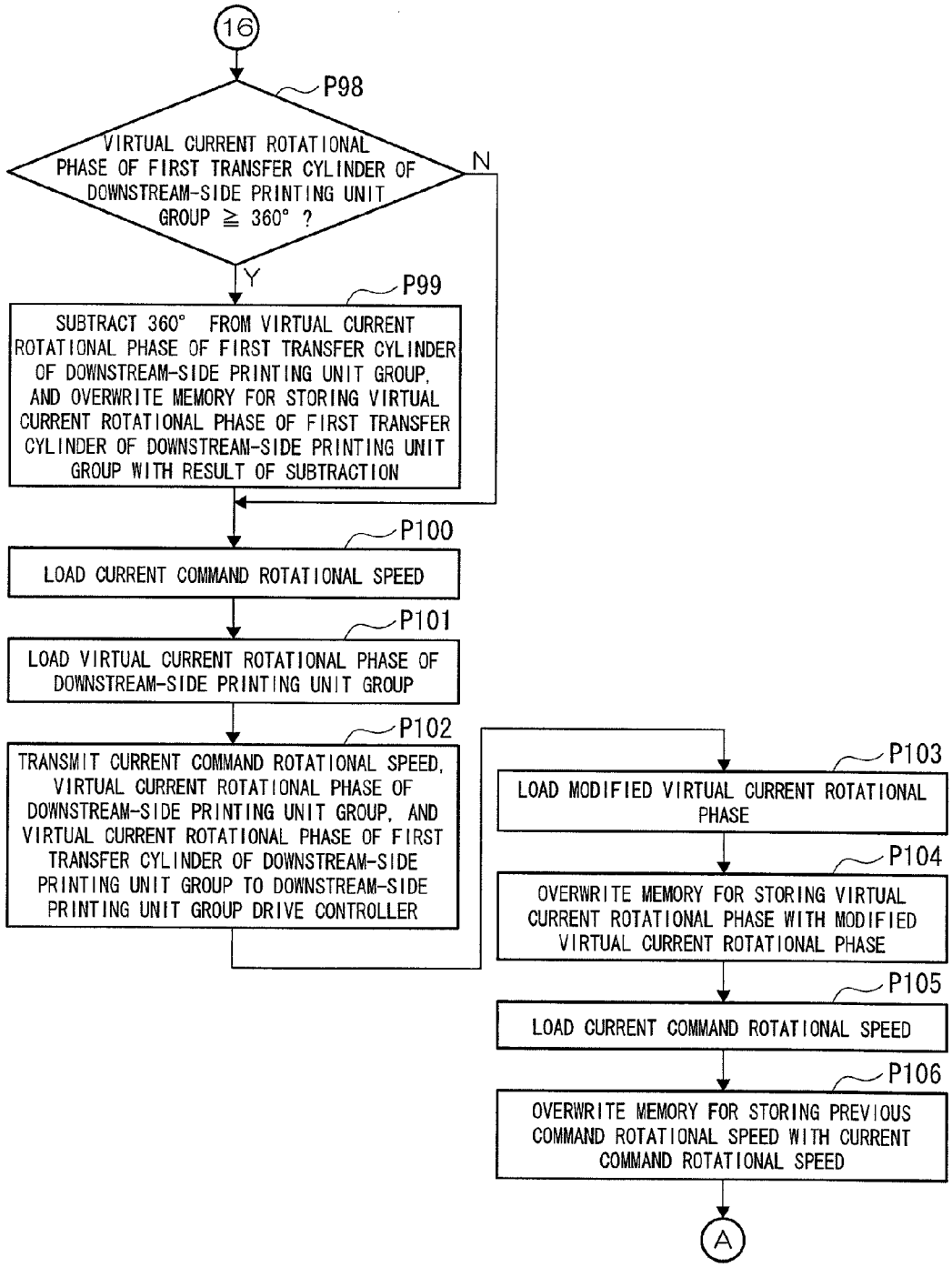
FIG. 7E is an operational flowchart of the virtual master generator in the embodiment of the present invention.
Figure 8A:
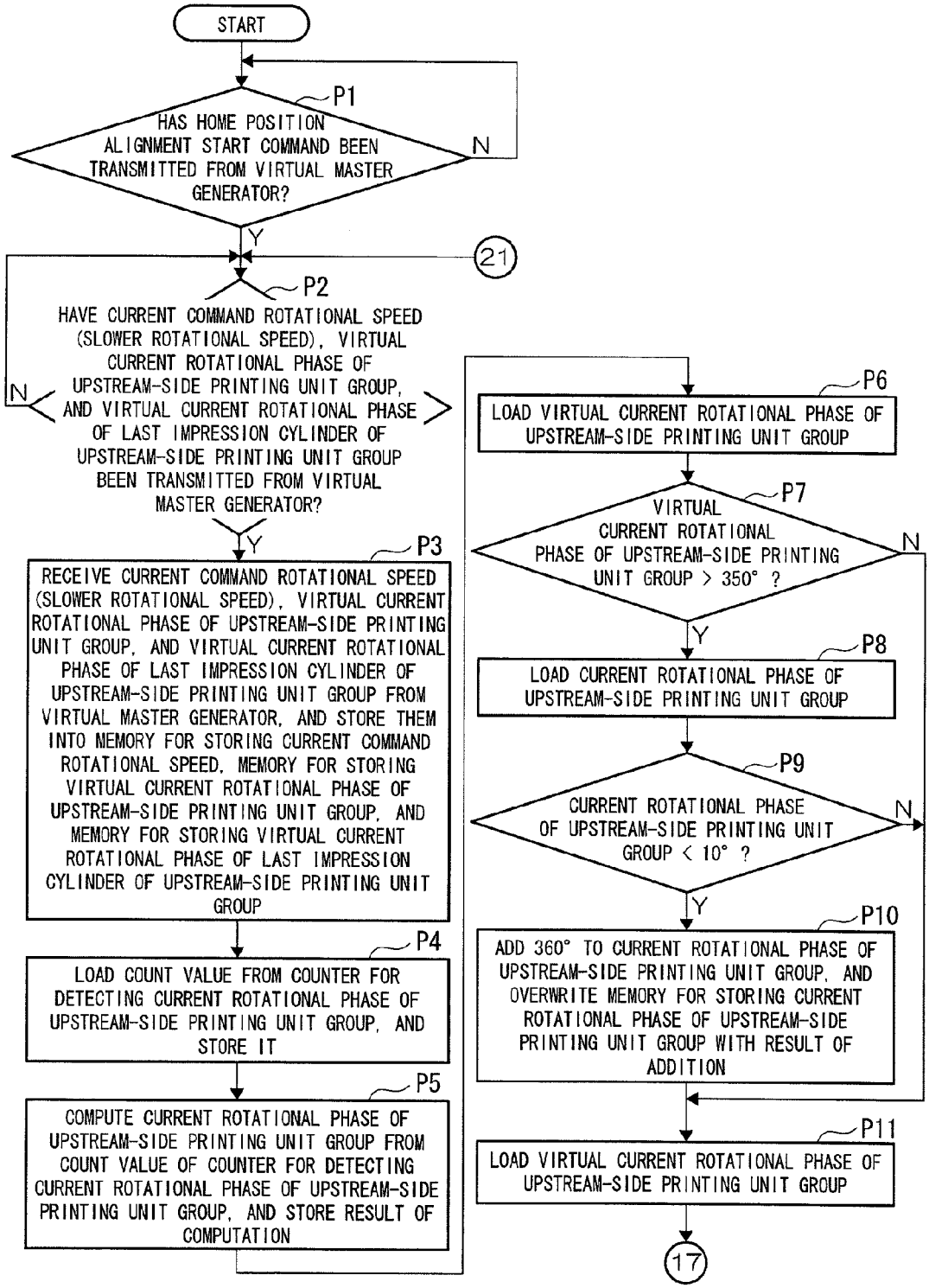
FIG. 8A is an operational flowchart of the upstream-side printing unit group drive controller in the embodiment of the present invention.
Figure 8B:
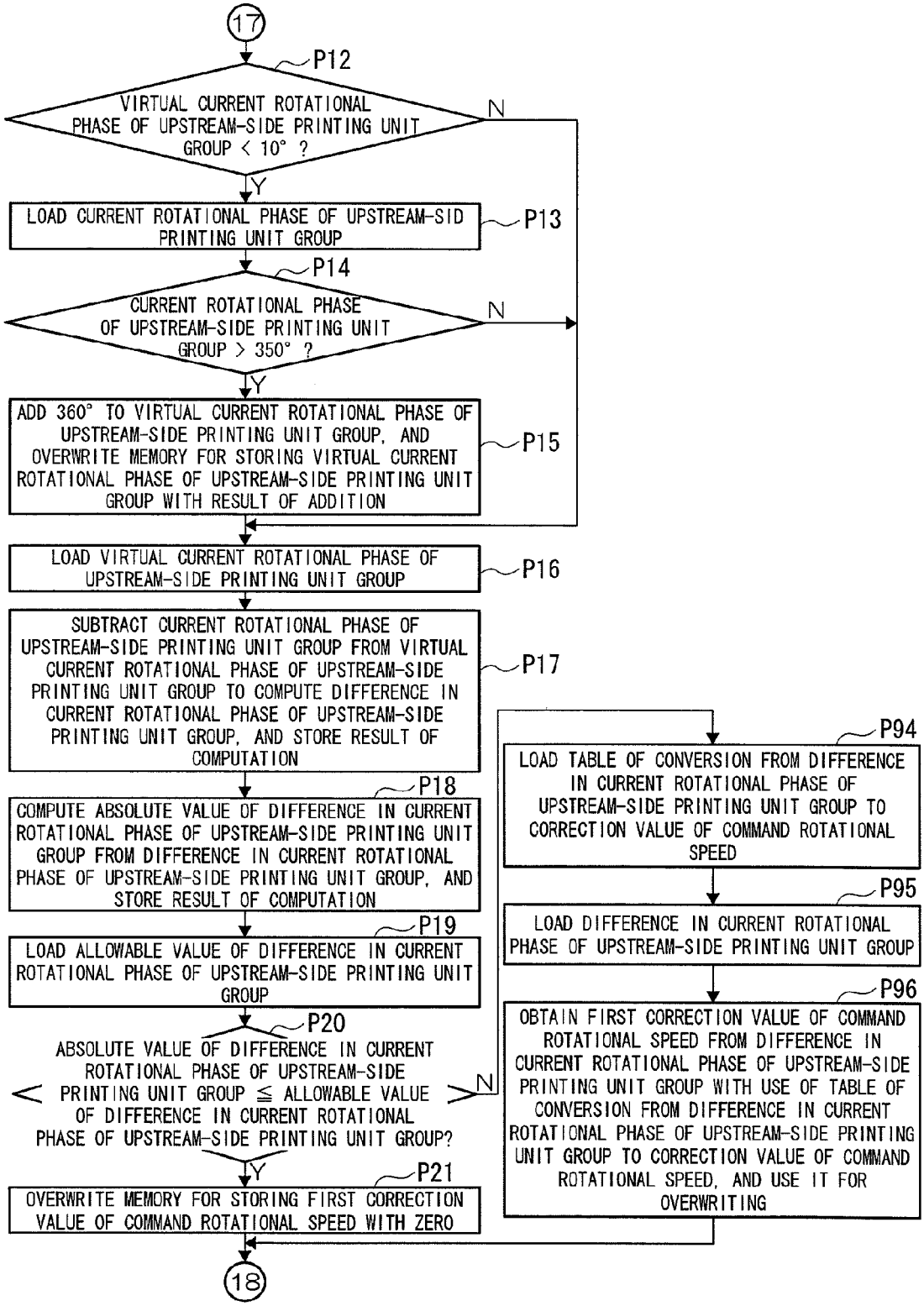
FIG. 8B is an operational flowchart of the upstream-side printing unit group drive controller in the embodiment of the present invention.
Figure 8C:
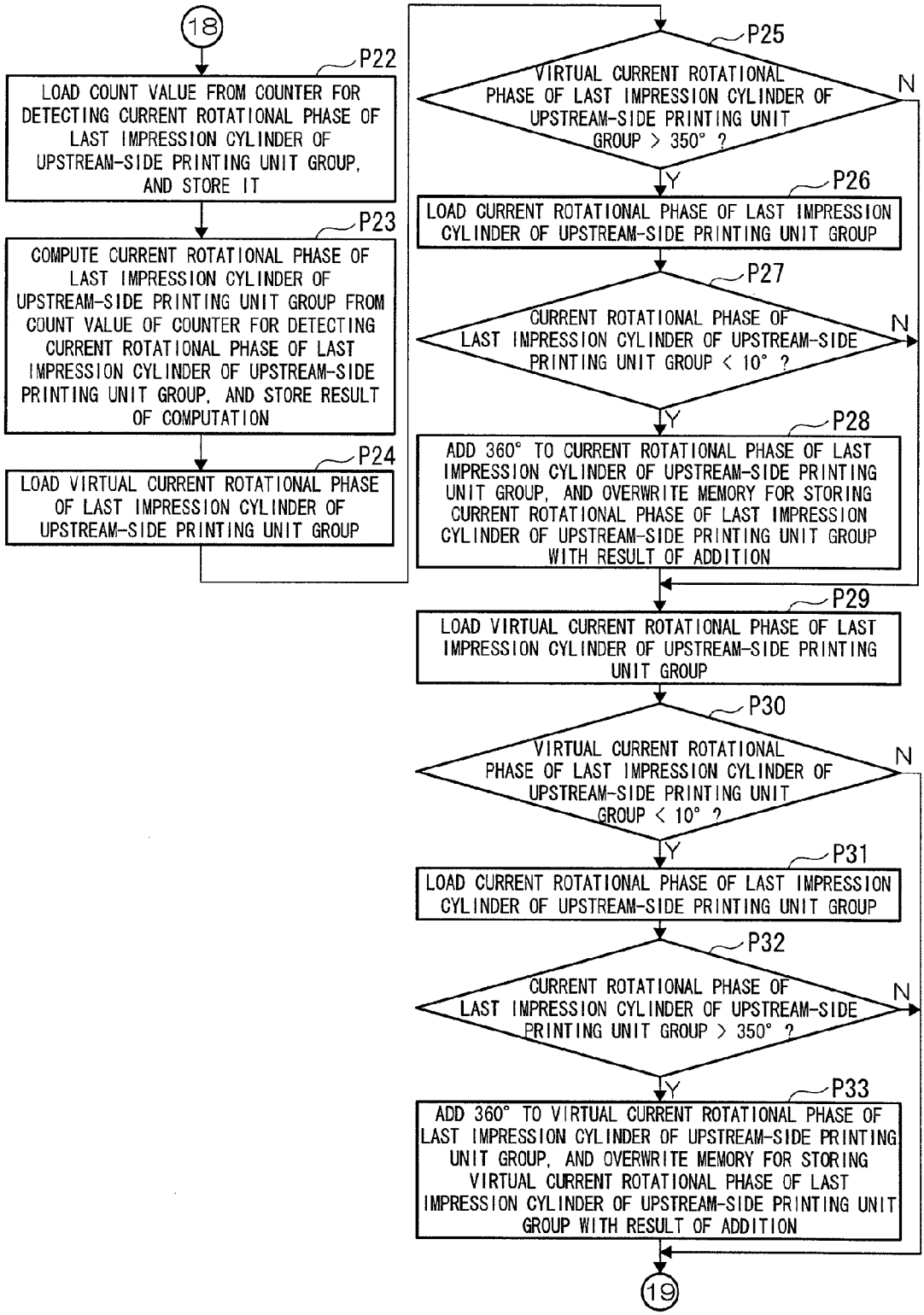
FIG. 8C is an operational flowchart of the upstream-side printing unit group drive controller in the embodiment of the present invention.
Figure 8D:
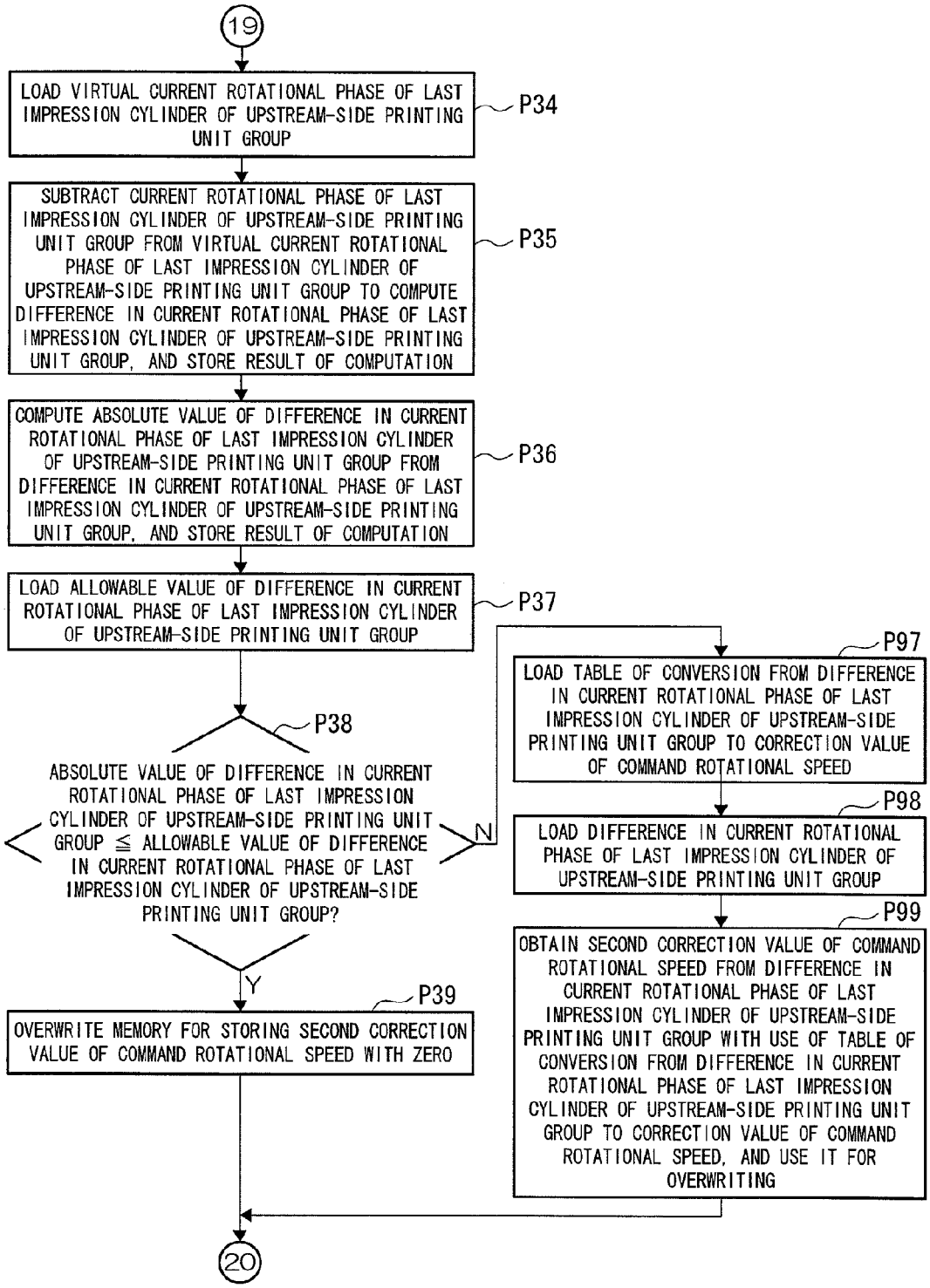
FIG. 8D is an operational flowchart of the upstream-side printing unit group drive controller in the embodiment of the present invention.
Figure 8E:
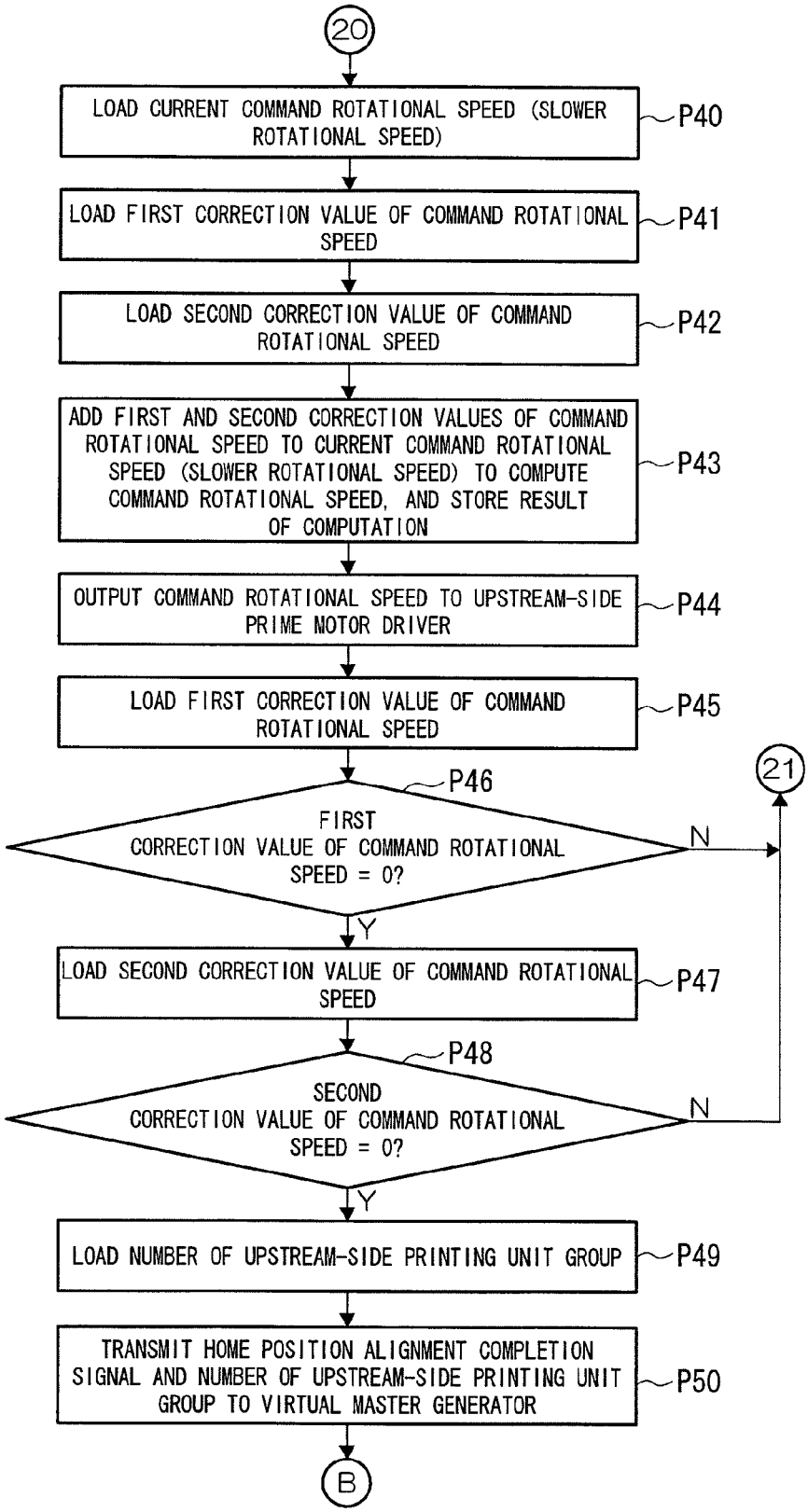
FIG. 8E is an operational flowchart of the upstream-side printing unit group drive controller in the embodiment of the present invention.
Figure 9A:
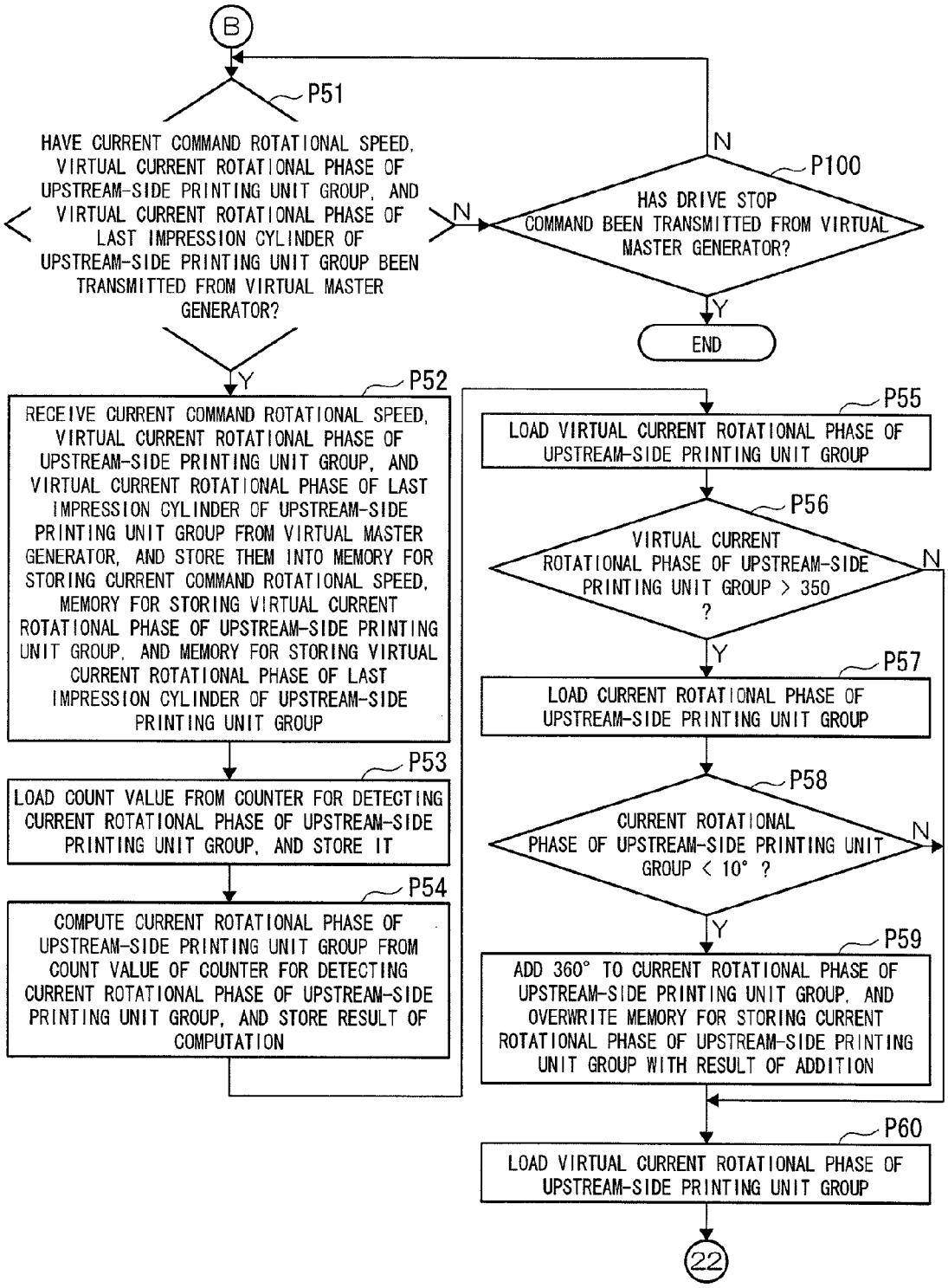
FIG. 9A is an operational flowchart of the upstream-side printing unit group drive controller in the embodiment of the present invention.
Figure 9B:
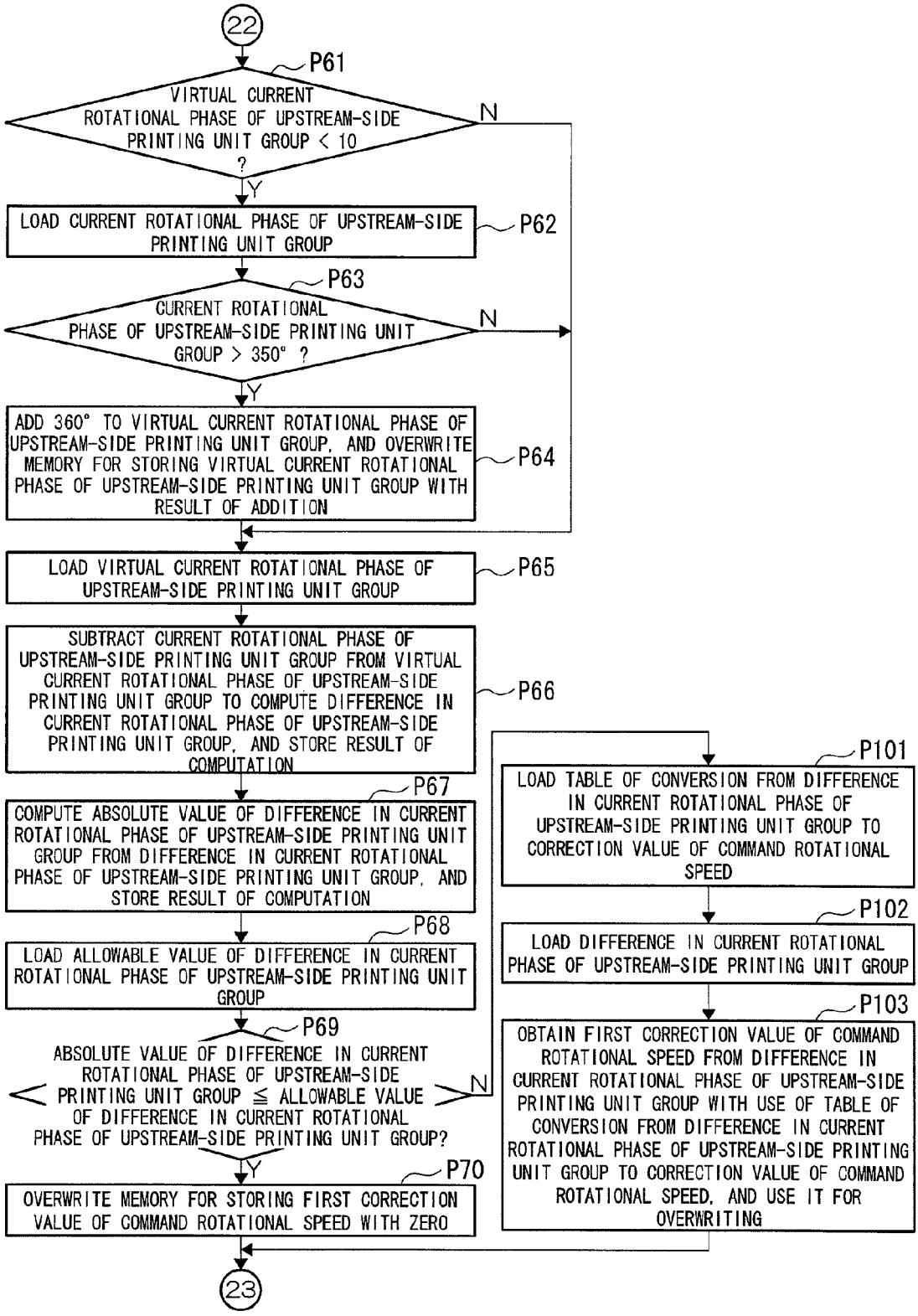
FIG. 9B is an operational flowchart of the upstream-side printing unit group drive controller in the embodiment of the present invention.
Figure 9C:
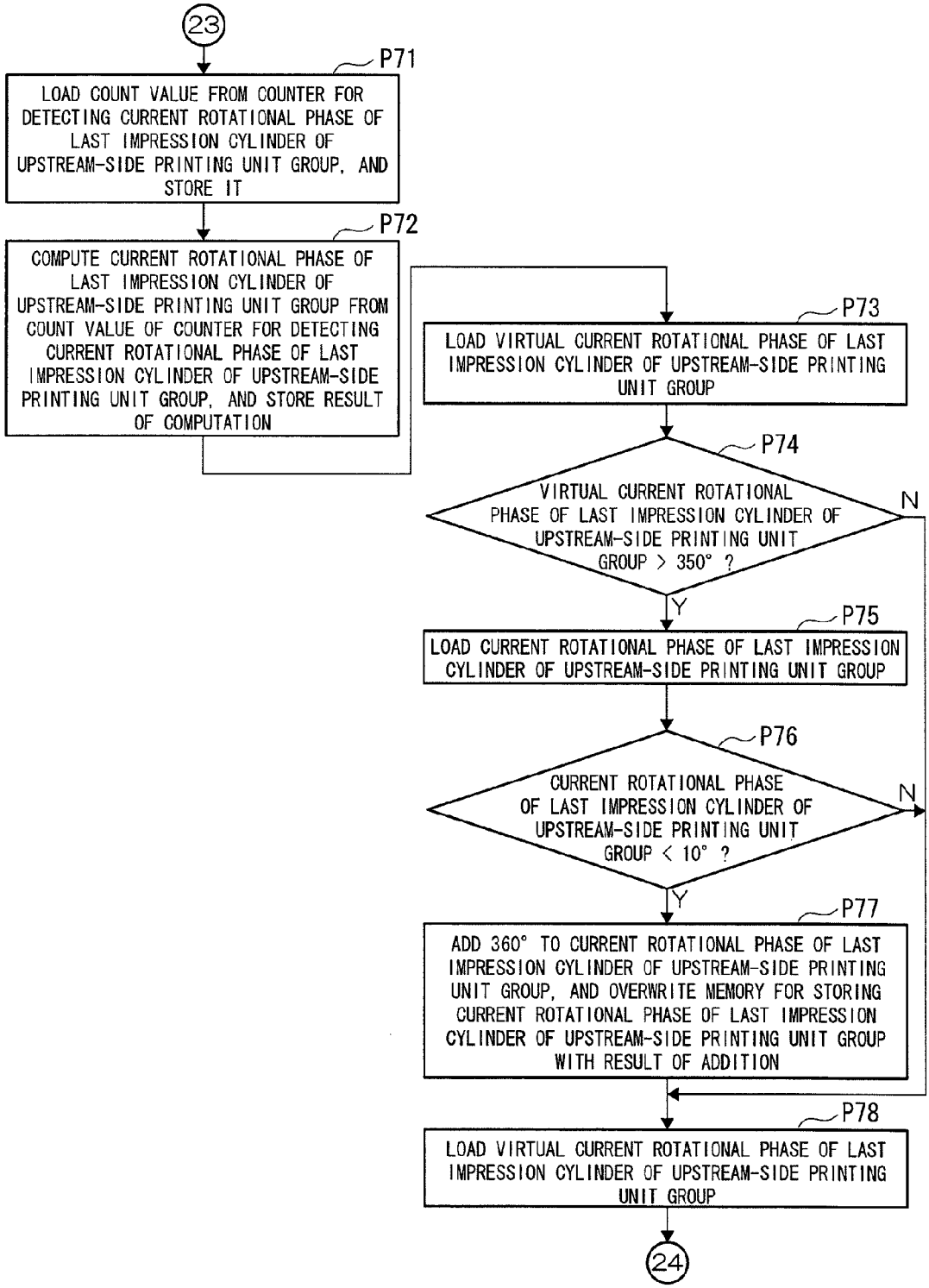
FIG. 9C is an operational flowchart of the upstream-side printing unit group drive controller in the embodiment of the present invention.
Figure 9D:
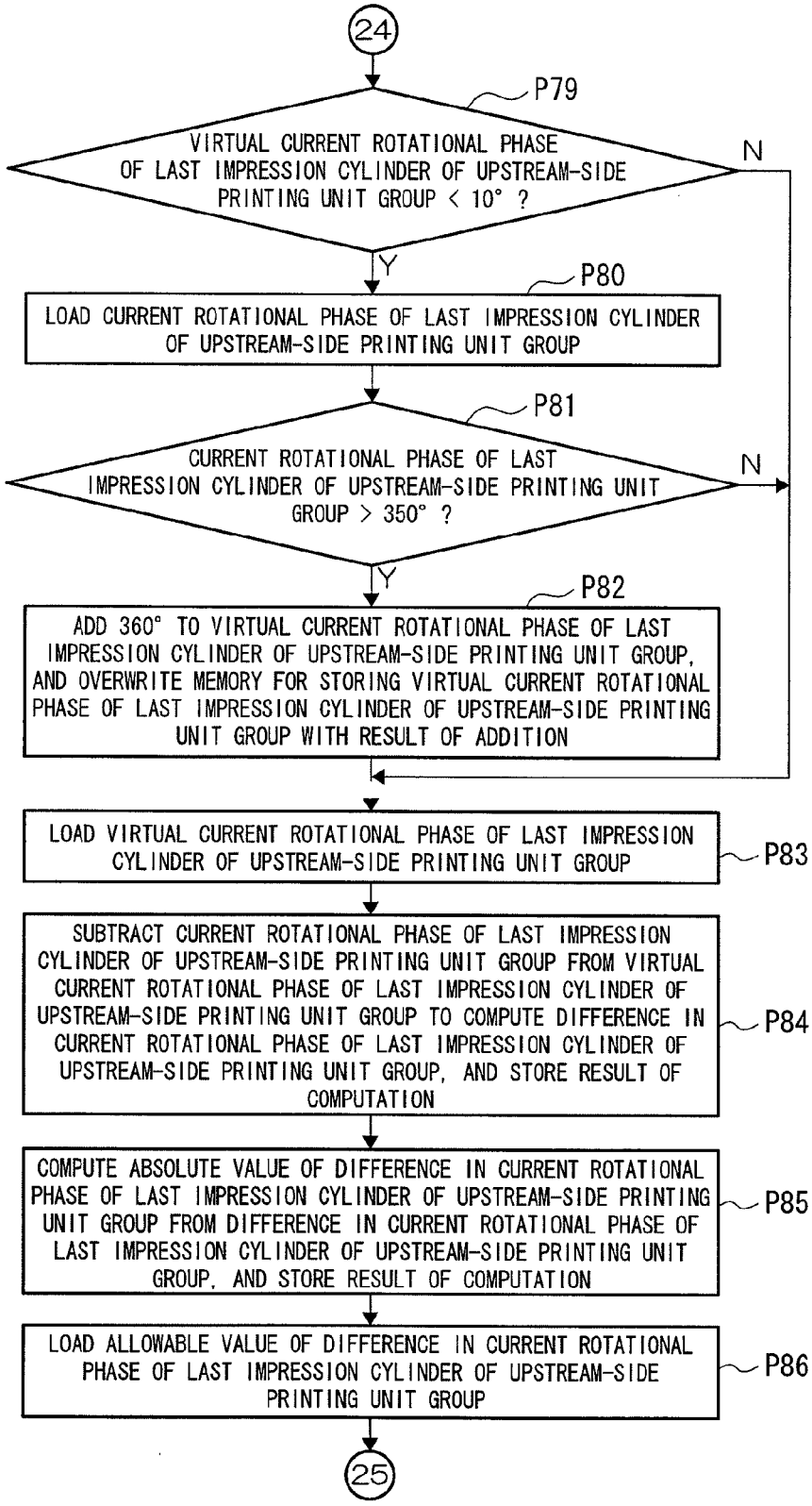
FIG. 9D is an operational flowchart of the upstream-side printing unit group drive controller in the embodiment of the present invention.
Figure 9E:
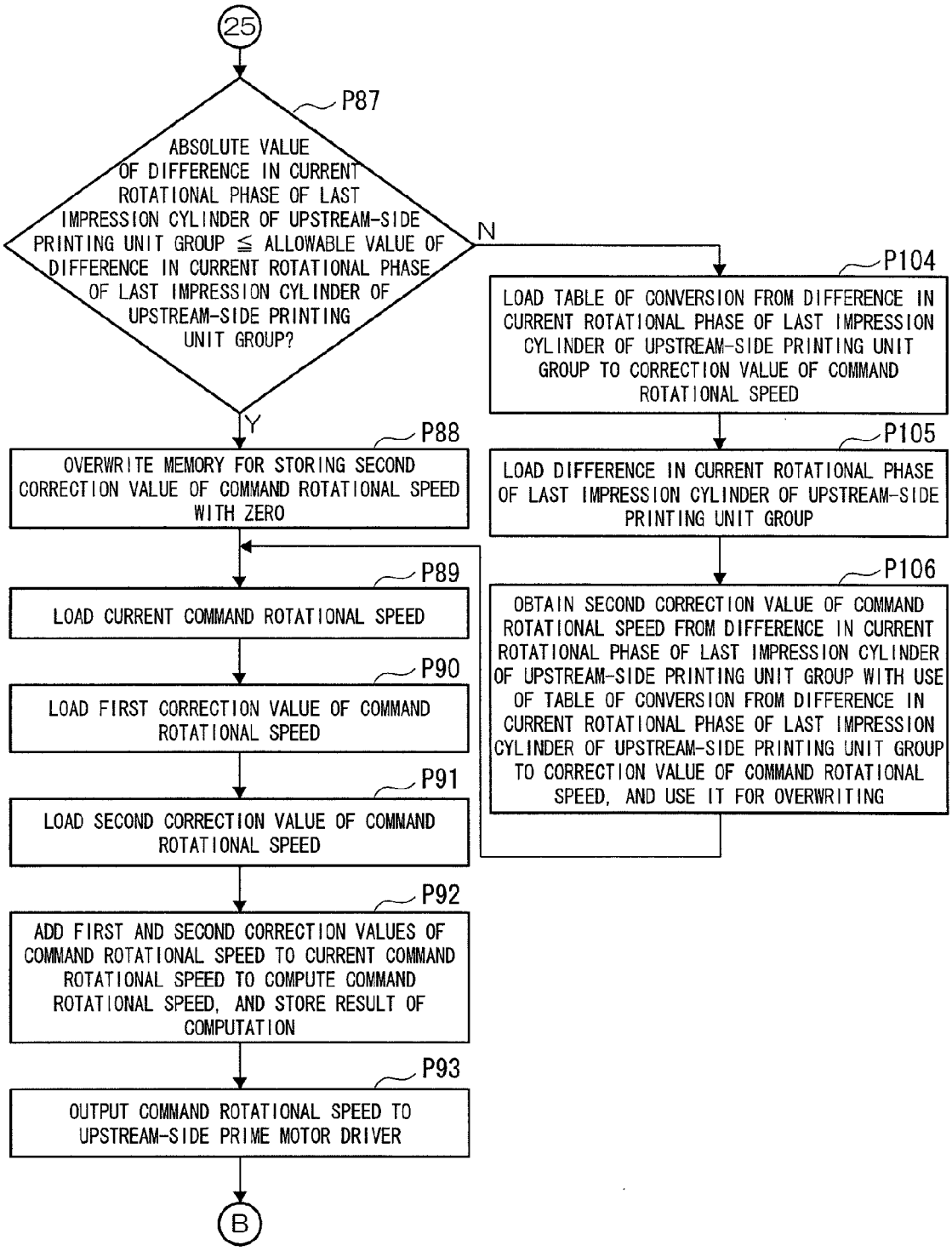
FIG. 9E is an operational flowchart of the upstream-side printing unit group drive controller in the embodiment of the present invention.
Figure 10A:
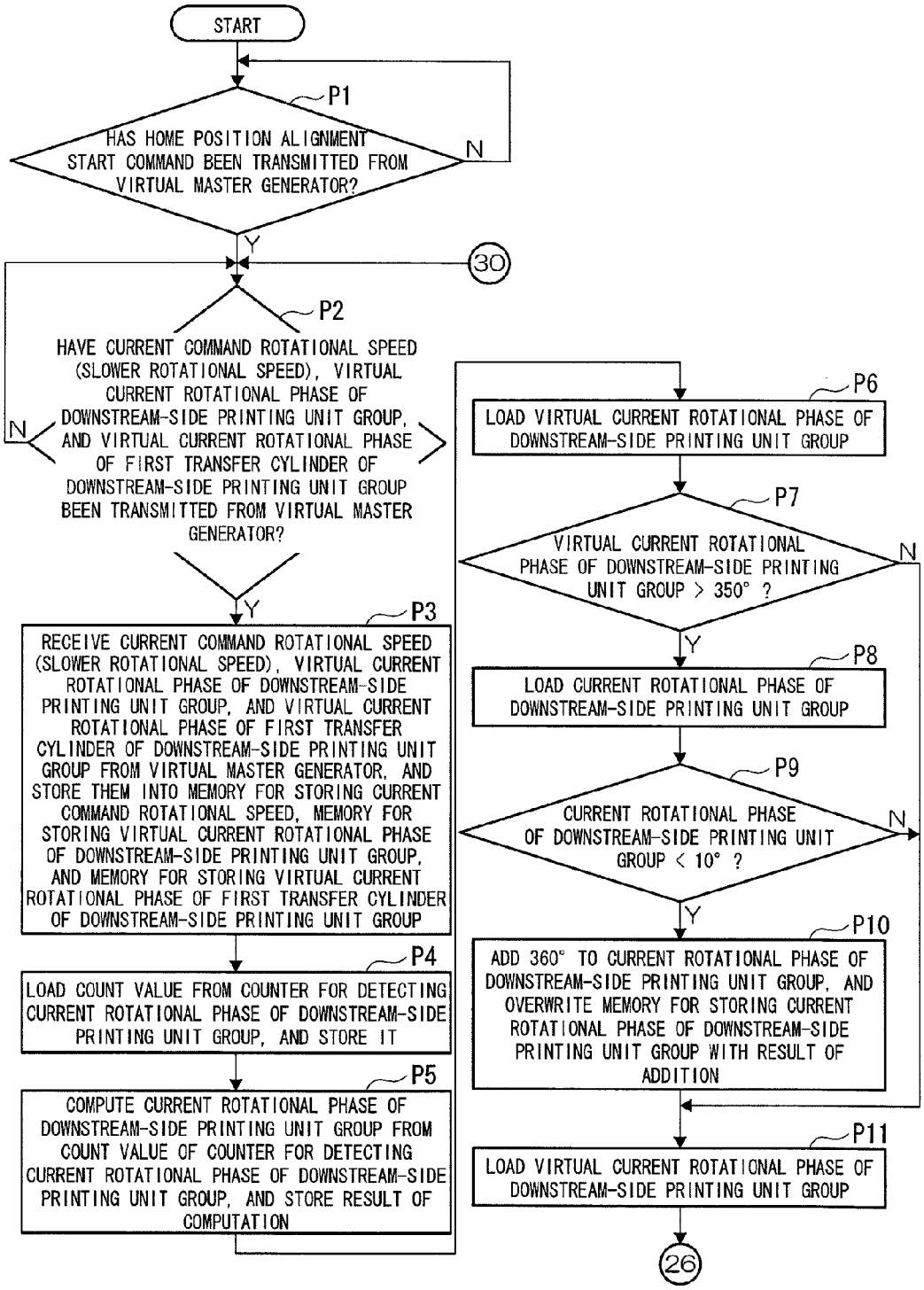
FIG. 10A is an operational flowchart of the downstream-side printing unit group drive controller in the embodiment of the present invention.
Figure 10B:
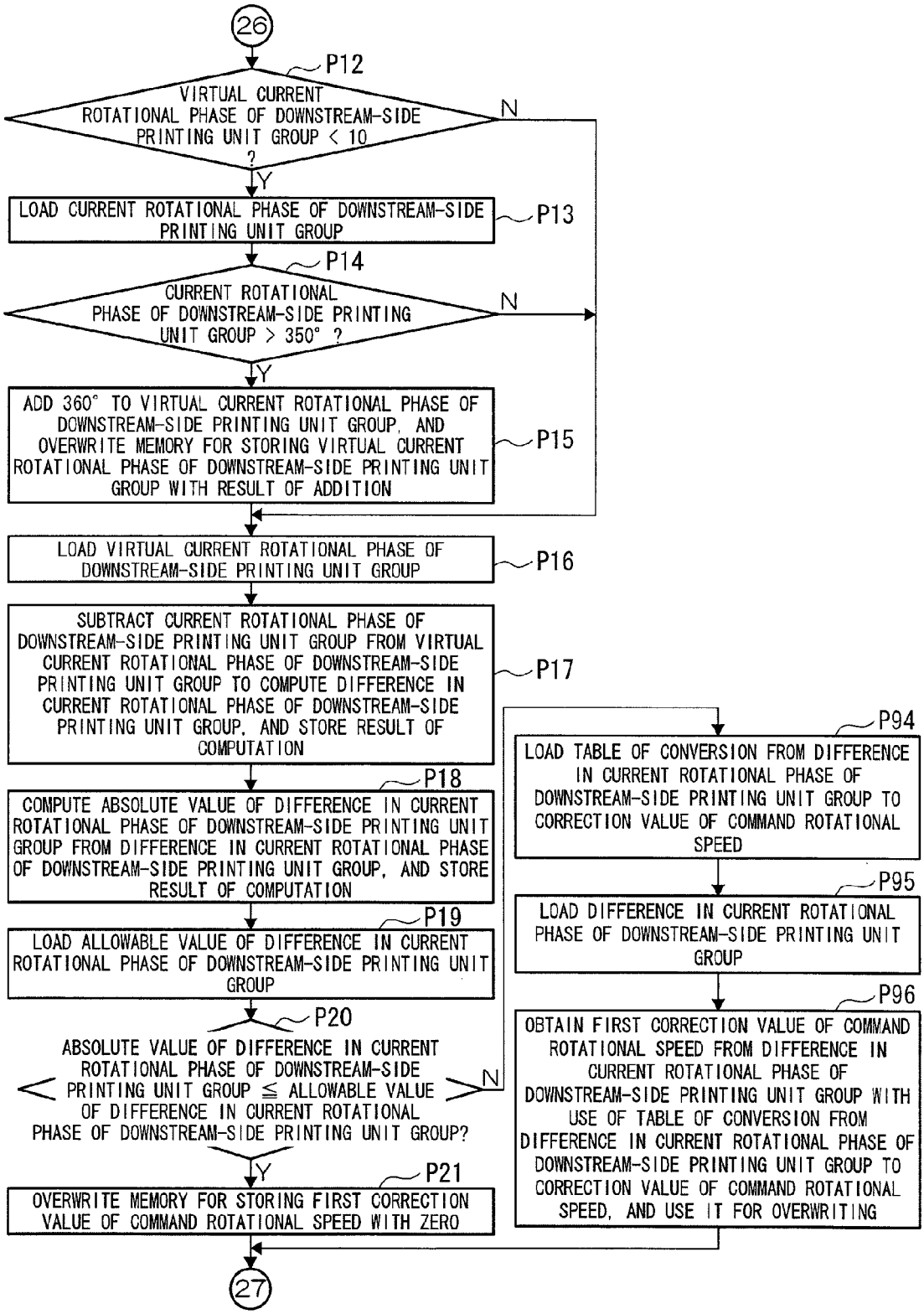
FIG. 10B is an operational flowchart of the downstream-side printing unit group drive controller in the embodiment of the present invention.
Figure 10C:
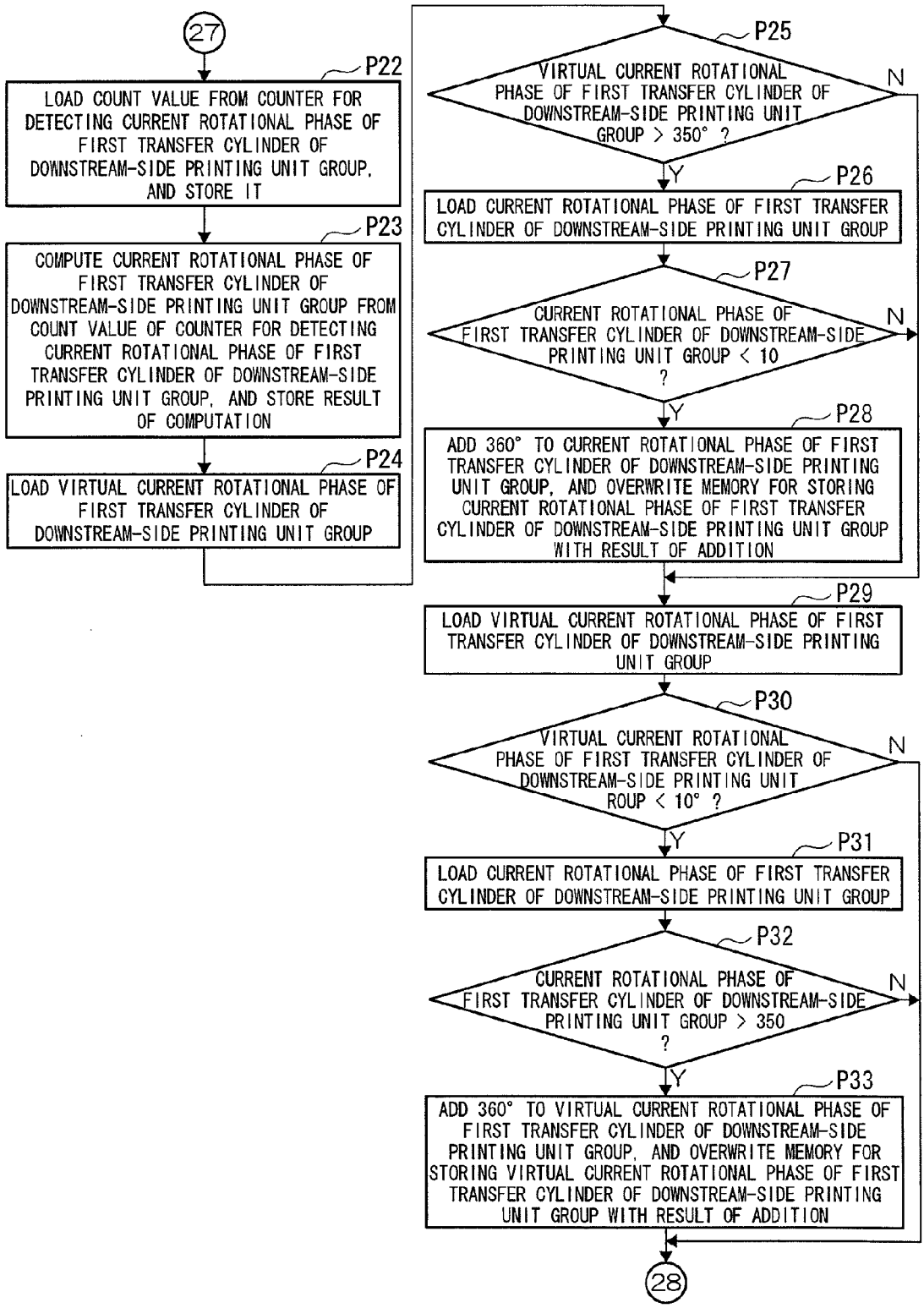
FIG. 10C is an operational flowchart of the downstream-side printing unit group drive controller in the embodiment of the present invention.
Figure 10D:
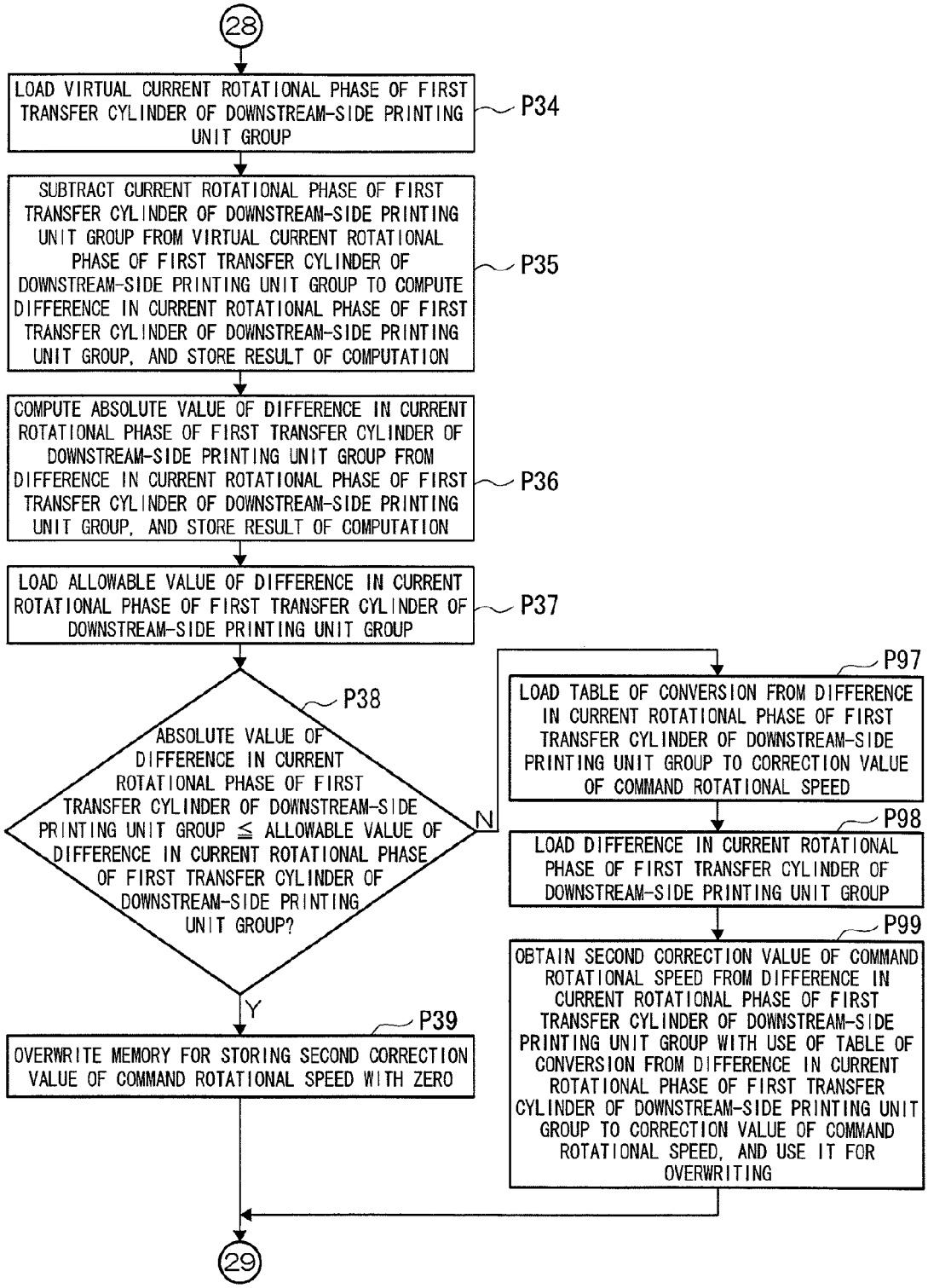
FIG. 10D is an operational flowchart of the downstream-side printing unit group drive controller in the embodiment of the present invention.
Figure 10E:
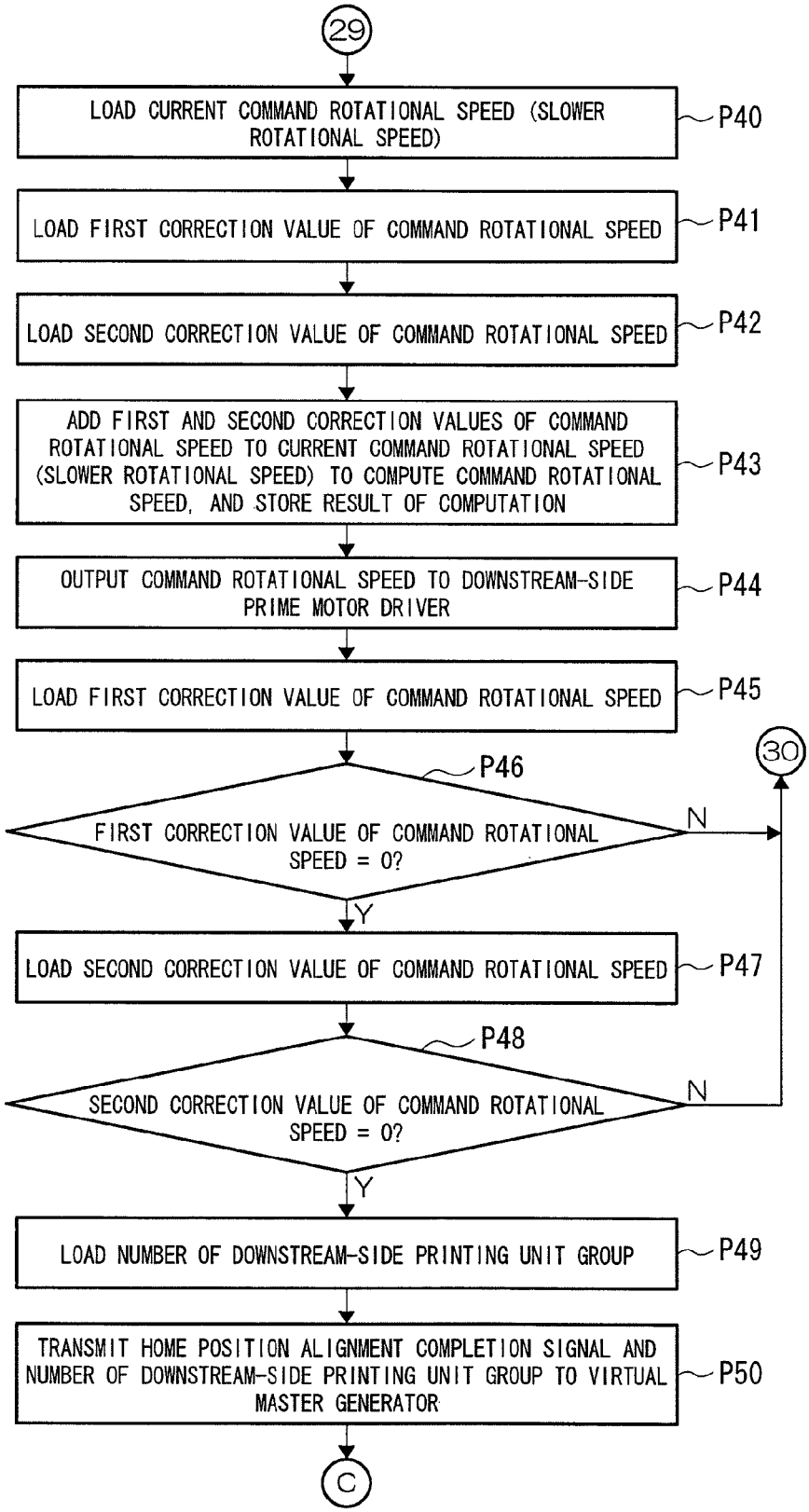
FIG. 10E is an operational flowchart of the downstream-side printing unit group drive controller in the embodiment of the present invention.
Figure 11A:
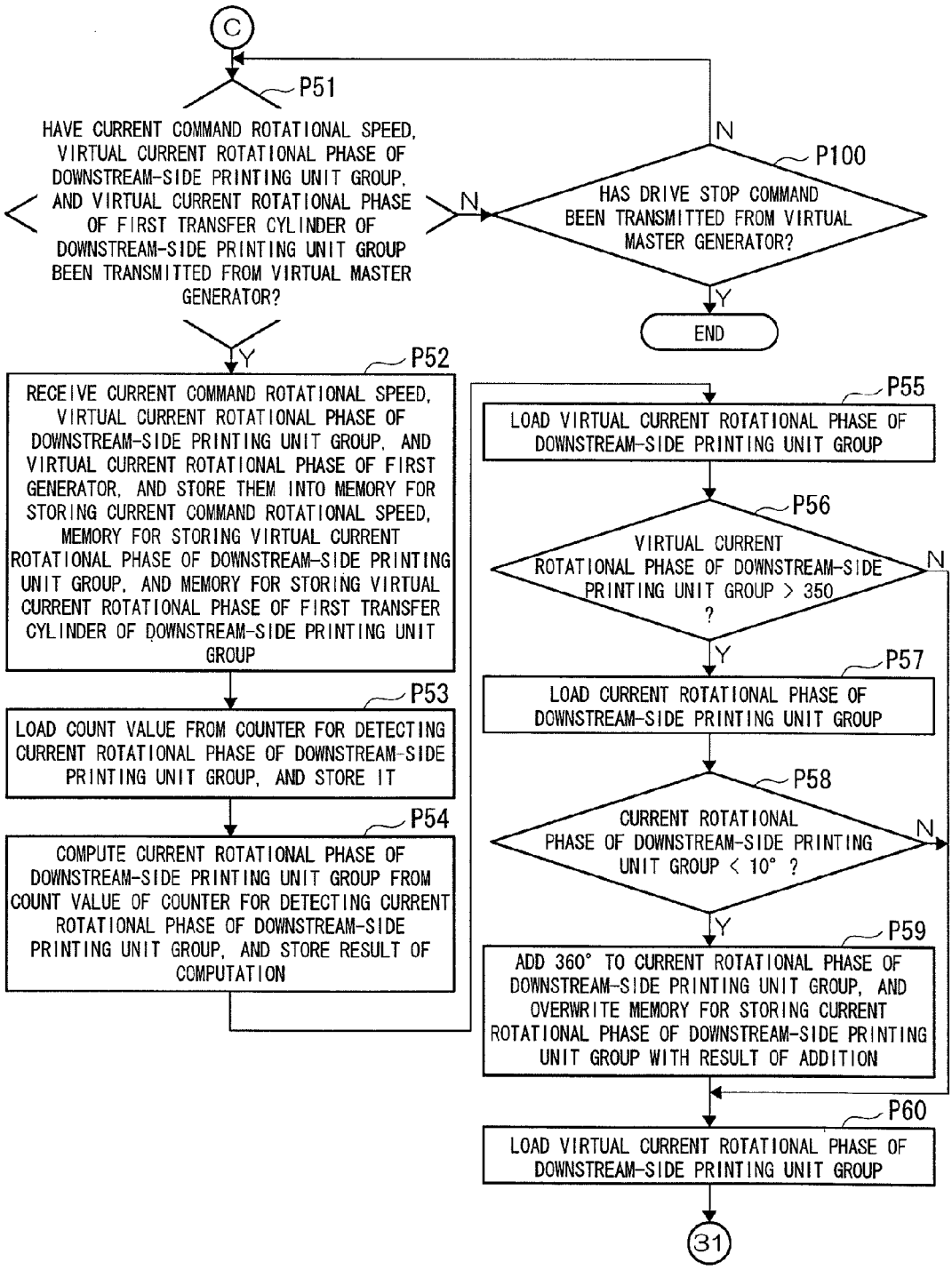
FIG. 11A is an operational flowchart of the downstream-side printing unit group drive controller in the embodiment of the present invention.
Figure 11B:
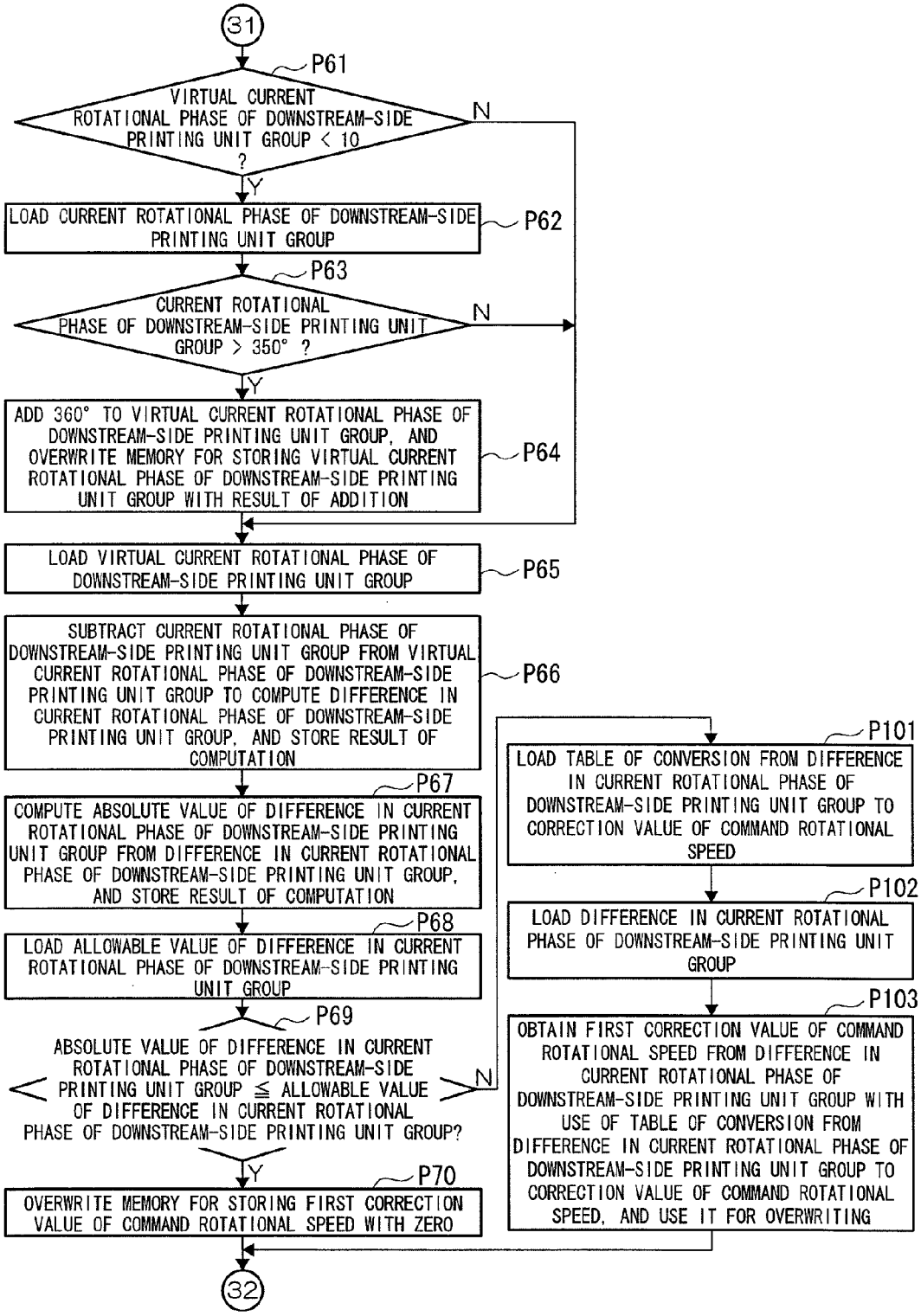
FIG. 11B is an operational flowchart of the downstream-side printing unit group drive controller in the embodiment of the present invention.
Figure 11C:
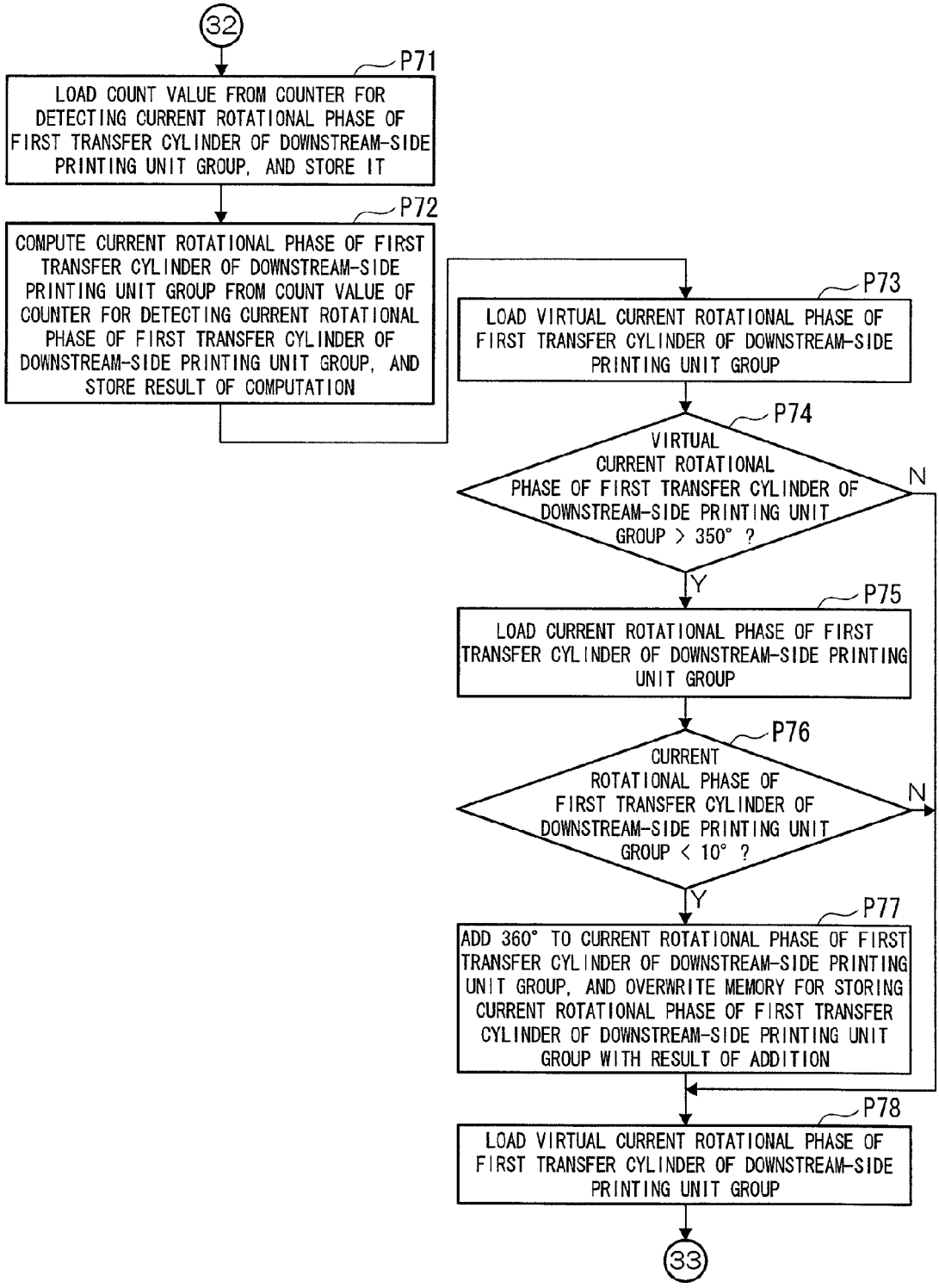
FIG. 11C is an operational flowchart of the downstream-side printing unit group drive controller in the embodiment of the present invention.
Figure 11D:
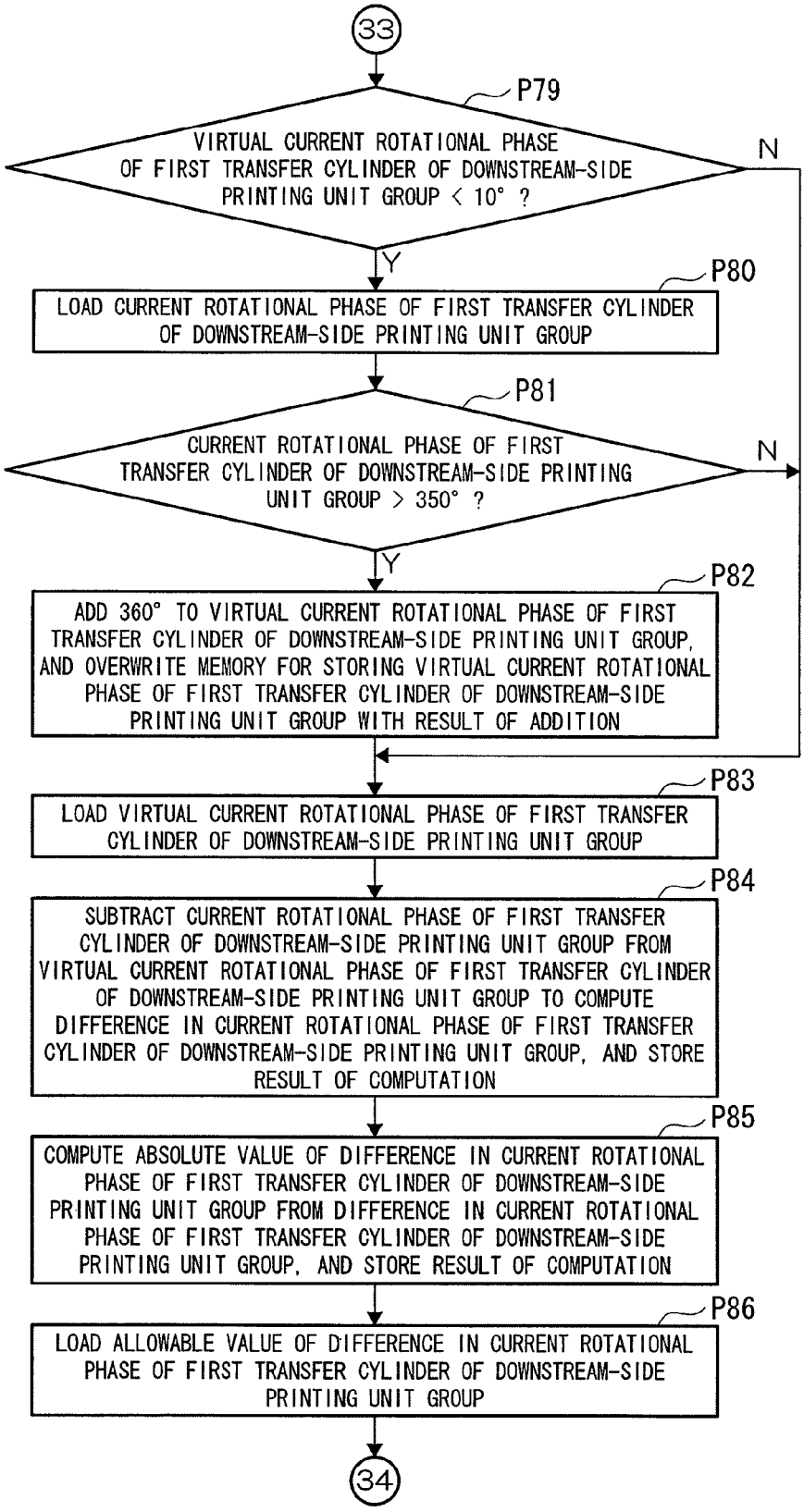
FIG. 11D is an operational flowchart of the downstream-side printing unit group drive controller in the embodiment of the present invention.
Figure 11E:
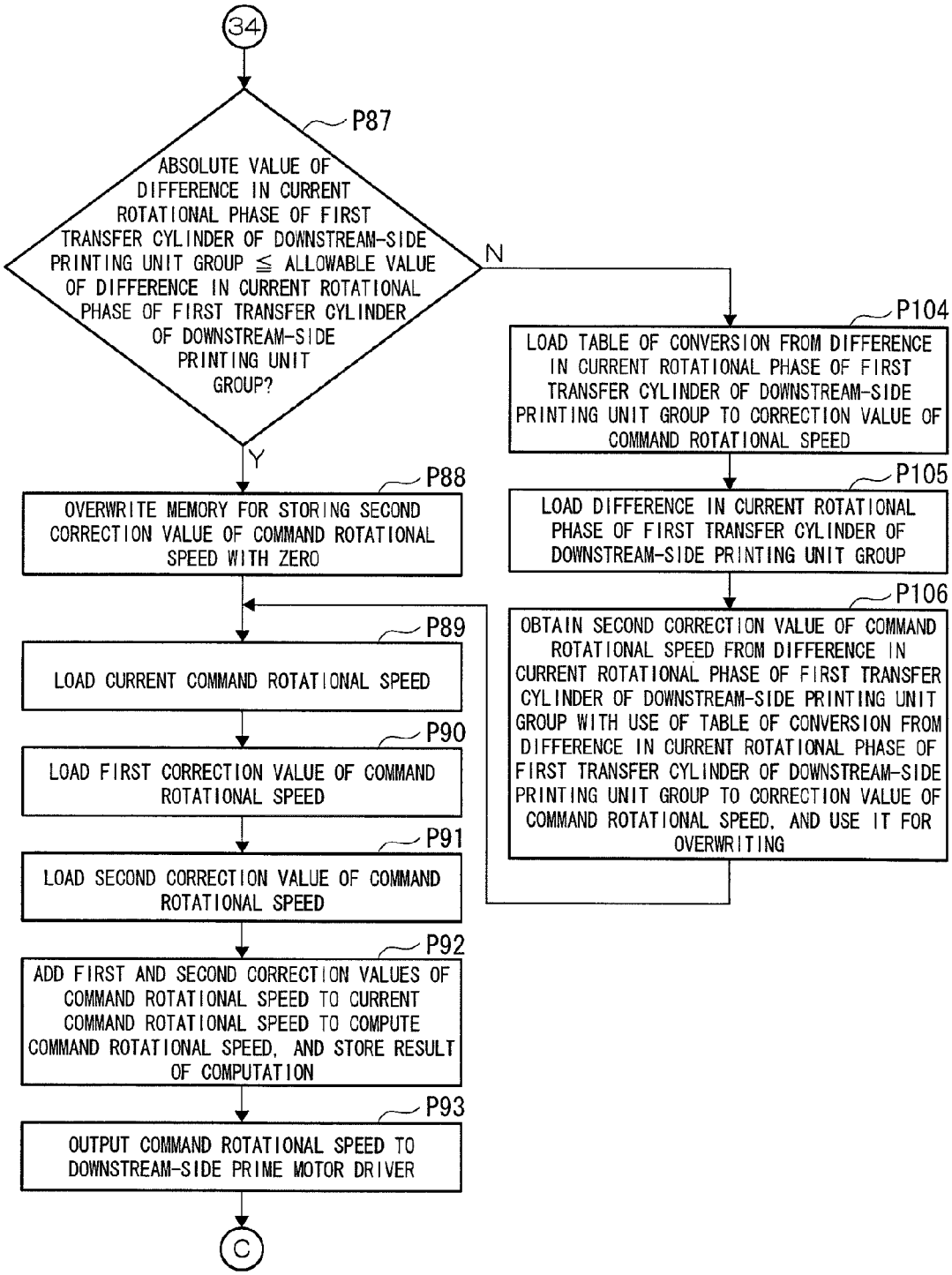
FIG. 11E is an operational flowchart of the downstream-side printing unit group drive controller in the embodiment of the present invention.

That is, a gear (second driven means) 2 of the last impression cylinder (first or quasi-second rotating body) 23 of the upstream-side printing unit group 20A does not mesh with a gear 3 of the first transfer cylinder (second or quasi-first rotating body) 24 of the downstream-side printing unit group 20B. Instead, the above gear 2 of the impression cylinder 23 meshes with a gear (first driven means) 3 of the last transfer cylinder 24 of the upstream-side printing unit group 20A to constitute a gear train of the upstream-side printing unit group 20A, thereby transmitting the driving force of the aforementioned upstream-side prime motor 1A. On the other hand, the gear (quasi-second driven means) 3 of the first transfer cylinder 24 of the downstream-side printing unit group 20B meshes with a gear (quasi-first driven means) 2 of the first impression cylinder 23 of the downstream-side printing unit group 20B to constitute a gear train of the downstream-side printing unit group 20B, thereby transmitting the driving force of the aforementioned downstream-side prime motor 18. In FIGS. 13, 5A and 5B denote drive pinions, 23*a* denotes a bearer of the impression cylinder 23, and 24*a* denotes a bear of the transfer cylinder 24.

At the cylinder shaft end, on the side opposite to the gear 2, of the first impression cylinder 23 of the upstream-side printing unit group 20A, a rotary encoder (first rotational phase detecting means) 8A for detecting the current rotational phase of the upstream-side printing unit group is mounted via a coupling 7A. At the cylinder shaft end, on the side opposite to the gear 2, of the last impression cylinder 23 of the upstream-side printing unit group 20A, a rotary encoder (second rotational phase detecting means) 8B for detecting the current rotational phase of the last impression cylinder of the upstream-side printing unit group is mounted via a coupling 78.

At the cylinder shaft end, on the side opposite to the gear 2, of the first impression cylinder 23 of the downstream-side printing unit group 20B, a rotary encoder (quasi-first rotational phase detecting means) 8C for detecting the current rotational phase of the downstream-side printing unit group is mounted via a coupling 7C. At the cylinder shaft end, on the side opposite to the gear 3, of the first transfer cylinder 24 of the downstream-side printing unit group 20B, a rotary encoder (quasi-second rotational phase detecting means) 8D for detecting the current rotational phase of the first transfer cylinder of the downstream-side printing unit group is mounted via a coupling 7D. Moreover, a home position detector (home position detecting means) 6 for detecting the home position of the last impression cylinder 23 of the upstream-side printing unit group 20A is provided for this impression cylinder 23.

The home position detector 6 is provided such that every time the last impression cylinder 23 of the upstream-side printing unit group 20A rotates, the home position detector 6 outputs a pulse at the home position of the last impression cylinder 23, resetting a counter 313 for detecting the current rotational phase of the upstream-side printing unit group, a counter 314 for detecting the current rotational phase of the last impression cylinder of the upstream-side printing unit group, a counter 413 for detecting the current rotational phase of the downstream-side printing unit group, and a counter 414 for detecting the current rotational phase of the first transfer cylinder of the downstream-side printing unit group (these counters will be described later).

The aforementioned upstream-side prime motor 1A has its drive controlled by an upstream-side printing unit group drive controller (control means) 300 to be described later, and the aforementioned downstream-side prime motor 1B has its drive controlled by a downstream-side printing unit group drive controller (control means) 400 to be described later.

In the present embodiment, the upstream-side prime motor 1A and the downstream-side prime motor 1B have their speed and phase synchronously controlled by a virtual master generator 200 (indicating means) based on a rotational speed to be set by a central controller 100 (to be described later).

As shown in FIG. 1, the central controller 100 comprises CPU 101, ROM 102, RAM 103, various input/output devices 104 to 106 and an interface 107 which are interconnected via BUS (bus line).

To the BUS, the following memories, etc. are connected: a memory M101 for storing a set rotational speed; a memory M102 for storing a slower rotational speed; a memory M103 for storing a command rotational speed; a memory M104 for storing a time interval at which the command rotational speed is transmitted to the virtual master generator; a memory M105 for storing the outputs of F/V converters connected to rotary encoders for detecting the current rotational phases of the upstream-side and downstream-side printing unit groups; a memory M106 for storing the current rotational speeds of the upstream-side and downstream-side printing unit groups; and an internal clock counter 108.

To the input/output device 104, the following are further connected: a printing press drive switch 111, a printing press drive stop switch 112, an input device 113 including a keyboard, various switches, buttons, and the like, a display unit 114 including CRT, lamps and the like, and an output device 115 including a floppy disk (registered trademark) drive, a printer, and the like.

A rotational speed setting unit 116 is connected to the input/output device 105. To the input/output device 106, the rotary encoder 8A for detecting the current rotational phase of the upstream-side printing unit group is connected via an A/D converter 117 and an F/V converter 118, and the rotary encoder 8C for detecting the current rotational phase of the downstream-side printing unit group is connected via an A/D converter 119 and an F/V converter 120.

The interface 107 is connected to the virtual master generator 200.

As shown in FIG. 2, the virtual master generator 200 comprises CPU 201, ROM 202, RAM 203, and an interface 204 which are interconnected via BUS (bus line).

To the BUS, the following memories are connected: a memory M201 for storing a virtual current rotational phase; a memory M202 for storing a current command rotational speed; a memory M203 for storing a previous command rotational speed; a memory M204 for storing a correction value of the current rotational phase of the upstream-side printing unit group; a memory M205 for storing the virtual current rotational phase of the upstream-side printing unit group; a memory M206 for storing a correction value of the current rotational phase of the last impression cylinder of the upstream-side printing unit group; a memory M207 for storing the virtual current rotational phase of the last impression cylinder of the upstream-side printing unit group; and a memory M208 for storing a correction value of the current rotational phase of the downstream-side printing unit group.

To the BUS, the following memories are also connected: a memory M209 for storing the virtual current rotational phase of the downstream-side printing unit group; a memory M210 for storing a correction value of the current rotational phase of the first transfer cylinder of the downstream-side printing unit group; a memory M211 for storing the virtual current rotational phase of the first transfer cylinder of the downstream-side printing unit group; a memory M212 for storing a time interval at which the command rotational speed is transmitted from the central controller to the virtual master generator; a memory M213 for storing a modification value of the virtual current rotational phase; a memory M214 for storing a modified virtual current rotational phase; a memory M215 for storing the number of the printing unit group which has completed home position alignment; a memory M216 for storing a rotational speed modification value during speed acceleration; a memory M217 for storing a modified current command rotational speed; and a memory M218 for storing a rotational speed modification value during speed reduction.

The interface 204 is connected to the central controller 100, the upstream-side printing unit group drive controller 300, and the downstream-side printing unit group drive controller 400.

As shown in FIGS. 3A and 3B, the upstream-side printing unit group drive controller 300 comprises CPU 301, ROM 302, RAM 303, various input/output devices 304 to 306 and an interface 307 which are interconnected via BUS (bus line).

To the BUS, the following memories are connected: a memory M301 for storing a current command rotational speed; a memory M302 for storing the virtual current rotational phase of the upstream-side printing unit group; a memory M303 for storing the virtual current rotational phase of the last impression cylinder of the upstream-side printing unit group; a memory M304 for storing the count value of a counter for detecting the current rotational phase of the upstream-side printing unit group; a memory M305 for storing the current rotational phase of the upstream-side printing unit group; a memory M306 for storing a difference in the current rotational phase of the upstream-side printing unit group; a memory M307 for storing the absolute value of the difference in the current rotational phase of the upstream-side printing unit group; a memory M308 for storing the allowable value of the difference in the current rotational phase of the upstream-side printing unit group; a memory M309 for storing a table of conversion from the difference in the current rotational phase of the upstream-side printing unit group to the correction value of the command rotational speed; a memory M310 for storing the first correction value of the command rotational speed; and a memory M311 for storing the count value of a counter for detecting the current rotational phase of the last impression cylinder of the upstream-side printing unit group.

To the BUS, the following memories are also connected: a memory M312 for storing the current rotational phase of the last impression cylinder of the upstream-side printing unit group; a memory M313 for storing a difference in the current rotational phase of the last impression cylinder of the upstream-side printing unit group; a memory M314 for storing the absolute value of the difference in the current rotational phase of the last impression cylinder of the upstream-side printing unit group; a memory M315 for storing the allowable value of the difference in the current rotational phase of the last impression cylinder of the upstream-side printing unit group; a memory M316 for storing a table of conversion from the difference in the current rotational phase of the last impression cylinder of the upstream-side printing unit group to the correction table of the command rotational speed; a memory M317 for storing the second correction value of the command rotational speed; a memory M318 for storing the command rotational speed; and a memory M319 for storing the number of the upstream-side printing unit group.

The upstream-side prime motor 1A is connected to the input/output device 304 via a D/A converter 311 and an upstream-side prime motor driver 312. The upstream-side prime motor driver 312 is connected to a rotary encoder 1AR for the upstream-side prime motor, which is integrally coupled to and incorporated in the shaft of the upstream-side prime motor 1A, for speed control.

A counter (first rotational phase detecting means) 313 for detecting the current rotational phase of the upstream-side printing unit group is connected to the input/output device 305. The rotary encoder 8A for detecting the current rotational phase of the upstream-side printing unit group, which is connected to the aforementioned input/output device 106, is connected to the counter 313 for detecting the current rotational phase of the upstream-side printing unit group, so as to output a clock pulse. Thus, the counter 313 for detecting the current rotational phase of the upstream-side printing unit group has a count value conformed to the current rotational phase of the upstream-side printing unit group 20A.

A counter (second rotational phase detecting means) 314 for detecting the current rotational phase of the last impression cylinder of the upstream-side printing unit group is connected to the input/output device 306. The rotary encoder BE for detecting the current rotational phase of the last impression cylinder of the upstream-side printing unit group is connected to the counter 314 for detecting the current rotational phase of the last impression cylinder of the upstream-side printing unit group, so as to output a clock pulse. Thus, the counter 314 for detecting the current rotational phase of the last impression cylinder of the upstream-side printing unit group has a count value conformed to the current rotational phase of the last impression cylinder 23 of the upstream-side printing unit group 20A.

The counter 313 for detecting the current rotational phase of the upstream-side printing unit group and the counter 314 for detecting the current rotational phase of the last impression cylinder of the upstream-side printing unit group are connected to the home position detector 6 provided for the last impression cylinder 23 of the upstream-side printing unit group 20A.

The interface 307 is connected to the virtual master generator 200.

As shown in FIGS. 4A and 4B, the downstream-side printing unit group drive controller 400 comprises CPU 401, ROM 402, RAM 403, input/output devices 404 to 406 and an interface 407 which are interconnected via BUS (bus line).

To the BUS, the following memories are connected: a memory M401 for storing a current command rotational speed; a memory M402 for storing the virtual current rotational phase of the downstream-side printing unit group; a memory M403 for storing the virtual current rotational phase of the first transfer cylinder of the downstream-side printing unit group; a memory M404 for storing the count value of a counter for detecting the current rotational phase of the downstream-side printing unit group; a memory M405 for storing the current rotational phase of the downstream-side printing unit group; a memory M406 for storing a difference in the current rotational phase of the downstream-side printing unit group; a memory M407 for storing the absolute value of the difference in the current rotational phase of the downstream-side printing unit group; a memory M408 for storing the allowable value of the difference in the current rotational phase of the downstream-side printing unit group; a memory M409 for storing a table of conversion from the difference in the current rotational phase of the downstream-side printing unit group to the correction value of the command rotational speed; a memory M410 for storing the first correction value of the command rotational speed; and a memory M411 for storing the count value of a counter for detecting the current rotational phase of the first transfer cylinder of the downstream-side printing unit group.

To the BUS, the following memories are also connected: a memory M412 for storing the current rotational phase of the first transfer cylinder of the downstream-side printing unit group; a memory M413 for storing a difference in the current rotational phase of the first transfer cylinder of the downstream-side printing unit group; a memory M414 for storing the absolute value of the difference in the current rotational phase of the first transfer cylinder of the downstream-side printing unit group; a memory M415 for storing the allowable value of the difference in the current rotational phase of the first transfer cylinder of the downstream-side printing unit group; a memory M416 for storing a table of conversion from the difference in the current rotational phase of the first transfer cylinder of the downstream-side printing unit group to the correction table of the command rotational speed; a memory M417 for storing the second correction value of the command rotational speed; a memory M418 for storing the command rotational speed; and a memory M419 for storing the number of the downstream-side printing unit group.

The downstream-side prime motor 1B is connected to the input/output device 404 via a D/A converter 411 and a downstream-side prime motor driver 412. The downstream-side prime motor driver 412 is connected to a rotary encoder 1BR for the downstream-side prime motor, which is integrally coupled to and incorporated in the shaft of the downstream-side prime motor 1B, for speed control.

A counter (first rotational phase detecting means) 413 for detecting the current rotational phase of the downstream-side printing unit group is connected to the input/output device 405. The rotary encoder 8C for detecting the current rotational phase of the downstream-side printing unit group, which is connected to the aforementioned input/output device 106, is connected to the counter 413 for detecting the current rotational phase of the downstream-side printing unit group, so as to output a clock pulse. Thus, the counter 413 for detecting the current rotational phase of the downstream-side printing unit group has a count value conformed to the current rotational phase of the downstream-side printing unit group 20B.

A counter (quasi-second rotational phase detecting means) 414 for detecting the current rotational phase of the first transfer cylinder of the downstream-side printing unit group is connected to the input/output device 406. The rotary encoder 8D for detecting the current rotational phase of the first transfer cylinder of the downstream-side printing unit group is connected to the counter 414 for detecting the current rotational phase of the first transfer cylinder of the downstream-side printing unit group, so as to output a clock pulse. Thus, the counter 414 for detecting the current rotational phase of the first transfer cylinder of the downstream-side printing unit group has a count value conformed to the current rotational phase of the first transfer cylinder 24 of the downstream-side printing unit group 20B.

The counter 413 for detecting the current rotational phase of the downstream-side printing unit group and the counter 414 for detecting the current rotational phase of the first transfer cylinder of the downstream-side printing unit group are connected to the home position detector 6 provided for the last impression cylinder 23 of the upstream-side printing unit group 20A.

The interface 407 is connected to the virtual master generator 200.

The actions of the central controller 100, the virtual master generator 200, the upstream-side printing unit group drive controller 300, and the downstream-side printing unit group drive controller 400, which have been described above, will be described below.

The central controller 100 operates in accordance with action or operational flows shown in FIGS. 5A to 5E.

In Step P1, it is determined whether a set rotational speed has been inputted to the rotational speed setting unit. If the set rotational speed has been inputted (the answer is yes (Y)), in Step P2, the set rotational speed is loaded from the rotational speed setting unit 116, and stored into the memory M101. If the set rotational speed has not been inputted (the answer is no (N)) in Step P1, the program returns to Step P1.

Subsequently to Step P2, it is determined in Step P3 whether a printing press drive switch 111 has been turned on (ON). If ON (the answer is Y), in Step P4, a home position alignment start command is transmitted to the virtual master generator 200. Then, in Step P5, a slower rotational speed is loaded from the memory M102 for storing the slower rotational speed. Then, in Step P6, the slower rotational speed is written into the memory M103 for storing the command rotational speed. If the printing press drive switch 111 has not been turned on (the answer is N) in Step P3, the program returns to Step P3.

After Step P6, counting of the internal clock counter (for counting the elapsed time) is started in Step P7. Then, in Step P8, the time interval at which the command rotational speed is transmitted to the virtual master generator 200 is loaded from the memory M104. Then, in Step P9, the count value of the internal clock counter 108 is loaded.

Then, in Step P10, it is determined whether the count value of the internal clock counter 108 is equal to the time interval at which the command rotational speed is transmitted to the virtual master generator 200. If this equation holds (Y), the command rotational speed (slower rotational speed) is loaded from the memory M103 in Step P11. Then, in Step P12, the command rotational speed (slower rotational speed) is transmitted to the virtual master generator 200. Then, the program returns to Step P7.

If the above equation does not hold (the answer is N) in Step P10, it is determined in Step P13 whether a home position alignment completion signal has been transmitted from the virtual master generator 200. If the home position alignment completion signal has been transmitted (Y), the time interval at which the command rotational speed is transmitted to the virtual master generator 200 is loaded from the memory M104 in Step P14. If the home position alignment completion signal has not been transmitted (N) in Step P13, the program returns to Step P8.

After Step P14, the count value of the internal clock counter 108 is loaded in Step P15. Then, in Step P16, it is determined whether the count value of the internal clock counter 108 is equal to the time interval at which the command rotational speed is transmitted to the virtual master generator 200. If this equation holds (Y), the command rotational speed (slower rotational speed) is loaded from the memory M103 in Step P17. If this equation does not hold (N), the program returns to Step P14.

After Step P17, the command rotational speed (slower rotational speed) is transmitted to the virtual master generator 200 in Step P18. Then, in Step P19, counting of the internal clock counter (for counting the elapsed time) 108 is started. Then, in Step P20, the time interval at which the command rotational speed is transmitted to the virtual master generator 200 is loaded from the memory M104. Then, in Step P21, the count value of the internal clock counter 108 is loaded.

Then, in Step P22, it is determined whether the count value of the internal clock counter 108 is equal to the time interval at which the command rotational speed is transmitted to the virtual master generator 200. If this equation holds (Y), the set rotational speed is loaded from the memory M101 in Step P23. Then, in Step P24, the memory M103 for storing the command rotational speed is overwritten with the set rotational speed. Then, in Step P25, the command rotational speed is loaded from the memory M103. Then, in Step P26, the command rotational speed is transmitted to the virtual master generator 200, and the program returns to Step P19.

If the above equation does not hold (N) in Step P22, the program shifts to Step P27 to determine whether the printing press drive stop switch 112 has become ON or not. If ON (Y), the time interval at which the command rotational speed is transmitted to the virtual master generator 200 is loaded from the memory M104 in Step P28. Then, in Step P29, the count value of the internal clock counter 108 is loaded. If the printing press drive stop switch 112 has not become ON (N) in Step P27, the program returns to Step P20.

Subsequently to Step P29, it is determined in Step P30 whether the count value of the internal clock counter 108 is equal to the time interval at which the command rotational speed is transmitted to the virtual master generator 200. If this equation holds (Y), the set rotational speed is loaded from the memory M101 in Step P31. If this equation does not hold (N), the program returns to Step P28.

Subsequently to Step P31, the memory M103 for storing the command rotational speed is overwritten with the set rotational speed in Step P32. Then, in Step P33, the command rotational speed is loaded from the memory M103. Then, in Step P34, the command rotational speed is transmitted to the virtual master generator 200.

Then, in Step P35, the memory M103 for storing the command rotational speed is overwritten with zero. Then, in Step P36, counting of the internal clock counter (for counting the elapsed time) 108 is started. In Step P37, the time interval at which the command rotational speed is transmitted to the virtual master generator 200 is loaded from the memory M104. Then, in Step P38, the count value of the internal clock counter 108 is loaded.

Then, in Step P39, it is determined whether the count value of the internal clock counter 108 is equal to the time interval at which the command rotational speed is transmitted to the virtual master generator 200. If this equation holds (Y), the command rotational speed (zero) is loaded from the memory M103 in Step P40. If this equation does not hold (N), the program returns to Step P37.

Subsequently to Step P40, Step P41 is executed to transmit the command rotational speed (zero) to the virtual master generator 200. Then, in Step P42, outputs of the F/V converters 118, 120 connected to the rotary encoder 8A for detecting the current rotational phase of the upstream-side printing unit group and the rotary encoder 8C for detecting the current rotational phase of the downstream-side printing unit group are loaded via the A/D converters 117, 119, and stored into the memory M105. The, in Step P43, the current rotational speed of the upstream-side printing unit group 20A and the current rotational speed of the downstream-side printing unit group 20B are computed based on the outputs of the F/V converters 118, 120 connected to the rotary encoder 8A for detecting the current rotational phase of the upstream-side printing unit group and the rotary encoder 8C for detecting the current rotational phase of the downstream-side printing unit group, and are stored into the memory M106.

Then, in Step P44, it is determined whether the current rotational speed of the upstream-side printing unit group 20A and the current rotational speed of the downstream-side printing unit group 20B are equal to zero. If this equation holds (Y), Step P45 is executed to transmit the drive stop command to the virtual master generator 200, thereby completing control by the central controller 100. If this equation does not hold (N), the program returns to Step P36.

In accordance with the above-described operational or action flows, the central controller 100 transmits the home position alignment start command and the drive stop command to the virtual master generator 200, and also transmits the command rotational speed to the upstream-side prime motor 1A and the downstream-side prime motor 1B.

The virtual master generator 200 operates in accordance with action or operational flows shown in FIGS. 6A to 6F and FIGS. 7A to 7E.

In Step P1, it is determined whether a home position alignment start command has been transmitted from the central controller 100. If the home position alignment start command has been transmitted (Y), in Step P2, the home position alignment start command is transmitted to the upstream-side printing unit group drive controller 300 and the downstream-side printing unit group drive controller 400. If the home position alignment start command has not been transmitted (N), the program returns to Step P1.

Subsequently to Step P2, Step P3 is executed to write the zero position into the memory M201 for storing the virtual current rotational phase.

Then, in Step P4, it is determined whether a command rotational speed (slower rotational speed) has been transmitted from the central controller 100. If the command rotational speed (slower rotational speed) has been transmitted (Y), the command rotational speed (slower rotational speed) is received from the central controller 100 in Step P5, and stored into the memory M202 for storing the current command rotational speed and the memory M203 for storing the previous command rotational speed in the same step. If the command rotational speed (slower rotational speed) has not been transmitted (N), on the other hand, the program returns to Step P4.

Subsequently to Step P5, the virtual current rotational phase is loaded from the memory M201 in Step P6. Then, in Step P7, the correction value of the current rotational phase of the upstream-side printing unit group 20A is loaded from the memory M204. Then, in Step P8, the correction value of the current rotational phase of the upstream-side printing unit group 20A is added to the virtual current rotational phase to compute the virtual current rotational phase of the upstream-side printing unit group 20A, and the result of computation is stored into the memory M205.

Then, in Step P9, the virtual current rotational phase is loaded from the memory M205. Then, in Step P10, the correction value of the current rotational phase of the last impression cylinder 23 of the upstream-side printing unit group 20A is loaded from the memory M206. Then, in Step P11, the correction value of the current rotational phase of the last impression cylinder 23 of the upstream-side printing unit group 20A is added to the virtual current rotational phase to compute the virtual current rotational phase of the last impression cylinder 23 of the upstream-side printing unit group 20A, and the result of computation is stored into the memory M207.

Then, in Step P12, the current command rotation speed is loaded from the memory M202. Then follows Step P13 in which the virtual current rotational phase of the upstream-side printing unit group 20A is loaded from the memory M205. Then, in Step P14, the current command rotational speed (slower rotational speed), the virtual current rotational phase of the upstream-side printing unit group 20A, and the virtual current rotational phase of the last impression cylinder 23 of the upstream-side printing unit group 20A are transmitted to the upstream-side printing unit group drive controller 300.

Then, in Step P15, the virtual current rotational phase is loaded from the memory M201. Then, in Step P16, the correction value of the current rotational phase of the downstream-side printing unit group 20B is loaded from the memory M208. Then, in Step P17, the correction value of the current rotational phase of the downstream-side printing unit group 20B is added to the virtual current rotational phase to compute the virtual current rotational phase of the downstream-side printing unit group 20B, and the result of computation is stored into the memory M209.

Then, in Step P18, the virtual current rotational phase is loaded from the memory M201. Then, in Step P19, the correction value of the current rotational phase of the first transfer cylinder 24 of the downstream-side printing unit group 20B is loaded from the memory M210. Then, in Step P20, the correction value of the current rotational phase of the first transfer cylinder 24 of the downstream-side printing unit group 20B is added to the virtual current rotational phase to compute the virtual current rotational phase of the first transfer cylinder 24 of the downstream-side printing unit group 20B, and the result of computation is stored into the memory M211.

Then, in Step P21, the current command rotation speed is loaded from the memory M202. Then follows Step P22 in which the virtual current rotational phase of the downstream-side printing unit group 20B is loaded from the memory M211. Then, in Step P23, the current command rotational speed (slower rotational speed), the virtual current rotational phase of the downstream-side printing unit group 20B, and the virtual current rotational phase of the first transfer cylinder 24 of the downstream-side printing unit group 20B are transmitted to the downstream-side printing unit group drive controller 400.

Then, in Step P24, it is determined whether the command rotational speed (slower rotational speed) has been transmitted from the central controller 100. If the command rotational speed has been transmitted (Y), Step P25 is executed to receive the command rotational speed (slower rotational speed) from the central controller 100, and store it into the memory M202 for storing the current command rotational speed. If the command rotational speed has not been transmitted (N) in Step P24, the program shifts to Step P62 to be described later.

Subsequently to Step P25, Step P26 follows to load the previous command rotational speed (slower rotational speed) from the memory M203. Then, in Step P27, the time interval at which the command rotational speed is transmitted from the central controller 100 to the virtual master generator 200 is loaded from the memory M212. Then, in Step P28, the previous command rotational speed (slower rotational speed) is multiplied by the time interval at which the command rotational speed is transmitted from the central controller 100 to the virtual master generator 200 to compute the modification value of the virtual current rotational phase, and the result of computation is stored into the memory M213.

Then, in Step P29, the virtual current rotational phase is loaded from the memory M201. Then, in Step P30, the modification value of the virtual current rotational phase is added to the virtual current rotational phase to compute the modified virtual current rotational phase, and the result of computation is stored into the memory M214.

Then, in Step P31, it is determined whether the modified virtual current rotational phase is equal to or greater than 360°. If this equality or inequality expression holds (Y), Step P32 is executed to subtract 360° from the modified virtual current rotational phase, and overwrite the memory M214 for storing the modified virtual current rotational phase with the result of subtraction. Then, in Step P33, the correction value of the current rotational phase of the upstream-side printing unit group 20A is loaded from the memory M204. If the above equality or inequality expression does not hold (N), the program shifts to Step P33.

Then, in Step P34, the correction value of the current rotational phase of the upstream-side printing unit group 20A is added to the modified virtual current rotational phase to compute the virtual current rotational phase of the upstream-side printing unit group 20A, and the result of computation is stored into the memory M205.

Then, in Step P35, it is determined whether the virtual current rotational phase of the upstream-side printing unit group 20A is equal to or greater than 360°. If this equality or inequality expression holds (Y), in Step P36, 360° is subtracted from the virtual current rotational phase of the upstream-side printing unit group 20A, and the memory M205 for storing the virtual current rotational phase of the upstream-side printing unit group is overwritten with the result of subtraction. Then, in Step P37,the modified virtual current rotational phase is loaded from the memory M214. If the above equality or inequality expression does not hold (N), the program shifts to Step P37.

Then, in Step P38, the correction value of the current rotational phase of the last impression cylinder 23 of the upstream-side printing unit group 20A is loaded from the memory M206. Then, in Step P39, the correction value of the current rotational phase of the last impression cylinder 23 of the upstream-side printing unit group 20A is added to the modified virtual current rotational phase to compute the virtual current rotational phase of the last impression cylinder 23 of the upstream-side printing unit group 20A, and the result of computation is stored into the memory M207.

Then, in Step P40, it is determined whether the virtual current rotational phase of the last impression cylinder 23 of the upstream-side printing unit group 20A is equal to or greater than 360°. If this equality or inequality expression holds (Y), in Step P41, 360° is subtracted from the virtual current rotational phase of the last impression cylinder 23 of the upstream-side printing unit group 20A, and the memory M207 for storing the virtual current rotational phase of the last impression cylinder of the upstream-side printing unit group is overwritten with the result of subtraction. Then, in Step P42, the current command rotational speed (slower rotational speed) is loaded from the memory M202. If the above equality or inequality expression does not hold (N), the program shifts to Step P42.

Then, in Step P43, the virtual current rotational phase of the upstream-side printing unit group 20A is loaded from the memory M205. Then, in Step P44, the current command rotational speed (slower rotational speed), the virtual current rotational phase of the upstream-side printing unit group 20A, and the virtual current rotational phase of the last impression cylinder 23 of the upstream-side printing unit group 20A are transmitted to the upstream-side printing unit group drive controller 300.

Then, in Step P45, the modified virtual current rotational phase is loaded from the memory M214. Then, in Step P46, the correction value of the current rotational phase of the downstream-side printing unit group 20B is loaded from the memory M208. Then, in Step P47, the correction value of the current rotational phase of the downstream-side printing unit group 20B is added to the modified virtual current rotational phase to compute the virtual current rotational phase of the downstream-side printing unit group 20B, and the result of computation is stored into the memory M209.

Then, in Step P48, it is determined whether the virtual current rotational phase of the downstream-side printing unit group 20B is equal to or greater than 360°. If this equality or inequality expression holds (Y), in Step P49, 360° is subtracted from the virtual current rotational phase of the downstream-side printing unit group 20B, and the memory M209 for storing the virtual current rotational phase of the downstream-side printing unit group is overwritten with the result of subtraction. Then, in Step P50, the modified virtual current rotational phase is loaded from the memory M214. If the above equality or inequality expression does not hold (N), the program shifts to Step P50.

Then, in Step P51, the correction value of the current rotational phase of the first transfer cylinder 24 of the downstream-side printing unit group 20B is loaded from the memory M210. Then, in Step P52, the correction value of the current rotational phase of the first transfer cylinder 24 of the downstream-side printing unit group 20B is added to the modified virtual current rotational phase to compute the virtual current rotational phase of the first transfer cylinder 24 of the downstream-side printing unit group 20B, and the result of computation is stored into the memory M211.

Then, in Step P53, it is determined whether the virtual current rotational phase of the first transfer cylinder of the downstream-side printing unit group is equal to or greater than 360°. If this equality or inequality expression holds (Y), in Step P54, 360° is subtracted from the virtual current rotational phase of the first transfer cylinder 24 of the downstream-side printing unit group 20B, and the memory M211 for storing the virtual current rotational phase of the first transfer cylinder of the downstream-side printing unit group is overwritten with the result of subtraction. Then, in Step P55, the current command rotational speed (slower rotational speed) is loaded from the memory M202. If the above equality or inequality expression does not hold (N), the program shifts to Step P55.

Then, in Step P56, the virtual current rotational phase of the downstream-side printing unit group 20B is loaded from the memory M209. Then, in Step P57, the current command rotational speed (slower rotational speed), the virtual current rotational phase of the downstream-side printing unit group 20B, and the virtual current rotational phase of the first transfer cylinder 24 of the downstream-side printing unit group 20B are transmitted to the downstream-side printing unit group drive controller 400. Then, in Step P58, the modified virtual current rotational phase is loaded from the memory M214.

Then, in Step P59, the memory M201 for storing the virtual current rotational phase is overwritten with the modified virtual current rotational phase. Then follows Step P60 in which the current command rotational speed (slower rotational speed) is loaded from the memory M202. Then, in Step P61, the memory M203 for storing the previous command rotational speed is overwritten with the current command rotational speed (slower rotational speed), and the program returns to Step P24.

If the program shifts from Step P24 to Step P62, it is determined in Step P62 whether a home position alignment completion signal and the number of the printing unit group have been transmitted from the upstream-side printing unit group drive controller 300 or the downstream-side printing unit group drive controller 400. If they have been transmitted (Y), in Step P63, the number of the printing unit group which has completed home position alignment is received from the upstream-side printing unit group drive controller 300 or the downstream-side printing unit group drive controller 400, and it is stored into the memory M215. If the home position alignment completion signal and the number of the printing unit group have not been transmitted (N), the program returns to Step P24.

Subsequently to Step P63, Step P64 is executed to load the contents of the memory M215 for storing the number of the printing unit group which has completed home position alignment. Then, in Step P65, it is determined, from the contents of the memory M215 for storing the number of the printing unit group which has completed home position alignment, whether the home position alignment of the upstream-side printing unit group 20A and the downstream-side printing unit group 20B has been completed. If the home position alignment has been completed (Y), the home position alignment completion signal is transmitted to the central controller 100 in Step P66, and the program shifts to Step P67. If the home position alignment has not been completed (N), the program returns to Step P24.

In Step P67, it is determined whether the command rotational speed has been transmitted from the central controller 100. If the command rotational speed has been transmitted (Y), Step P68 is executed to receive the command rotational speed from the central controller 100, and store it into the memory M202 for storing the current command rotational speed. If the command rotational speed has not been transmitted (N), the program shifts to Step P107 to be described later.

Subsequently to Step P68, the previous command rotational speed is loaded from the memory M203 in Step P69. Then, in Step P70, it is determined whether the current command rotational speed is equal to the previous command rotational speed. If this equation holds (Y), the time interval at which the command rotational speed is transmitted from the central controller 100 to the virtual master generator 200 is loaded from the memory M212 in Step P71. If the above equation does not hold (N), the program shifts to Step P109 to be described later.

Subsequently to Step P71, Step P72 follows to load the previous command rotational speed from the memory M203. Then, in Step P73, the previous command rotational speed is multiplied by the time interval at which the command rotational speed is transmitted from the central controller 100 to the virtual master generator 200 to compute the modification value of the virtual current rotational phase, and the result of computation is stored into the memory M213.

Then, in Step P74, the virtual current rotational phase is loaded from the memory M201. Then, in Step P75, the modification value of the virtual current rotational phase is added to the virtual current rotational phase to compute the modified virtual current rotational phase, and the result of computation is stored into the memory M214.

Then, in Step P76, it is determined whether the modified virtual current rotational phase is equal to or greater than 360°. If this equality or inequality expression holds (Y), Step P77 is executed to subtract 360° from the modified virtual current rotational phase, and overwrite the memory M214 for storing the modified virtual current rotational phase with the result of subtraction. Then, in Step P78, the correction value of the current rotational phase of the upstream-side printing unit group 20A is loaded from the memory M204. If the above equality or inequality expression does not hold (N), the program shifts to Step P78.

Then, in Step P79, the correction value of the current rotational phase of the upstream-side printing unit group 20A is added to the modified virtual current rotational phase to compute the virtual current rotational phase of the upstream-side printing unit group 20A, and the result of computation is stored into the memory M205.

Then, in Step P80, it is determined whether the virtual current rotational phase of the upstream-side printing unit group 20A is equal to or greater than 360°. If this equality or inequality expression holds (Y), in Step P81, 360° is subtracted from the virtual current rotational phase of the upstream-side printing unit group 20A, and the memory M205 for storing the virtual current rotational phase of the upstream-side printing unit group is overwritten with the result of subtraction. Then, in Step P82, the modified virtual current rotational phase is loaded from the memory M214. If the above equality or inequality expression does not hold (N), the program shifts to Step P82.

Then, in Step P83, the correction value of the current rotational phase of the last impression cylinder 23 of the upstream-side printing unit group 20A is loaded from the memory M206. Then, in Step P84, the correction value of the current rotational phase of the last impression cylinder 23 of the upstream-side printing unit group 20A is added to the modified virtual current rotational phase to compute the virtual current rotational phase of the last impression cylinder 23 of the upstream-side printing unit group 20A, and the result of computation is stored into the memory M207.

Then, in Step P85, it is determined whether the virtual current rotational phase of the last impression cylinder 23 of the upstream-side printing unit group 20A is equal to or greater than 360°. If this equality or inequality expression holds (Y), in Step P86, 360° is subtracted from the virtual current rotational phase of the last impression cylinder 23 of the upstream-side printing unit group 20A, and the memory M207 for storing the virtual current rotational phase of the last impression cylinder of the upstream-side printing unit group is overwritten with the result of subtraction. Then, in Step P87, the current command rotational speed is loaded from the memory M202 If the above equality or inequality expression does not hold (N), the program shifts to Step P87.

Then, in Step P88, the virtual current rotational phase of the upstream-side printing unit group 20A is loaded from the memory M205. Then, in Step P89, the current command rotational speed, the virtual current rotational phase of the upstream-side printing unit group 20A, and the virtual current rotational phase of the last impression cylinder 23 of the upstream-side printing unit group 20A are transmitted to the upstream-side printing unit group drive controller 300. Then, in Step P90, the modified virtual current rotational phase is loaded from the memory M214.

Then, in Step P91, the correction value of the current rotational phase of the downstream-side printing unit group 20B is loaded from the memory M208. Then, in Step P92, the correction value of the current rotational phase of the downstream-side printing unit group 20B is added to the modified virtual current rotational phase to compute the virtual current rotational phase of the downstream-side printing unit group 20B, and the result of computation is stored into the memory M209.

Then, in Step P93, it is determined whether the virtual current rotational phase of the downstream-side printing unit group is equal to or greater than 360°. If this equality or inequality expression holds (Y), in Step P94, 360° is subtracted from the virtual current rotational phase of the downstream-side printing unit group 20B, and the memory M209 for storing the virtual current rotational phase of the downstream-side printing unit group is overwritten with the result of subtraction. Then, in Step P95, the modified virtual current rotational phase is loaded from the memory M214. If the above equality or inequality expression does not hold (N), the program shifts to Step P95.

Then, in Step P96, the correction value of the current rotational phase of the first transfer cylinder 24 of the downstream-side printing unit group 20B is loaded from the memory M210. Then, in Step P97, the correction value of the current rotational phase of the first transfer cylinder 24 of the downstream-side printing unit group 20B is added to the modified virtual current rotational phase to compute the virtual current rotational phase of the first transfer cylinder 24 of the downstream-side printing unit group 20B, and the result of computation is stored into the memory M211.

Then, in Step P98, it is determined whether the virtual current rotational phase of the first transfer cylinder of the downstream-side printing unit group is equal to or greater than 360°. If this equality or inequality expression holds (Y), in Step P99, 360° is subtracted from the virtual current rotational phase of the first transfer cylinder 24 of the downstream-side printing unit group 20B, and the memory M211 for storing the virtual current rotational phase of the first transfer cylinder of the downstream-side printing unit group is overwritten with the result of subtraction. Then, in Step P100, the current command rotational speed is loaded from the memory M202. If the above equality or inequality expression does not hold (N), the program shifts to Step P100.

Then, in Step P101, the virtual current rotational phase of the downstream-side printing unit group 20B is loaded from the memory M209. Then, in Step P102, the current command rotational speed, the virtual current rotational phase of the downstream-side printing unit group 20B, and the virtual current rotational phase of the first transfer cylinder 24 of the downstream-side printing unit group 20B are transmitted to the downstream-side printing unit group drive controller 400.

Then, in Step P103, the modified virtual current rotational phase is loaded from the memory M214. Then, in Step P104, the memory M201 for storing the virtual current rotational phase is overwritten with the modified virtual current rotational phase.

Then follows Step P105 in which the current command rotational speed is loaded from the memory M202. Then, in Step P106, the memory M203 for storing the previous command rotational speed is overwritten with the current command rotational speed, and the program returns to Step P67.

If the program shifts from Step P67 to Step P107, it is determined in Step P107 whether a drive stop command has been transmitted from the central controller 100. If the drive stop command has been transmitted (Y), in Step P108, the drive stop command is transmitted to the upstream-side printing unit group drive controller 300 and the downstream-side printing unit group drive controller 400 to terminate control by the virtual master generator 200. If the drive stop command has not been transmitted (N), the program returns to Step P67.

If the program shifts from Step P70 to Step P109, it is determined in Step P109 whether the current command rotational speed is higher than the previous command rotational speed. If this inequality expression holds (Y), a rotational speed modification value during speed acceleration is loaded from the memory M216 in Step P110. If this inequality expression does not hold (N), the program shifts to Step P115 to be described later.

Subsequently to Step P110, Step P111 is executed to add the rotational speed modification value during speed acceleration to the previous command rotational speed, thereby computing a modified current command rotational speed, and store the result of computation into the memory M217. Then, in Step P112, the current command rotational speed is loaded from the memory M202.

Then, in Step P113, it is determined whether the current command rotational speed is higher than the modified current command rotational speed. If this inequality expression holds (Y), in Step P114, the memory M202 for storing the current command rotational speed is overwritten with the modified current command rotational speed. Then, the program returns to Step P71. If the above inequality expression does not hold (N), the program returns to Step P71.

If the program shifts from Step P109 to Step P115, a rotational speed modification value during speed reduction is loaded from the memory M218 in Step P115. Then, in Step P116, the rotational speed modification value during speed reduction is subtracted from the previous command rotational speed to compute a modified current command rotational speed.

Then, in Step P117, it is determined whether the modified current command rotational speed is less than 0. If this inequality expression holds (Y), the memory M217 for storing the modified current command rotational speed is overwritten with zero in Step P118. Then, in Step P119, the modified current command rotational speed is loaded from the memory M217, and the program shifts to Step P114. If the above inequality expression does not hold (N), the program shifts to Step P114.

In accordance with the above-described operational or action flows, the virtual master generator 200 transmits the home position alignment start command and the drive stop command to the upstream-side printing unit group drive controller 300 and the downstream-side printing unit group drive controller 400, and also transmits the command rotational speeds conformed to the command rotational speed inputted from the central controller 100, as well as the respective virtual rotational phases which should be present, at constant time intervals.

The upstream-side printing unit group drive controller 300 operates in accordance with action or operational flows shown in FIGS. 8A to 8E and FIGS. 9A to 9E.

In Step P1, it is determined whether a home position alignment start command has been transmitted from the virtual master generator 200. If the home position alignment start command has been transmitted (Y), the program shifts to Step P2 to be described later. If the home position alignment start command has not been transmitted (N) in Step P1, the program returns to Step P1.

In Step P2, it is determined whether the current command rotational speed (slower rotational speed), the virtual current rotational phase of the upstream-side printing unit group 20A, and the virtual current rotational phase of the last impression cylinder 23 of the upstream-side printing unit group 20A have been transmitted from the virtual master generator 200. If they have been transmitted (Y), the program shifts to Step P3 to be described later. If they have not been transmitted (N), the program returns to Step P2.

In step P3, the current command rotational speed (slower rotational speed), the virtual current rotational phase of the upstream-side printing unit group 20A, and the virtual current rotational phase of the last impression cylinder 23 of the upstream-side printing unit group 20A are received from the virtual master generator 200, and they are respectively stored into the memory M301 for storing the current command rotational speed, the memory M302 for storing the virtual current rotational phase of the upstream-side printing unit group, and the memory M303 for storing the virtual current rotational phase of the last impression cylinder of the upstream-side printing unit group.

Then, in Step P4, the count value is loaded from the counter 313 for detecting the current rotational phase of the upstream-side printing unit group, and stored into the memory M304. Then, in Step P5, the current rotational phase of the upstream-side printing unit group 20A is computed from the count value of the counter 313 for detecting the current rotational phase of the upstream-side printing unit group, and the result of computation is stored into the memory M305. Then, in Step P6, the virtual current rotational phase of the upstream-side printing unit group 20A is loaded from the memory M302.

Then, in Step P7, it is determined whether the virtual current rotational phase of the upstream-side printing unit group 20A is greater than 350°. If this inequality expression holds (Y), the current rotational phase of the upstream-side printing unit group 20A is loaded from the memory M305 in Step P8.

If the above inequality expression does not hold (N), the program shifts to Step P11 to be described later.

Subsequently to Step P8, it is determined in Step P9 whether the current rotational phase of the upstream-side printing unit group 20A is less than 10°. If this inequality expression holds (Y), in Step P10, 360° is added to the current rotational phase of the upstream-side printing unit group 20A, and the memory M305 for storing the current rotational phase of the upstream-side printing unit group is overwritten with the result of addition. Then, in Step P11, the virtual current rotational phase of the upstream-side printing unit group 20A is loaded from the memory M302. If the above inequality expression does not hold (N), the program shifts to Step P11.

Then, in Step P12, it is determined whether the virtual current rotational phase of the upstream-side printing unit group 20A is less than 10°. If this inequality expression holds (Y), the current rotational phase of the upstream-side printing unit group 20A is loaded from the memory M305 in Step P13. If the above inequality expression does not hold (N), the program shifts to Step P16 to be described later.

Subsequently to Step P13, it is determined in Step P14 whether the current rotational phase of the upstream-side printing unit group 20A is greater than 350°. If this inequality expression holds (Y), in Step P15, 360° is added to the virtual current rotational phase of the upstream-side printing unit group 20A, and the memory M302 for storing the virtual current rotational phase of the upstream-side printing unit group is overwritten with the result of addition. Then, in Step P16, the virtual current rotational phase of the upstream-side printing unit group 20A is loaded from the memory M302. If the above inequality expression does not hold (N), the program shifts to Step P16.

Then, in Step P17, the current rotational phase of the upstream-side printing unit group 20A is subtracted from the virtual current rotational phase of the upstream-side printing unit group 20A to compute the difference in the current rotational phase of the upstream-side printing unit group 20A, and the result of computation is stored into the memory M306. Then, in Step P18, the absolute value of the difference in the current rotational phase of the upstream-side printing unit group 20A is computed from the difference in the current rotational phase of the upstream-side printing unit group 20A, and the result of computation is stored into the memory M307. Then, in Step P19, the allowable value of the difference in the current rotational phase of the upstream-side printing unit group 20A is loaded from the memory M308.

Then, in Step P20, it is determined whether the absolute value of the difference in the current rotational phase of the upstream-side printing unit group 20A is equal to or less than the allowable value of the difference in the current rotational phase of the upstream-side printing unit group 20A. If this equality or inequality expression holds (Y), in Step P21, the memory M310 for storing the first correction value of the command rotational speed is overwritten with zero. Then, in Step P22, the count value is loaded from the counter 314 for detecting the current rotational phase of the last impression cylinder of the upstream-side printing unit group, and is stored into the memory M311.

If the above equality or inequality expression does not hold (N) in Step P20, on the other hand, the program shifts to Step P94 in which the table of conversion from the difference in the current rotational phase of the upstream-side printing unit group 20A to the correction value of the command rotational speed is loaded from the memory M309. Then, in Step P95, the difference in the current rotational phase of the upstream-side printing unit group is loaded from the memory M306. Then, in Step P96, the first correction value of the command rotational speed is obtained from the difference in the current rotational phase of the upstream-side printing unit group 20A with the use of the table of conversion from the difference in the current rotational phase of the upstream-side printing unit group 20A to the correction value of the command rotational speed, and the memory M310 is overwritten with the obtained correction value. Then, the program shifts to Step P22.

Then, in Step P23, the current rotational phase of the last impression cylinder 23 of the upstream-side printing unit group 20A is computed from the count value of the counter 314 for detecting the current rotational phase of the last impression cylinder of the upstream-side printing unit group, and the result of computation is stored into the memory M312. Then, in Step P24, the virtual current rotational phase of the last impression cylinder 23 of the upstream-side printing unit group 20A is loaded from the memory M303.

Then, in Step P25, it is determined whether the virtual current rotational phase of the last impression cylinder 23 of the upstream-side printing unit group 20A is greater than 350°. If this inequality expression holds (Y), the current rotational phase of the last impression cylinder 23 of the upstream-side printing unit group 20A is loaded from the memory M312 in Step P26. If the above inequality expression does not hold (N), the program shifts to Step P29 to be described later.

Subsequently to Step P26, it is determined in Step P27 whether the current rotational phase of the last impression cylinder 23 of the upstream-side printing unit group 20A is less than 10°. If this inequality expression holds (Y), in Step P28, 360° is added to the current rotational phase of the last impression cylinder 23 of the upstream-side printing unit group 20A, and the memory M312 for storing the current rotational phase of the last impression cylinder of the upstream-side printing unit group is overwritten with the result of addition. Then, in Step P29, the virtual current rotational phase of the last impression cylinder 23 of the upstream-side printing unit group 20A is loaded from the memory M303. If the above inequality expression does not hold (N), the program shifts to Step P29.

Then, in Step P30, it is determined whether the virtual current rotational phase of the last impression cylinder 23 of the upstream-side printing unit group 20A is less than 10°. If this inequality expression holds (Y), the current rotational phase of the last impression cylinder 23 of the upstream-side printing unit group 20A is loaded from the memory M312 in Step P31. If the above inequality expression does not hold (N), the program shifts to Step P34 to be described later.

Subsequently to Step P31, it is determined in Step P32 whether the current rotational phase of the last impression cylinder 23 of the upstream-side printing unit group 20A is greater than 350°. If this inequality expression holds (Y), in Step P33, 360° is added to the virtual current rotational phase of the last impression cylinder 23 of the upstream-side printing unit group 20A, and the memory M303 for storing the virtual current rotational phase of the last impression cylinder of the upstream-side printing unit group is overwritten with the result of addition. Then, in Step P34, the virtual current rotational phase of the last impression cylinder 23 of the upstream-side printing unit group 20A is loaded from the memory M303. If the above inequality expression does not hold (N), the program shifts to Step P34.

Then, in Step P35, the current rotational phase of the last impression cylinder 23 of the upstream-side printing unit group 20A is subtracted from the virtual current rotational phase of the last impression cylinder 23 of the upstream-side printing unit group 20A to compute the difference in the current rotational phase of the last impression cylinder 23 of the upstream-side printing unit group 20A, and the result of computation is stored into the memory M313. Then, in Step P36, the absolute value of the difference in the current rotational phase of the last impression cylinder 23 of the upstream-side printing unit group 20A is computed from the difference in the current rotational phase of the last impression cylinder 23 of the upstream-side printing unit group 20A, and the result of computation is stored into the memory M314. Then, in Step P37, the allowable value of the difference in the current rotational phase of the last impression cylinder 23 of the upstream-side printing unit group 20A is loaded from the memory M315.

Then, in Step P38, it is determined whether the absolute value of the difference in the current rotational phase of the last impression cylinder 23 of the upstream-side printing unit group 20A is equal to or less than the allowable value of the difference in the current rotational phase of the last impression cylinder 23 of the upstream-side printing unit group 20A. If this equality or inequality expression holds (Y) in Step P39, the memory M317 for storing the second correction value of the command rotational speed is overwritten with zero. Then, in Step P40, the current command rotational speed (slower rotational speed) is loaded from the memory M301.

If the above equality or inequality expression does not hold (N), on the other hand, the program shifts to Step P97 in which the table of conversion from the difference in the current rotational phase of the last impression cylinder 23 of the upstream-side printing unit group 20A to the correction value of the command rotational speed is loaded from the memory M316. Then, in Step P98, the difference in the current rotational phase of the last impression cylinder 23 of the upstream-side printing unit group 20A is loaded from the memory M313. Then, in Step P99, the second correction value of the command rotational speed is obtained from the difference in the current rotational phase of the last impression cylinder 23 of the upstream-side printing unit group 20A with the use of the table of conversion from the difference in the current rotational phase of the last impression cylinder 23 of the upstream-side printing unit group 20A to the correction value of the command rotational speed, and the memory M317 is overwritten with the obtained correction value. Then, the program shifts to Step P40.

Then, in Step P41, the first correction value of the command rotational speed is loaded from the memory M310. Then, in Step P42, the second correction value of the command rotational speed is loaded from the memory M317. Then, in Step P43, the first and second correction values of the command rotational speed are added to the current command rotational speed (slower rotational speed) to compute the command rotational speed, and the result of computation is stored into the memory M318.

Then, in Step P44, the command rotational speed is outputted to the upstream-side prime motor driver 312 via the D/A converter 311. Then, in Step P45, the first correction value of the command rotational speed is loaded from the memory M310.

Then, in Step P46, it is determined whether the first correction value of the command rotational speed is equal to 0. If this equation holds (Y), the second correction value of the command rotational speed is loaded from the memory M317 in Step P47. If the above equation does not hold (N), the program returns to Step P2.

Subsequently to Step P47, it is determined in Step P48 whether the second correction value of the command rotational speed is equal to 0. If this equation holds (Y), the number of the upstream-side printing unit group is loaded from the memory M319 in Step P49. If the above equation does not hold (N), the program returns to Step P2.

Subsequently to Step P49, the home position alignment completion signal and the number of the upstream-side printing unit group are transmitted to the virtual master generator 200 in Step P50. Then, the program shifts to Step P51.

In Step P51, it is determined whether the current command rotational speed, the virtual current rotational phase of the upstream-side printing unit group 20A, and the virtual current rotational phase of the last impression cylinder 23 of the upstream-side printing unit group 20A have been transmitted from the virtual master generator 200. If they have been transmitted (Y), the program shifts to Step P52 to be described later. If they have not been transmitted (N), the program shifts to Step P100 to be described later.

In Step P52, the current command rotational speed, the virtual current rotational phase of the upstream-side printing unit group 20A, and the virtual current rotational phase of the last impression cylinder 23 of the upstream-side printing unit group 20A are received from the virtual master generator 200, and they are respectively stored into the memory M301 for storing the current command rotational speed, the memory M302 for storing the virtual current rotational phase of the upstream-side printing unit group, and the memory M303 for storing the virtual current rotational phase of the last impression cylinder of the upstream-side printing unit group.

Then, in Step P53, the count value is loaded from the counter 313 for detecting the current rotational phase of the upstream-side printing unit group, and stored into the memory M304. Then, in Step P54, the current rotational phase of the upstream-side printing unit group 20A is computed from the count value of the counter 313 for detecting the current rotational phase of the upstream-side printing unit group, and the result of computation is stored into the memory M305. Then, in Step P55, the virtual current rotational phase of the upstream-side printing unit group 20A is loaded from the memory M302.

Then, in Step P56, it is determined whether the virtual current rotational phase of the upstream-side printing unit group 20A is greater than 350°. If this inequality expression holds (Y), the current rotational phase of the upstream-side printing unit group 20A is loaded from the memory M305 in Step P57. If the above inequality expression does not hold (N), the program shifts to Step P60 to be described later.

Subsequently to Step P57, it is determined in Step P58 whether the current rotational phase of the upstream-side printing unit group 20A is less than 10°. If this inequality expression holds (Y), in Step P59, 360° is added to the current rotational phase of the upstream-side printing unit group 20A, and the memory M305 for storing the current rotational phase of the upstream-side printing unit group is overwritten with the result of addition. Then, in Step P60, the virtual current rotational phase of the upstream-side printing unit group 20A is loaded from the memory M302. If the above inequality expression does not hold (N), the program shifts to Step P60.

Then, in Step P61, it is determined whether the virtual current rotational phase of the upstream-side printing unit group 20A is less than 10°. If this inequality expression holds (Y), the current rotational phase of the upstream-side printing unit group 20A is loaded from the memory M305 in Step P62. If the above inequality expression does not hold (N), the program shifts to Step P65 to be described later.

Subsequently to Step P62, it is determined in Step P63 whether the current rotational phase of the upstream-side printing unit group 20A is greater than 350°. If this inequality expression holds (Y), in Step P64, 360° is added to the virtual current rotational phase of the upstream-side printing unit group 20A, and the memory M302 for storing the virtual current rotational phase of the upstream-side printing unit group is overwritten with the result of addition. Then, in Step P65, the virtual current rotational phase of the upstream-side printing unit group 20A is loaded from the memory M302. If the above inequality expression does not hold (N), the program shifts to Step P65.

Then, in Step P66, the current rotational phase of the upstream-side printing unit group 20A is subtracted from the virtual current rotational phase of the upstream-side printing unit group 20A to compute the difference in the current rotational phase of the upstream-side printing unit group 20A, and the result of computation is stored into the memory M306. Then, in Step P67, the absolute value of the difference in the current rotational phase of the upstream-side printing unit group 20A is computed from the difference in the current rotational phase of the upstream-side printing unit group 20A, and the result of computation is stored into the memory M307. Then, in Step P68, the allowable value of the difference in the current rotational phase of the upstream-side printing unit group 20A is loaded from the memory M308.

Then, in Step P69, it is determined whether the absolute value of the difference in the current rotational phase of the upstream-side printing unit group 20A is equal to or less than the allowable value of the difference in the current rotational phase of the upstream-side printing unit group 20A. If this equality or inequality expression holds (Y), in Step P70, the memory M310 for storing the first correction value of the command rotational speed is overwritten with zero. Then, in Step P71, the count value is loaded from the counter 314 for detecting the current rotational phase of the last impression cylinder of the upstream-side printing unit group, and is stored into the memory M311. Then, the program shifts to Step P72.

If the above equality or inequality expression does not hold (N), on the other hand, the program shifts to Step P101 in which the table of conversion from the difference in the current rotational phase of the upstream-side printing unit group 20A to the correction value of the command rotational speed is loaded from the memory M309. Then, in Step P102, the difference in the current rotational phase of the upstream-side printing unit group is loaded from the memory M306. Then, in Step P103, the first correction value of the command rotational speed is obtained from the difference in the current rotational phase of the upstream-side printing unit group 20A with the use of the table of conversion from the difference in the current rotational phase of the upstream-side printing unit group 20A to the correction value of the command rotational speed, and the memory M310 is overwritten with the obtained correction value. Then, the program shifts to Step P71.

Then, in Step P72, the current rotational phase of the last impression cylinder 23 of the upstream-side printing unit group 20A is computed from the count value of the counter 314 for detecting the current rotational phase of the last impression cylinder of the upstream-side printing unit group, and the result of computation is stored into the memory M312. Then, in Step P73, the virtual current rotational phase of the last impression cylinder 23 of the upstream-side printing unit group 20A is loaded from the memory M303.

Then, in Step P74, it is determined whether the virtual current rotational phase of the last impression cylinder 23 of the upstream-side printing unit group 20A is greater than 350°. If this inequality expression holds (Y), the current rotational phase of the last impression cylinder 23 of the upstream-side printing unit group 20A is loaded from the memory M312 in Step P75. If the above inequality expression does not hold (N), the program shifts to Step P78 to be described later.

Subsequently to Step P75, it is determined in Step P76 whether the current rotational phase of the last impression cylinder 23 of the upstream-side printing unit group 20A is less than 10°. If this inequality expression holds (Y), in Step P77, 360° is added to the current rotational phase of the last impression cylinder 23 of the upstream-side printing unit group 20A, and the memory M312 for storing the current rotational phase of the last impression cylinder of the upstream-side printing unit group is overwritten with the result of addition. Then, in Step P78, the virtual current rotational phase of the last impression cylinder 23 of the upstream-side printing unit group 20A is loaded from the memory M303. If the above inequality expression does not hold (N), the program shifts to Step P78.

Then, in Step P79, it is determined whether the virtual current rotational phase of the last impression cylinder 23 of the upstream-side printing unit group 20A is less than 10°. If this inequality expression holds (Y), the current rotational phase of the last impression cylinder 23 of the upstream-side printing unit group 20A is loaded from the memory M312 in Step P80. If the above inequality expression does not hold (N), the program shifts to Step P83 to be described later.

Subsequently to Step P80, it is determined in Step P81 whether the current rotational phase of the last impression cylinder 23 of the upstream-side printing unit group 20A is greater than 350°. If this inequality expression holds (Y), in Step P82, 360° is added to the virtual current rotational phase of the last impression cylinder 23 of the upstream-side printing unit group 20A, and the memory M303 for storing the virtual current rotational phase of the last impression cylinder of the upstream-side printing unit group is overwritten with the result of addition. Then, in Step P83, the virtual current rotational phase of the last impression cylinder 23 of the upstream-side printing unit group 20A is loaded from the memory M303. If the above inequality expression does not hold (N), the program shifts to Step P83.

Then, in Step P84, the current rotational phase of the last impression cylinder 23 of the upstream-side printing unit group 20A is subtracted from the virtual current rotational phase of the last impression cylinder 23 of the upstream-side printing unit group 20A to compute the difference in the current rotational phase of the last impression cylinder 23 of the upstream-side printing unit group 20A, and the result of computation is stored into the memory M313. Then, in Step P85, the absolute value of the difference in the current rotational phase of the last impression cylinder 23 of the upstream-side printing unit group 20A is computed from the difference in the current rotational phase of the last impression cylinder 23 of the upstream-side printing unit group 20A, and the result of computation is stored into the memory M314. Then, in Step P86, the allowable value of the difference in the current rotational phase of the last impression cylinder of the upstream-side printing unit group is loaded from the memory M315.

Then, in Step P87, it is determined whether the absolute value of the difference in the current rotational phase of the last impression cylinder 23 of the upstream-side printing unit group 20A is equal to or less than the allowable value of the difference in the current rotational phase of the last impression cylinder 23 of the upstream-side printing unit group 20A. If this equality or inequality expression holds (Y), in Step P88, the memory M317 for storing the second correction value of the command rotational speed is overwritten with zero. Then, in Step P89, the current command rotational speed is loaded from the memory M301.

If the above equality or inequality expression does not hold (N), on the other hand, the program shifts to Step P104 in which the table of conversion from the difference in the current rotational phase of the last impression cylinder 23 of the upstream-side printing unit group 20A to the correction value of the command rotational speed is loaded from the memory M316. Then, in Step P105, the difference in the current rotational phase of the last impression cylinder 23 of the upstream-side printing unit group 20A is loaded from the memory M313. Then, in Step P106, the second correction value of the command rotational speed is obtained from the difference in the current rotational phase of the last impression cylinder 23 of the upstream-side printing unit group 20A with the use of the table of conversion from the difference in the current rotational phase of the last impression cylinder 23 of the upstream-side printing unit group 20A to the correction value of the command rotational speed, and the memory M317 is overwritten with the obtained correction value. Then, the program shifts to Step P89.

Then, in Step P90, the first correction value of the command rotational speed is loaded from the memory M310. Then, in Step P91, the second correction value of the command rotational speed is loaded from the memory M317. Then, in Step P92, the first and second correction values of the command rotational speed are added to the current command rotational speed to compute the command rotational speed, and the result of computation is stored into the memory M318.

Then, in Step P93, the command rotational speed is outputted to the upstream-side prime motor driver 312 via the D/A converter 311. Then, the program returns to Step P51. Thereafter, this procedure is repeated.

If the program shifts from Step P51 to Step P100, it is determined in Step P100 whether a drive stop command has been transmitted from the virtual master generator 200. If it has been transmitted (Y), control by the upstream-side printing unit group drive controller 300 is terminated. If the drive stop command has not been transmitted (N), the program returns to Step P51.

In accordance with the above-described operational or action flows, the upstream-side printing unit group drive controller 300 detects rotational phase differences (positional deviations) between the rotational phases which the upstream-side printing unit group 20A and the last impression cylinder 23 of the upstream-side printing unit group 20A should have upon setting by the virtual master generator 200, and the actual rotational phases of the upstream-side printing unit group 20A and the last impression cylinder 23 of the upstream-side printing unit group 20A, and corrects the rotational speed of the upstream-side prime motor 1A in accordance with these detected rotational phase differences, in response to the home position alignment start command and the drive stop command from the virtual master generator 200.

The downstream-side printing unit group drive controller 400 operates in accordance with action or operational flows shown in FIGS. 10A to 10E and FIGS. 11A to 11E.

In Step P1, it is determined whether a home position alignment start command has been transmitted from the virtual master generator 200. If the home position alignment start command has been transmitted (Y), the program shifts to Step P2 to be described later. If the home position alignment start command has not been transmitted (N), the program returns to Step P1.

In Step P2, it is determined whether the current command rotational speed (slower rotational speed), the virtual current rotational phase of the downstream-side printing unit group 20B, and the virtual current rotational phase of the first transfer cylinder 24 of the downstream-side printing unit group 20B have been transmitted from the virtual master generator. If they have been transmitted (Y), the program shifts to Step P3 to be described later. If they have not been transmitted (N), the program returns to Step P2.

In Step 3, the current command rotational speed (slower rotational speed), the virtual current rotational phase of the downstream-side printing unit group 20B, and the virtual current rotational phase of the first transfer cylinder 24 of the downstream-side printing unit group 20B are received from the virtual master generator 200, and they are respectively stored into the memory M401 for storing the current command rotational speed, the memory M402 for storing the virtual current rotational phase of the downstream-side printing unit group, and the memory M403 for storing the virtual current rotational phase of the first transfer cylinder of the downstream-side printing unit group.

Then, in Step P4, the count value is loaded from the counter 413 for detecting the current rotational phase of the downstream-side printing unit group, and stored into the memory M404. Then, in Step P5, the current rotational phase of the downstream-side printing unit group 20B is computed from the count value of the counter 413 for detecting the current rotational phase of the downstream-side printing unit group, and the result of computation is stored into the memory M405. Then, in Step P6, the virtual current rotational phase of the downstream-side printing unit group 20B is loaded from the memory M402.

Then, in Step P7, it is determined whether the virtual current rotational phase of the downstream-side printing unit group is greater than 350°. If this inequality expression holds (Y), the current rotational phase of the downstream-side printing unit group 20B is loaded from the memory M405 in Step P8. If the above inequality expression does not hold (N), the program shifts to Step P11 to be described later.

Subsequently to Step P8, it is determined in Step P9 whether the current rotational phase of the downstream-side printing unit group 20B is less than 10°. If this inequality expression holds (Y), in Step P10, 360° is added to the current rotational phase of the downstream-side printing unit group 20B, and the memory M405 for storing the current rotational phase of the downstream-side printing unit group is overwritten with the result of addition. Then, in Step P11, the virtual current rotational phase of the downstream-side printing unit group 20B is loaded from the memory M402. If the above inequality expression does not hold (N), the program shifts to Step P11.

Then, in Step P12, it is determined whether the virtual current rotational phase of the downstream-side printing unit group 20B is less than 10°. If this inequality expression holds (Y), the current rotational phase of the downstream-side printing unit group 20B is loaded from the memory M405 in Step P13. If the above inequality expression does not hold (N), the program shifts to Step P16 to be described later.

Subsequently to Step P13, it is determined in Step P14 whether the current rotational phase of the downstream-side printing unit group 20B is greater than 350°. If this inequality expression holds (Y), in Step P15, 360° is added to the virtual current rotational phase of the downstream-side printing unit group 20B, and the memory M402 for storing the virtual current rotational phase of the downstream-side printing unit group is overwritten with the result of addition. Then, in Step P16, the virtual current rotational phase of the downstream-side printing unit group 20B is loaded from the memory M402. If the above inequality expression does not hold (N), the program shifts to Step P16.

Then, in Step P17, the current rotational phase of the downstream-side printing unit group 20B is subtracted from the virtual current rotational phase of the downstream-side printing unit group 20B to compute the difference in the current rotational phase of the downstream-side printing unit group 20B, and the result of computation is stored into the memory M406. Then, in Step P18, the absolute value of the difference in the current rotational phase of the downstream-side printing unit group 20B is computed from the difference in the current rotational phase of the downstream-side printing unit group 20B, and the result of computation is stored into the memory M407. Then, in Step P19, the allowable value of the difference in the current rotational phase of the downstream-side printing unit group 20B is loaded from the memory M408.

Then, in Step P20, it is determined whether the absolute value of the difference in the current rotational phase of the downstream-side printing unit group 20B is equal to or less than the allowable value of the difference in the current rotational phase of the downstream-side printing unit group 20B. If this equality or inequality expression holds (Y), in Step P21, the memory M410 for storing the first correction value of the command rotational speed is overwritten with zero. Then, in Step P22, the count value is loaded from the counter 414 for detecting the current rotational phase of the first transfer cylinder of the downstream-side printing unit group, and is stored into the memory M411.

If the above equality or inequality expression does not hold (N), on the other hand, the program shifts to Step P94 in which the table of conversion from the difference in the current rotational phase of the downstream-side printing unit group 20B to the correction value of the command rotational speed is loaded from the memory M409. Then, in Step P95, the difference in the current rotational phase of the downstream-side printing unit group 20B is loaded from the memory M406. Then, in Step P96, the first correction value of the command rotational speed is obtained from the difference in the current rotational phase of the downstream-side printing unit group 20B with the use of the table of conversion from the difference in the current rotational phase of the downstream-side printing unit group 20B to the correction value of the command rotational speed, and the memory M410 is overwritten with the obtained correction value. Then, the program shifts to Step P22.

Then, in Step P23, the current rotational phase of the first transfer cylinder 24 of the downstream-side printing unit group 20B is computed from the count value of the counter 414 for detecting the current rotational phase of the first transfer cylinder of the downstream-side printing unit group, and the result of computation is stored into the memory M412. Then, in Step P24, the virtual current rotational phase of the first transfer cylinder 24 of the downstream-side printing unit group 20B is loaded from the memory M403.

Then, in Step P25, it is determined whether the virtual current rotational phase of the first transfer cylinder 24 of the downstream-side printing unit group 20B is greater than 350°. If this inequality expression holds (Y), the current rotational phase of the first transfer cylinder 24 of the downstream-side printing unit group 20B is loaded from the memory M412 in Step P26. If the above inequality expression does not hold (N), the program shifts to Step P29 to be described later.

Subsequently to Step P26, it is determined in Step P27 whether the current rotational phase of the first transfer cylinder 24 of the downstream-side printing unit group 20B is less than 10°. If this inequality expression holds (Y), in Step P28, 360° is added to the current rotational phase of the first transfer cylinder 24 of the downstream-side printing unit group 20B, and the memory M412 for storing the current rotational phase of the first transfer cylinder of the downstream-side printing unit group is overwritten with the result of addition. Then, in Step P29, the virtual current rotational phase of the first transfer cylinder 24 of the downstream-side printing unit group 20B is loaded from the memory M403. If the above inequality expression does not hold (N), the program shifts to Step P29.

Then, in Step P30, it is determined whether the virtual current rotational phase of the first transfer cylinder 24 of the downstream-side printing unit group 20B is less than 10°. If this inequality expression holds (Y), the current rotational phase of the first transfer cylinder 24 of the downstream-side printing unit group 20B is loaded from the memory M412 in Step P31. If the above inequality expression does not hold (N), the program shifts to Step P34 to be described later.

Subsequently to Step P31, it is determined in Step P32 whether the current rotational phase of the first transfer cylinder 24 of the downstream-side printing unit group 20B is greater than 350°. If this inequality expression holds (Y), in Step P33, 360° is added to the virtual current rotational phase of the first transfer cylinder 24 of the downstream-side printing unit group 20B, and the memory M403 for storing the virtual current rotational phase of the first transfer cylinder of the downstream-side printing unit group is overwritten with the result of addition. Then, in Step P34, the virtual current rotational phase of the first transfer cylinder 24 of the downstream-side printing unit group 20B is loaded from the memory M402. If the above inequality expression does not hold (N), the program shifts to Step P34.

Then, in Step P35, the current rotational phase of the first transfer cylinder 24 of the downstream-side printing unit group 20B is subtracted from the virtual current rotational phase of the first transfer cylinder 24 of the downstream-side printing unit group 20B to compute the difference in the current rotational phase of the first transfer cylinder 24 of the downstream-side printing unit group 20B, and the result of computation is stored into the memory M413. Then, in Step P36, the absolute value of the difference in the current rotational phase of the first transfer cylinder 24 of the downstream-side printing unit group 20B is computed from the difference in the current rotational phase of the first transfer cylinder 24 of the downstream-side printing unit group 20B, and the result of computation is stored into the memory M414. Then, in Step P37, the allowable value of the difference in the current rotational phase of the first transfer cylinder 24 of the downstream-side printing unit group 20B is loaded from the memory M415.

Then, in Step P38, it is determined whether the absolute value of the difference in the current rotational phase of the first transfer cylinder 24 of the downstream-side printing unit group 20B is equal to or less than the allowable value of the difference in the current rotational phase of the first transfer cylinder 24 of the downstream-side printing unit group 20B. If this equality or inequality expression holds (Y), in Step P39, the memory M417 for storing the second correction value of the command rotational speed is overwritten with zero. Then, in Step P40, the current command rotational speed (slower rotational speed) is loaded from the memory M401.

If the above equality or inequality expression does not hold (N), on the other hand, the program shifts to Step P97 in which the table of conversion from the difference in the current rotational phase of the first transfer cylinder 24 of the downstream-side printing unit group 20B to the correction value of the command rotational speed is loaded from the memory M416. Then, in Step P98, the difference in the current rotational phase of the first transfer cylinder 24 of the downstream-side printing unit group 20B is loaded from the memory M413. Then, in Step P99, the second correction value of the command rotational speed is obtained from the difference in the current rotational phase of the first transfer cylinder 24 of the downstream-side printing unit group 20B with the use of the table of conversion from the difference in the current rotational phase of the first transfer cylinder 24 of the downstream-side printing unit group 20B to the correction value of the command rotational speed, and the memory M417 is overwritten with the obtained correction value. Then, the program shifts to Step P40.

Then, in Step P41, the first correction value of the command rotational speed is loaded from the memory M410. Then, in Step P42, the second correction value of the command rotational speed is loaded from the memory M417. Then, in Step P43, the first and second correction values of the command rotational speed are added to the current command rotational speed (slower rotational speed) to compute the command rotational speed, and the result of computation is stored into the memory M418.

Then, in Step P44, the command rotational speed is outputted to the downstream-side prime motor driver 412 via the D/A converter 311. Then, in Step P45, the first correction value of the command rotational speed is loaded from the memory M410.

Then, in Step P46, it is determined whether the first correction value of the command rotational speed is equal to 0. If this equation holds (Y), the second correction value of the command rotational speed is loaded from the memory M417 in Step P47. If the above equation does not hold (N), the program returns to Step P2.

Subsequently to Step P47, it is determined in Step P48 whether the second correction value of the command rotational speed is equal to 0. If this equation holds (Y), the number of the downstream-side printing unit group is loaded from the memory M419 in Step P49. If the above equation does not hold (N), the program returns to Step P2.

Subsequently to Step P49, the home position alignment completion signal and the number of the downstream-side printing unit group are transmitted to the virtual master generator 200 in Step P50. Then, the program shifts to Step P51.

In Step P51, it is determined whether the current command rotational speed, the virtual current rotational phase of the downstream-side printing unit group 20B, and the virtual current rotational phase of the first transfer cylinder 24 of the downstream-side printing unit group 20B have been transmitted from the virtual master generator 200. If they have been transmitted (Y), the program shifts to Step P52 to be described later. If they have not been transmitted (N), the program shifts to Step P100 to be described later.

If the program shifts from Step P51 to Step P52, in Step P52, the current command rotational speed, the virtual current rotational phase of the downstream-side printing unit group 20B, and the virtual current rotational phase of the first transfer cylinder 24 of the downstream-side printing unit group 20B are received from the virtual master generator 200, and they are respectively stored into the memory M401 for storing the current command rotational speed, the memory M402 for storing the virtual current rotational phase of the downstream-side printing unit group, and the memory M403 for storing the virtual current rotational phase of the first transfer cylinder of the downstream-side printing unit group.

Then, in Step P53, the count value is loaded from the counter 413 for detecting the current rotational phase of the downstream-side printing unit group, and stored into the memory M404. Then, in Step P54, the current rotational phase of the downstream-side printing unit group 20B is computed from the count value of the counter 413 for detecting the current rotational phase of the downstream-side printing unit group, and the result of computation is stored into the memory M405. Then, in Step P55, the virtual current rotational phase of the downstream-side printing unit group 20B is loaded from the memory M402.

Then, in Step P56, it is determined whether the virtual current rotational phase of the downstream-side printing unit group 20B is greater than 350°. If this inequality expression holds (Y), the current rotational phase of the downstream-side printing unit group 20B is loaded from the memory M405 in Step P57. If the above inequality expression does not hold (N), the program shifts to Step P60 to be described later.

Subsequently to Step P57, it is determined in Step P58 whether the current rotational phase of the downstream-side printing unit group 20B is less than 10°. If this inequality expression holds (Y), in Step P59, 360° is added to the current rotational phase of the downstream-side printing unit group 20B, and the memory M405 for storing the current rotational phase of the downstream-side printing unit group is overwritten with the result of addition. Then, in Step P60, the virtual current rotational phase of the downstream-side printing unit group 20B is loaded from the memory M402. If the above inequality expression does not hold (N), the program shifts to Step P60.

Then, in Step P61, it is determined whether the virtual current rotational phase of the downstream-side printing unit group 20B is less than 10°. If this inequality expression holds (Y), the current rotational phase of the downstream-side printing unit group 20B is loaded from the memory M405 in Step P62. If the above inequality expression does not hold (N), the program shifts to Step P65 to be described later.

Subsequently to Step P62, it is determined in Step P63 whether the current rotational phase of the downstream-side printing unit group 20B is greater than 350°. If this inequality expression holds (Y), in Step P64, 360° is added to the virtual current rotational phase of the downstream-side printing unit group 20B, and the memory M402 for storing the virtual current rotational phase of the downstream-side printing unit group is overwritten with the result of addition. Then, in Step P65, the virtual current rotational phase of the downstream-side printing unit group 20B is loaded from the memory M402. If the above inequality expression does not hold (N), the program shifts to Step P65.

Then, in Step P66, the current rotational phase of the downstream-side printing unit group 20B is subtracted from the virtual current rotational phase of the downstream-side printing unit group 20B to compute the difference in the current rotational phase of the downstream-side printing unit group 20B, and the result of computation is stored into the memory M406. Then, in Step P67, the absolute value of the difference in the current rotational phase of the downstream-side printing unit group 20B is computed from the difference in the current rotational phase of the downstream-side printing unit group 20B, and the result of computation is stored into the memory M407. Then, in Step P68, the allowable value of the difference in the current rotational phase of the downstream-side printing unit group 20B is loaded from the memory M408.

Then, in Step P69, it is determined whether the absolute value of the difference in the current rotational phase of the downstream-side printing unit group 20B is equal to or less than the allowable value of the difference in the current rotational phase of the downstream-side printing unit group 20B. If this equality or inequality expression holds (Y), in Step P70, the memory M410 for storing the first correction value of the command rotational speed is overwritten with zero. Then, in Step P71, the count value is loaded from the counter 414 for detecting the current rotational phase of the first transfer cylinder of the downstream-side printing unit group, and is stored into the memory M411.

If the above equality or inequality expression does not hold (N), on the other hand, the program shifts to Step P101 in which the table of conversion from the difference in the current rotational phase of the downstream-side printing unit group 20B to the correction value of the command rotational speed is loaded from the memory M409. Then, in Step P102, the difference in the current rotational phase of the downstream-side printing unit group 20B is loaded from the memory M406. Then, in Step P103, the first correction value of the command rotational speed is obtained from the difference in the current rotational phase of the downstream-side printing unit group 20B with the use of the table of conversion from the difference in the current rotational phase of the downstream-side printing unit group 20B to the correction value of the command rotational speed, and the memory M410 is overwritten with the obtained correction value. Then, the program shifts to Step P71.

Then, in Step P72, the current rotational phase of the first transfer cylinder 24 of the downstream-side printing unit group 20B is computed from the count value of the counter 414 for detecting the current rotational phase of the first transfer cylinder of the downstream-side printing unit group, and the result of computation is stored into the memory M412. Then, in Step P73, the virtual current rotational phase of the first transfer cylinder 24 of the downstream-side printing unit group 20B is loaded from the memory M403.

Then, in Step P74, it is determined whether the virtual current rotational phase of the first transfer cylinder 24 of the downstream-side printing unit group 20B is greater than 350°. If this inequality expression holds (Y), the current rotational phase of the first transfer cylinder 24 of the downstream-side printing unit group 20B is loaded from the memory M412 in Step P75. If the above inequality expression does not hold (N), the program shifts to Step P78 to be described later.

Subsequently to Step P75, it is determined in Step P76 whether the current rotational phase of the first transfer cylinder 24 of the downstream-side printing unit group 20B is less than 10°. If this inequality expression holds (Y), in Step P77, 360° is added to the current rotational phase of the first transfer cylinder 24 of the downstream-side printing unit group 20B, and the memory M412 for storing the current rotational phase of the first transfer cylinder of the downstream-side printing unit group is overwritten with the result of addition. Then, in Step P78, the virtual current rotational phase of the first transfer cylinder 24 of the downstream-side printing unit group 20B is loaded from the memory M403. If the above inequality expression does not hold (N), the program shifts to Step P78.

Then, in Step P79, it is determined whether the virtual current rotational phase of the first transfer cylinder 24 of the downstream-side printing unit group 20B is less than 10°. If this inequality expression holds (Y), the current rotational phase of the first transfer cylinder 24 of the downstream-side printing unit group 20B is loaded from the memory M412 in Step P80. If the above inequality expression does not hold (N), the program shifts to Step P83 to be described later.

Subsequently to Step P80, it is determined in Step P81 whether the current rotational phase of the first transfer cylinder 24 of the downstream-side printing unit group 20B is greater than 350°. If this inequality expression holds (Y), in Step P82, 360° is added to the virtual current rotational phase of the first transfer cylinder 24 of the downstream-side printing unit group 20B, and the memory M403 for storing the virtual current rotational phase of the first transfer cylinder of the downstream-side printing unit group is overwritten with the result of addition. Then, in Step P83, the virtual current rotational phase of the first transfer cylinder 24 of the downstream-side printing unit group 20B is loaded from the memory M403. If the above inequality expression does not hold (N), the program shifts to Step P83.

Then, in Step P84, the current rotational phase of the first transfer cylinder 24 of the downstream-side printing unit group 20B is subtracted from the virtual current rotational phase of the first transfer cylinder 24 of the downstream-side printing unit group 20B to compute the difference in the current rotational phase of the first transfer cylinder 24 of the downstream-side printing unit group 20B, and the result of computation is stored into the memory M413. Then, in Step P85, the absolute value of the difference in the current rotational phase of the first transfer cylinder 24 of the downstream-side printing unit group 20B is computed from the difference in the current rotational phase of the first transfer cylinder 24 of the downstream-side printing unit group 20B, and the result of computation is stored into the memory M414. Then, in Step P86, the allowable value of the difference in the current rotational phase of the first transfer cylinder of the downstream-side printing unit group is loaded from the memory M415.

Then, in Step P87, it is determined whether the absolute value of the difference in the current rotational phase of the first transfer cylinder 24 of the downstream-side printing unit group 20B is equal to or less than the allowable value of the difference in the current rotational phase of the first transfer cylinder 24 of the downstream-side printing unit group 20B. If this equality or inequality expression holds (Y), in Step P88, the memory M417 for storing the second correction value of the command rotational speed is overwritten with zero. Then, in Step P89, the current command rotational speed is loaded from the memory M401.

If the above equality or inequality expression does not hold (N), on the other hand, the program shifts to Step P104 in which the table of conversion from the difference in the current rotational phase of the first transfer cylinder 24 of the downstream-side printing unit group 20B to the correction value of the command rotational speed is loaded from the memory M416. Then, in Step P105, the difference in the current rotational phase of the first transfer cylinder 24 of the downstream-side printing unit group 20B is loaded from the memory M413. Then, in Step P106, the second correction value of the command rotational speed is obtained from the difference in the current rotational phase of the first transfer cylinder 24 of the downstream-side printing unit group 20B with the use of the table of conversion from the difference in the current rotational phase of the first transfer cylinder 24 of the downstream-side printing unit group 20B to the correction value of the command rotational speed, and the memory M417 is overwritten with the obtained correction value. Then, the program shifts to Step P89.

Then, in Step P90, the first correction value of the command rotational speed is loaded from the memory M410. Then, in Step P91, the second correction value of the command rotational speed is loaded from the memory M417.

Then, in Step P92, the first and second correction values of the command rotational speed are added to the current command rotational speed to compute the command rotational speed, and the result of computation is stored into the memory M418. Then, in Step P93, the command rotational speed is outputted to the downstream-side prime motor driver 412 via the D/A converter 411. Then, the program returns to Step P51. Thereafter, this procedure is repeated.

If the program shifts from Step P51 to Step P100, it is determined whether a drive stop command has been transmitted from the virtual master generator 200 in Step P100. If it has been transmitted (Y), control by the downstream-side printing unit group drive controller 400 is terminated. If the drive stop command has not been transmitted (N), the program returns to Step P51.

In accordance with the above-described operational or action flows, the downstream-side printing unit group drive controller 400 detects rotational phase differences (positional deviations) between the rotational phases which the downstream-side printing unit group 20B and the first transfer cylinder 24 of the downstream-side printing unit group 20B should have upon setting by the virtual master generator 200 and the actual rotational phases of the downstream-side printing unit group 20B and the first transfer cylinder 24 of the downstream-side printing unit group 20B, and corrects the rotational speed of the downstream-side prime motor 1B in accordance with these detected rotational phase differences, in response to the home position alignment start command and the drive stop command from the virtual master generator 200. By so doing, the upstream-side prime motor 1A and the downstream-side prime motor 1B are synchronously controlled.

In the present embodiment, as described above, the upstream-side printing unit group 20A and the downstream-side printing unit group 20B are separately driven by the upstream-side prime motor 1A and the downstream-side prime motor 1B and synchronously controlled, and the last located impression cylinder 23 of the upstream-side printing unit group 20A and the first located transfer cylinder 24 of the downstream-side printing unit group 20B are respectively provided with the counters 314 and 414 and the rotary encoders 8E and 8D. According to this configuration, the difference between the rotational phase which the last located impression cylinder 23 of the upstream-side printing unit group 20A should have and the actual rotational phase of the last located impression cylinder 23 of the upstream-side printing unit group 20A, and the difference between the rotational phase which the first located transfer cylinder 24 of the downstream-side printing unit group 20B should have and the actual rotational phase of the first located transfer cylinder 24 of the downstream-side printing unit group 20B are detected, and the rotational speeds of the upstream-side prime motor 1A and the downstream-side prime motor 1B are corrected in accordance with the detected rotational phase differences.

Hence, control can be exercised in consideration of rotational speed variations due to backlash within the gear train between the upstream-side prime motor 1A and the last located impression cylinder 23 of the upstream-side printing unit group 20A, as well as rotational speed variations due to backlash within the gear train between the downstream-side prime motor 1B and the first located transfer cylinder 24 of the downstream-side printing unit group 20B. Accordingly, when the sheet is transferred from the upstream-side printing unit group 20A to the downstream-side printing unit group 20B, the sheet can be transferred every time at the exact position.

Furthermore, the counters 313, 314, 413, 414 for detecting the rotational phases of the printing unit groups 20A, 20B are reset by utilizing the signals from the home position detector 6 provided for the last located impression cylinder 23 of the upstream-side printing unit group 20A, whereby the positions of resetting of all the counters 313, 314, 413, 414 are brought into conformity. Thus, an error can be prevented from occurring during sheet transfer from the upstream-side printing unit group 20A to the downstream-side printing unit group 20B.

In the above embodiment, the home position detector 6 is provided for the last located impression cylinder 23 of the upstream-side printing unit group 20A. However, the home position detector 6 may be provided for the first located transfer cylinder 24 of the downstream-side printing unit group 20B.

In the embodiment, moreover, the rotary encoders 8A and 8C are provided at the first impression cylinder 23 of the upstream-side printing unit group 20A, and the first impression cylinder 23 of the downstream-side printing unit group 20B. However, if the upstream-side printing unit group 20A is directly driven by the gear of the upstream-side prime motor 1A, and if the downstream-side printing unit group 20B is directly driven by the gear of the downstream-side prime motor 1B, no slip occurs between the upstream-side prime motor 1A and the upstream-side printing unit group 20A or between the downstream-side prime motor 1B and the downstream-side printing unit group 20B. In such cases, therefore, the rotary encoder 8A may be provided to be coupled integrally to the shaft of the upstream-side prime motor 1A, and the rotary encoder 8C maybe provided to be coupled integrally to the shaft of the downstream-side prime motor 1B so that the rotary encoder 8A and the rotary encoder 8C concurrently serve as the rotary encoder 1AR for the upstream-side prime motor and the rotary encoder 1BR for the downstream-side prime motor. As seen here, it goes without saying that the present invention is not limited to the above embodiment, and various changes and modifications maybe made without departing from the gist of the present invention.

REFERENCE SIGNS LIST

1A Upstream-side prime motor
1B Downstream-side prime motor
2 Gear of impression cylinder
3 Gear of transfer cylinder
6 Home position detector
8A Rotary encoder for detecting current rotational phase of upstream-side printing unit group
8B Rotary encoder for detecting current rotational phase of last impression cylinder of upstream-side printing unit group
8C Rotary encoder for detecting current rotational phase of downstream-side printing unit group
8D Rotary encoder for detecting current rotational phase of first transfer cylinder of downstream-side printing unit group
10 Feeder
20 Printing section
20A Upstream-side printing unit group
20B Downstream-side printing unit group
23 Impression cylinder
24 Transfer cylinder
30 Delivery unit
100 Central controller
200 Virtual master generator
300 Upstream-side printing unit group drive controller
400 Downstream-side printing unit group drive controller

The invention claimed is:

1. A drive control method for a processing machine which includes, first drive means, first driven means driven by the first drive means, second driven means rotationally driven by the first drive means via the first driven means, a first rotating body provided with a first holding portion for holding a member to be processed, and rotationally driven by the second driven means, and a second rotating body provided with a second holding portion for receiving the member to be processed, from the first holding portion of the first rotating body, the drive control method comprising:

providing second drive means for rotationally driving the second rotating body; indicating means for indicating a rotational phase and a rotational speed which the first rotating body should have; first rotational phase detecting means for detecting a rotational phase of the first drive means; and second rotational phase detecting means for detecting a rotational phase of the first rotating body; and controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

2. The drive control method for a processing machine according to claim 1, further comprising:

providing home position detecting means provided for the first rotating body and adapted to detect a home position of the rotational phase of the first rotating body, wherein the first rotational phase detecting means and the second rotational phase detecting means are reset by a signal from the home position detecting means.

3. The drive control method for a processing machine according to claim 1, further comprising:

providing home position detecting means provided for the second rotating body and adapted to detect a home position of a rotational phase of the second rotating body, wherein the first rotational phase detecting means and the second rotational phase detecting means are reset by a signal from the home position detecting means.

4. A drive control method for a processing machine which includes, first drive means, first driven means driven by the first drive means, second driven means rotationally driven by the first drive means via the first driven means, a first rotating body provided with a first holding portion for holding a member to be processed, and rotationally driven by the second driven means, and a second rotating body provided with a second holding portion for passing the member to be processed, on to the first holding portion of the first rotating body, the drive control method comprising:

providing second drive means for rotationally driving the second rotating body; indicating means for indicating a rotational phase and a rotational speed which the first rotating body should have; first rotational phase detecting means for detecting a rotational phase of the first drive means; and second rotational phase detecting means for detecting a rotational phase of the first rotating body; and controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

5. The drive control method for a processing machine according to claim 4, further comprising:

providing home position detecting means provided for the first rotating body and adapted to detect a home position of the rotational phase of the first rotating body, wherein the first rotational phase detecting means and the second rotational phase detecting means are reset by a signal from the home position detecting means.

6. The drive control method for a processing machine according to claim 4, further comprising:

providing home position detecting means provided for the second rotating body and adapted to detect a home position of a rotational phase of the second rotating body, wherein the first rotational phase detecting means and the second rotational phase detecting means are reset by a signal from the home position detecting means.

7. A drive control apparatus for a processing machine, comprising:

first drive means;

first driven means driven by the first drive means;

second driven means rotationally driven by the first drive means via the first driven means;

a first rotating body provided with a first holding portion for holding a member to be processed, and rotationally driven by the second driven means;

a second rotating body provided with a second holding portion for receiving the member to be processed, from the first holding portion of the first rotating body;

second drive means for rotationally driving the second rotating body;

indicating means for indicating a rotational phase and a rotational speed which the first rotating body should have;

first rotational phase detecting means for detecting a rotational phase of the first drive means;

second rotational phase detecting means for detecting a rotational phase of the first rotating body; and control means for controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

8. The drive control apparatus for a processing machine according to claim 7, further comprising:

home position detecting means provided for the first rotating body and adapted to detect a home position of the rotational phase of the first rotating body, wherein the first rotational phase detecting means and the second rotational phase detecting means are reset by a signal from the home position detecting means.

9. The drive control apparatus for a processing machine according to claim 7, further comprising:

home position detecting means provided for the second rotating body and adapted to detect a home position of a rotational phase of the second rotating body, wherein the first rotational phase detecting means and the second rotational phase detecting means are reset by a signal from the home position detecting means.

10. A drive control apparatus for a processing machine, comprising:

first drive means;

first driven means driven by the first drive means;

second driven means rotationally driven by the first drive means via the first driven means;

a first rotating body provided with a first holding portion for holding a member to be processed, and rotationally driven by the second driven means a second rotating body provided with a second holding portion for passing the member to be processed, on to the first holding portion of the first rotating body;

second drive means for rotationally driving the second rotating body;

indicating means for indicating a rotational phase and a rotational speed which the first rotating body should have;

first rotational phase detecting means for detecting a rotational phase of the first drive means;

second rotational phase detecting means for detecting a rotational phase of the first rotating body; and control means for controlling a rotational speed of the first drive means based on the rotational phase and the rotational speed, which the first rotating body should have, from the indicating means, the rotational phase of the first drive means from the first rotational phase detecting means, and the rotational phase of the first rotating body from the second rotational phase detecting means.

11. The drive control apparatus for a processing machine according to claim 10, further comprising:

home position detecting means provided for the first rotating body and adapted to detect a home position of the rotational phase of the first rotating body, wherein the first rotational phase detecting means and the second rotational phase detecting means are reset by a signal from the home position detecting means.

12. The drive control apparatus for a processing machine according to claim 10, further comprising:

home position detecting means provided for the second rotating body and adapted to detect a home position of a rotational phase of the second rotating body, wherein the first rotational phase detecting means and the second rotational phase detecting means are reset by a signal from the home position detecting means.

* * * * *